US012338578B2

(12) United States Patent
Leach et al.

(10) Patent No.: US 12,338,578 B2
(45) Date of Patent: Jun. 24, 2025

(54) SYSTEM AND METHOD FOR REFINING AGRICULTURAL FIBERS TO A PULP SPECIFICATION

(71) Applicant: KANBOL, INC., Auburn, KY (US)

(72) Inventors: Miles Leach, Franklin, KY (US); Michel McKenzie, Valleyfield (CA)

(73) Assignee: Kanbol, Inc., Auburn, KY (US)

( * ) Notice: Subject to any disclaimer, the term of this patent is extended or adjusted under 35 U.S.C. 154(b) by 0 days.

(21) Appl. No.: 17/825,964

(22) Filed: May 26, 2022

(65) Prior Publication Data

US 2022/0389657 A1 Dec. 8, 2022

Related U.S. Application Data

(60) Provisional application No. 63/194,345, filed on May 28, 2021, provisional application No. 63/280,855, filed on Nov. 18, 2021.

(51) Int. Cl.
*D21C 11/12* (2006.01)
*D21C 1/06* (2006.01)
(Continued)

(52) U.S. Cl.
CPC ..... *D21H 11/12* (2013.01); *D21C 1/06* (2013.01); *D21C 3/02* (2013.01); *D21H 25/005* (2013.01)

(58) Field of Classification Search
CPC ..... D21H 11/12; D21H 25/005; D21C 1/06; D21C 3/02
See application file for complete search history.

(56) References Cited

U.S. PATENT DOCUMENTS 2,783,146 A 2/1957 McKee
3,313,677 A 4/1967 Carr
(Continued)

FOREIGN PATENT DOCUMENTS

CN 101613728 B 12/2012
CN 105064116 A 11/2015
(Continued)

OTHER PUBLICATIONS

Dale R. Sanchez, Recausticizeing—Principles and Practice, 2015, TAPPI (Year: 2015).*
(Continued)

*Primary Examiner* — Jacob T Minskey
*Assistant Examiner* — Stephen M Russell
(74) *Attorney, Agent, or Firm* — Workman Nydegger

(57) ABSTRACT

Methods and systems for preparing non-wood agricultural feedstock material for use as a pulp, and making a paper product therefrom. The method includes providing non-wood agricultural feedstock material (e.g., corn stover) that includes agricultural fibers, chemically pulping the agricultural fibers at a low temperature of less than 100° C., refining the agricultural fibers (either before or after cooking), and introducing the produced agricultural fiber pulp into a paper-making machine to make liner, medium, tissue, towel, cardstock or other paper product (e.g., tubes, cores, chipboard, grayboard, or other rigid container board). The agricultural pulp fibers can also be introduced into a molded pulp products manufacturing machine, to make egg cartons, molded paper plates, molded single use packaging, or the like.

22 Claims, 23 Drawing Sheets

(51) Int. Cl.

| | |
|---|---|
| ***D21C 3/02*** | (2006.01) |
| ***D21H 11/12*** | (2006.01) |
| ***D21H 25/00*** | (2006.01) |

(56) References Cited

U.S. PATENT DOCUMENTS

| | | | | |
|---|---|---|---|---|
| 6,048,917 | A | 4/2000 | Hammer et al. | |
| 6,302,997 | B1 | 10/2001 | Hurter et al. | |
| 6,379,594 | B1 | 4/2002 | Dopfner et al. | |
| 7,867,358 | B2 | 1/2011 | Medoff | |
| 7,887,672 | B2 | 2/2011 | Yang et al. | |
| 8,157,955 | B2 | 4/2012 | Foody, Sr. | |
| 8,303,772 | B2 | 11/2012 | Li et al. | |
| 8,778,135 | B2 | 7/2014 | Li et al. | |
| 9,375,703 | B2 | 6/2016 | Harlin et al. | |
| 9,719,213 | B2 | 8/2017 | Miller, IV et al. | |
| 9,777,429 | B2 | 10/2017 | Mikulic | |
| 9,938,663 | B2 | 4/2018 | Powars | |
| 10,077,531 | B2 | 9/2018 | Schroeder et al. | |
| 10,544,547 | B2 | 1/2020 | Sealey et al. | |
| 10,662,586 | B2 | 5/2020 | Kokko et al. | |
| 12,195,919 | B2 | 1/2025 | Leach et al. | |
| 2002/0148575 | A1* | 10/2002 | Wingerson | D21C 3/02 162/14 |
| 2003/0041982 | A1 | 3/2003 | Prior | |
| 2004/0256065 | A1 | 12/2004 | Ahmed et al. | |
| 2006/0201641 | A1* | 9/2006 | Harris | D21C 11/125 162/239 |
| 2007/0095491 | A1 | 5/2007 | Altheimer | |
| 2007/0199669 | A1* | 8/2007 | Yang | D21C 3/02 162/96 |
| 2008/0187735 | A1 | 8/2008 | Hammer et al. | |
| 2014/0205777 | A1 | 7/2014 | Hawkins et al. | |
| 2014/0352903 | A1 | 12/2014 | Ernegg | |
| 2015/0232703 | A1* | 8/2015 | Nelson | C08H 8/00 523/210 |
| 2016/0130762 | A1 | 5/2016 | Ramaratnam et al. | |
| 2016/0257486 | A1 | 9/2016 | Kuiper et al. | |
| 2016/0355444 | A1 | 12/2016 | Olkowski et al. | |
| 2017/0016179 | A1 | 1/2017 | Olkowski et al. | |
| 2017/0328011 | A1 | 11/2017 | Sealey, II et al. | |
| 2018/0134472 | A1 | 5/2018 | Shi et al. | |
| 2018/0299059 | A1 | 10/2018 | McGoff et al. | |
| 2019/0264385 | A1 | 8/2019 | Pauwels et al. | |
| 2019/0284760 | A1* | 9/2019 | Hoekstra | D21H 17/005 |
| 2019/0390405 | A1* | 12/2019 | Geigle | D21C 3/022 |
| 2020/0056333 | A1* | 2/2020 | Backfolk | D21H 27/10 |
| 2020/0189256 | A1 | 6/2020 | Field et al. | |
| 2021/0355636 | A1 | 11/2021 | Mikulic | |
| 2023/0151547 | A1 | 5/2023 | Leach et al. | |

FOREIGN PATENT DOCUMENTS

| | | | |
|---|---|---|---|
| CN | 106012635 | A | 10/2016 |
| CN | 106012650 | A | 10/2016 |
| CN | 106087503 | A | 11/2016 |
| CN | 108589371 | A | 9/2018 |
| CN | 110318278 | A | 10/2019 |
| CN | 110700004 | A | 1/2020 |
| CN | 111691215 | A | 9/2020 |
| CN | 111691221 | A | 9/2020 |
| CN | 111996827 | A | 11/2020 |
| CN | 112176762 | A | 1/2021 |
| CN | 112813718 | A | 5/2021 |
| CN | 113106769 | A | 7/2021 |
| CN | 113265898 | A | 8/2021 |
| CN | 113389085 | A | 9/2021 |
| EP | 0743393 | A2 | 11/1996 |
| EP | 3172378 | B1 | 4/2018 |
| IN | 219632 | | 10/2007 |
| KR | 10-2005-0003545 | A | 1/2005 |
| WO | 2003/025280 | A1 | 3/2003 |
| WO | 2009/015555 | A1 | 2/2009 |
| WO | 2009/015556 | A1 | 2/2009 |
| WO | 2016/011736 | A1 | 1/2016 |
| WO | 2016/013946 | A1 | 1/2016 |
| WO | 2016/051202 | A1 | 4/2016 |
| WO | 2019/210221 | A1 | 10/2019 |
| WO | 2020/048176 | A1 | 3/2020 |
| WO | 2020/261165 | A1 | 12/2020 |
| WO | 2022/052775 | A1 | 3/2022 |

OTHER PUBLICATIONS

El-Saied et al., "Bagasse semichemical pulp by alkaline hydrogen peroxide treatment", IPPTA Journal, Mar. 2022, vol. 14, No. 1, pp. 14.

Aguilar-Rivera, "Sustainable Sugarcane Bagasse Cellulose for Papermaking", Advanced Engineering Materials and Modeling, Chapter 4, 2016, pp. 121-163.

El-Saied et al., "Bagasse semichemical pulp by alkali treatment", IPPTA vol. 13, No. 4, Dec. 2001, pp. 39-46.

Cheng et al., "Alkali extraction of hemicellulose from depithed com stover and effects on soda-AQ pulping," BioRes. 6 (2011), 196-206, 2005. Retrieved at http://ojs.cnr.ncsu.edu/index.php/BioRes/article/viewFile/BioRes_06_1_0196_Cheng_ZFL_Alk_Extrac_Hemicel_Corn_Stover/799.

Delmas, "Vegetal Refining and Agrichemistry," Chem. Eng. Technology, vol. 31, Issue 5, 2008, pp. 792-797.

Goel et al., "Switchgrass: A potential pulp fibre source," Pulp and Paper Canada 2000, vol. 101, Issue 6, pp. 41-45.

Gutierrez et al., "Chemical characterization of pitch deposits produced in the manufacturing of high-quality paper pulps from hemp fibers," Bioresource Technology, vol. 96, 2005, pp. 1445-1450.

Kortekaas, "Sequenced Anaerobic-Aerobic Treatment of Hemp Pulping Wastewaters", Waginengen Agricultural University, 1998, Retrieved at https://library.wur.nl/WebQuery/wurpubs/fulltext/193312, Nov. 4, 1998, pp. 153.

Law et al., "Fibre morphology and soda-sulphite pulping of switchgrass," Bioresource Technology, vol. 77, 2001, pp. 1-7.

Mussatto et al., "Lignin recovery from brewer's spent grain black liquor," Carbohydrate Polymers, vol. 70, Issue 2, Sep. 20, 2007, pp. 218-223.

Theng et al., "Fiberboards Made from Corn Stalk Thermomechanical Pulp and Kraft Lignin as a Green Adhesive," BioResources 2017, vol. 12, Issue 2, pp. 2379-2393.

Van der Werf et al., "Quality of hemp (*Cannabis sativa* L.) stems as a raw material for paper," Industrial Crops and Products, vol. 2, Issue 3, May 1994, pp. 219-227.

Zhai et al., "Ultrastructure and Topochemistry of Delignification in Alkaline Pulping of Wheat Straw," Journal of Wood Chemistry and Technology 1989, 9:3, pp. 387-406.

Katherine E. Semple et al., Moulded pulp fibers for disposable food packaging: A state-of-the-art review., Aug. 20, 2021, Food Packaging and Shelf Life, 18 pages, vol. 33.

Gary A. Smook, "Handbook for Pulp & Paper Technologists," 2nd Edition, 1992, chapter 9, Angus Wilde Publications, Vancouver, B.C.

International Search Report from corresponding PCT Application PCT/US2022/072613, mailed Oct. 25, 2022.

International Search Report from corresponding PCT Application PCT/US22/80072, mailed Mar. 31, 2023.

Non-Final Rejection Mailed on Jul. 31, 2024 for U.S. Appl. No. 17/989,255, 11 page(s).

Notice of Allowance received for U.S. Appl. No. 17/989,255, mailed on Sep. 18, 2024, 11 pages.

* cited by examiner

SYSTEM AND METHOD FOR REFINING AGRICULTURAL FIBERS TO A PULP SPECIFICATION

CROSS-REFERENCE TO RELATED APPLICATIONS

The present invention claims the benefit under 35 USC 119(e) of U.S. Application No. 63/194,345, filed May 28, 2021, and entitled SYSTEM AND METHOD FOR REFINING AGRICULTURAL RESIDUALS TO A PULP SPECIFICATION, as well as U.S. Application No. 63/280,855, filed Nov. 18, 2021, and entitled MULTI-STEP LOW TEMPERATURE AND LOW PRESSURE PROCESS FOR AGRICULTURAL RESIDUE STOCK PREPARATION WITH HEMICELLULOSE AND LIGNIN RECOVERY, each of which is herein incorporated by reference in its entirety.

FIELD OF THE INVENTION

Example embodiments of the present invention generally involve the production and use of feedstock blends, and products such as cardboard and paperboard (e.g., corrugated containerboard), made from feedstock blends, that may include one or more types of agricultural fibers and/or other non-wood fibers in various quantities.

BACKGROUND

Some recent environmental protection efforts are targeting problems such as global warming due to increased greenhouse gas emissions (GHG). Some studies indicate that approximately 80% of GHGs consist of carbon. Forest resources may help to sequester carbon, and thereby reduce GHGs. However, such resources provide a significant amount of materials for use in the pulp and paper industry. In order to preserve, if not improve, the ability of forest resources to sequester the carbon found in GHGs, there is a need to exert further efforts to protect forest resources.

Particular focus has been placed on the pulp and paper industry, which has traditionally harvested forest resources in high volumes. The paper recycling industry has continued to grow in recent years, and in a process common to the industry, used pulp and paper fibers can be recovered and used as feedstock (recycled paper) for the manufacturing of new corrugated containers, or other products. This has helped start the industry toward a decrease in forest resource consumption.

Although there has been some effort in the field to use pulp fibers derived from agricultural residues and other agricultural feedstock materials, two of many remaining challenges has been the very high capital investment required for conventional pulping systems and equipment, as well as the significant pollution associated with the black liquor and other waste streams generated through conventional pulping processes. Another challenge with use of non-wood agricultural fibers is the typically low yield achieved (e.g., less than 60%, or even less than 50%).

By way of additional background, U.S. Pat. No. 6,302,997 to Hurter describes use of nonwood pulp materials for use in papermaking, although the methods described therein rely on pressurized cooking (which then requires an expensive cold blow discharge tank), acidification of the pulp, and treatment with ozone and bleaching solutions. Such processes are complex and expensive. An aspect of the present invention is to provide an alternative process that would be far simpler and less expensive, and would not expose the material being pulped to high temperatures, pressures, or to such acids, ozone, bleaching agents, etc.

Several other references also suggest use of non-wood materials for use in papermaking, e.g., U.S. Pat. No. 8,303,772 to Li, US 2004/0256065 to Ahmed, US 2007/0095491 to Altheimer, WO 2006/132462 to Ryu, and CN 111691221 to Liu, although each of these references performs cooking at high temperature, far in excess of 100° C. (e.g., 140° C.-170° C.), with problems attendant thereto, as described herein. Additional references, e.g., CN 106012635 to Feng, CN 106012650 to Yang, CN113265898 to Wang, CN 112176762 to Luan, and CN 113389085 to Wang each rely on use of enzymatic treatment of the non-wood material. The presently contemplated processes differ from such in that enzymes are destroyed at temperatures of greater than 60° C., or greater than 70° C. (where the present processes operate), and use of enzymes in processes as described in such references is very expensive, not suitable for a process intended to produce an alternative pulp material, to be commercially competitive with OCC pulp. Another exemplary reference is U.S. Pat. No. 9,908,680 to Shi, which employs red algae and similar seaweed non-wood pulp materials, precisely because such materials do not include lignin. The present processes are directed to solutions for non-wood pulp materials that do in fact include lignin which needs to be removed (e.g., such as corn stover). In addition, although Shi may describe manufacture of paper products including a blend of such seaweed pulp with wheat straw or corn stover pulp, there is no teaching or suggestion of a low temperature, low pressure, simple and inexpensive process that could be used to produce non-wood pulp materials that might be comparable in cost to low cost alternatives, such as OCC. In an embodiment, the present systems and methods do not employ seaweed, algae or similar marine feedstocks.

SUMMARY

An embodiment of the present invention is directed to methods for producing an agricultural fiber pulp product, that can be used in the production of liner or medium in a corrugated container, containerboard, molded pulp products, commercial brown towel, tissue, cardstock, chipboard, sacks, bags and other paper or pulp products. Such agricultural fiber materials are advantageously annually renewable, as opposed to use of wood pulp materials, which are not annually renewable. It is advantageous to use such annually renewable fiber materials in such single use pulp products, particularly where such annually renewable agricultural feedstock materials can be locally or regionally sourced (e.g., they do not require shipping from overseas).

An exemplary method may include providing non-wood agricultural feedstock material that includes agricultural fibers, and reducing the size of such agricultural fibers to a desired length, and mechanically refining such agricultural fibers, as well as chemically pulping the agricultural fibers in an alkaline chemical pulping process to produce an agricultural fiber pulp, where chemically pulping the agricultural fibers is achieved at a temperature of less than 100° C. and at atmospheric pressure. Such mechanical refining refers to any of a wide variety of devices or processes that reduce size and free up fibers from larger bundles of fibers. Such may include shredding, work done in a screw press, and is not limited to a "refiner" as that term is understood in the field. Applicant has found that by maintaining the cooking temperature at less than 100° C., and specifically not pressurizing the vessel where cooking occurs, the capital costs are greatly reduced, and the production of hazardous waste materials are also reduced. At the same time, applicant has found that quality of the resulting pulp fiber material produced is improved (e.g., fiber length is preserved), so as to provide a high quality pulp material that can be used in paper making. Such conditions are important in ensuring that higher yields, and good mechanical and physical properties (e.g., strength, freeness, etc.) are achieved. Numerous processes are described in the art that teach the use of significantly higher cooking temperatures (e.g., over 110° C., over 120° C., over 130° C., over 140° C. or over 150° C.). Many such processes also employ pressurized treatments, e.g., either during cooking or in treatments preliminary to, or after cooking, (e.g., in a pressurized oxygen delignification step). The present methods and systems are specifically directed to overall far simpler, less complex, and less expensive systems that allow conversion of agricultural feedstock materials into an agricultural fiber pulp product at costs that would be competitive to either virgin wood pulp (whether derived from softwood, or hardwood), or even old corrugated containers (OCC), which is generally the least expensive of typically employed pulp materials.

In an embodiment, the method may include a 2-step chemical pulping cooking process that includes introducing the agricultural fibers into a first reactor, where both the first and second reactors operate at a low temperature of less than 100° C. (e.g., 60° C. to 99° C., 70° C. to 99° C., 80° C. to 99° C. or 90° C. to 99° C. The $2^{nd}$ reactor can be at a higher temperature, higher alkali concentration, and/or higher consistency than the first reactor.

The conditions of the first reactor can be particularly configured to remove "fast" or "easy" lignin from the agricultural feedstock material, releasing the desired agricultural fibers, or bundles of fibers. The more difficult "slow" lignin can be removed within the $2^{nd}$ reactor, which includes different conditions, specifically tailored to remove such.

Both reactors operate at atmospheric pressure, so that no expensive pressurized reaction or other vessels are required (which vessels equipped for pressurization are far more expensive). In addition, at such low temperature, unpressurized conditions, no blow tank or similar structure is required downstream from the reactor. Such blow tanks are commonly required in many conventional pulping systems and methods, because of the high operating temperatures and/or pressures. Again, such equipment is significantly more expensive than what is required in the present inventive systems and methods.

Pulp leaving the first reactor may pass through a screw press or similar apparatus to remove the black liquor from the pulp. Another screw press or similar apparatus may be located after the second reactor, so as to separate the pulp from the black liquor in the product leaving the second reactor. Such black liquor includes residual alkali, and can be cycled back, in a countercurrent fashion, to an upstream location within the process, to allow the alkali present therein to react and remove additional lignin. In other words, it is important to note that the first reactor uses for reactant the filtrate from the second reactor press.

Another embodiment of the present invention is directed to products (e.g., liner, medium, corrugated containers, containerboard, kraft paper, etc.) formed from a process as described herein. Such a product may be formed from a blend of agricultural fibers produced using processes as described herein, blended with OCC and/or virgin wood pulp. The ratios of such pulp components may vary widely, depending on the particular application. For example, either such component (the agricultural pulp fibers or the OCC or virgin wood pulp) may range from at least 3%, 5% to 95%, 10% to 90%, 20% to 80%, 30% to 70%, 40% to 60% or any value therebetween. Additional ranges may be defined between any of the above endpoints, or other values provided herein as exemplary.

Another embodiment is directed to a system configured to perform methods as described herein. For example, such a system can include a separation and size reduction module configured to reduce the size of agricultural fibers within provided non-wood agricultural feedstock material to a desired fiber length. Such a module may be configured to cut, mill, and/or screen the agricultural feedstock material. The system further includes a chemical pulping module configured to chemically pulp the agricultural fibers in an alkaline chemical pulping process to produce an agricultural fiber pulp, wherein the chemical pulping module operates at atmospheric pressure and at a temperature of less than 100° C. The system can also include a papermaking machine configured to make liner, medium, or other paper product from the agricultural fiber pulp. As described above relative to the method, the system may be one where the chemical pulping module comprises a 2-step cooking system, including a first reactor and a second reactor, where both reactors operate at atmospheric pressure and at a temperature of less than 100° C. As noted, the second reactor may operate at a higher temperature than the first reactor. A screw press may be provided between the first and second reactors, to separate agricultural fibers exiting the first reactor from the black liquor generated by removal of the "fast" lignin from such agricultural feedstock material, within the first reactor. As noted, such liquor can be cycled back, to a location within the process that is upstream, to allow residual alkali therein to be used to remove additional lignin. For example, the black liquor removed after the first cooking is processed to recover the lignin and hemicellulose. The filtrate from the second reactor press is used partially or entirely for the first cooking (it is countercurrent, cycled back to the first reactor).

An exemplary method includes providing non-wood agricultural feedstock material that includes agricultural fibers, and reducing the size of such agricultural fibers to a desired length, and mechanically refining such agricultural fibers; chemically pulping the agricultural fibers in an alkaline chemical pulping process to produce an agricultural fiber pulp, wherein chemically pulping the agricultural fibers is achieved at a temperature of less than 100° C. and at atmospheric pressure; and introducing the agricultural fiber pulp into a papermaking machine to make liner, medium, tissue, towel, cardstock, chipboard, or other paper product from the agricultural fiber pulp.

In an embodiment reducing the size of the agricultural fibers to a desired length and mechanically refining such fibers occurs before chemical pulping.

In an embodiment reducing the size of the agricultural fibers to a desired length and mechanically refining such fibers occurs during or after chemical pulping.

In an embodiment the non-wood agricultural feedstock material comprises at least one of corn stover, hemp, wheat straw, rice straw, soybean residue, cotton residue, switchgrass, miscanthus, DDGS, bamboo, or sugarcane bagasse.

In an embodiment the agricultural fiber pulp is combined with at least one of OCC pulp, other recycled paper pulp, or virgin wood pulp to make the liner, medium, H tissue, towel, cardstock, chipboard, or other paper product.

In an embodiment chemically pulping the agricultural fibers is achieved without addition of any acids.

In an embodiment chemically pulping the agricultural fibers is achieved in a 2-step cooking process, comprising:

introducing the agricultural fibers into a first reactor, wherein the first reactor operates at a low temperature of less than 100° C.; and introducing the agricultural fibers from the first reactor into a second reactor, where the second reactor operates at a low temperature, of less than 100° C., the second reactor operating at a higher temperature than the first reactor, to produce the agricultural fiber pulp.

In an embodiment chemically pulping the agricultural fibers includes chemically pulping with a sodium hydroxide or other active alkali concentration of less than 40 g/L, or an active alkali (relative to the agricultural feedstock material) value of less than 50%.

In an embodiment chemically pulping the agricultural fibers includes chemically pulping with a sodium hydroxide or other active alkali concentration of from 4 g/L to less than 40 g/L, from 4 g/L to 20 g/L, or from 4 g/L to 10 g/L, or an active alkali (relative to the agricultural feedstock material) value of from 10% to 30%.

In an embodiment chemically pulping the agricultural fibers includes chemically pulping with a sodium hydroxide or other active alkali concentration of from from 4 g/L to less than 40 g/L, from 4 g/L to 20 g/L, or from 4 g/L to 10 g/L or an active alkali (relative to the agricultural feedstock material) value of from 10% to 30%, for a period of time of at least 1 hour.

In an embodiment chemically pulping the agricultural fibers includes chemically pulping with a sodium hydroxide or other active alkali concentration of from from 4 g/L to less than 40 g/L, from 4 g/L to 20 g/L, or from 4 g/L to 10 g/L or an active alkali (relative to the agricultural feedstock material) value of from 10% to 30%, for a period of time of from 1 hour to 5 hours, at a temperature of less than 100° C.

In an embodiment chemically pulping the agricultural fibers is achieved in a continuous screw digester, with a residence time of from 1 to 5 hours.

In an embodiment a yield of the agricultural fibers in the liner, medium, tissue, towel, cardstock, chipboard, or other paper product is at least 40%, at least 50%, at least 60%, at least 70%, or at least 80% by weight.

In an embodiment the liner, medium, tissue, towel, cardstock, chipboard, or other paper product includes at least 3% by weight of agricultural fibers.

In an embodiment the liner, medium, tissue, towel, cardstock, chipboard, or other paper product includes 3% to 100% by weight of agricultural fibers.

In an embodiment the liner, medium, tissue, towel, cardstock, chipboard, or other paper product includes 10% to 90% by weight of agricultural fibers.

In an embodiment the liner, medium, tissue, towel, cardstock, chipboard, or other paper product is at least one of liner or medium, and is incorporated into a corrugated paper container.

In an embodiment the corrugated paper container includes both liner and medium, wherein the liner and medium both include agricultural fibers, and wherein the liner and medium include different weight fractions of agricultural fiber therein. In another embodiment, only one of the liner or medium includes agricultural fibers therein.

In an embodiment reducing the size of such agricultural fibers to a desired length, and mechanically refining such agricultural fibers in preparation for pulping comprises (i) chopping or shredding, (2) milling, and/or (3) screening such agricultural fibers. In an embodiment, such (i) chopping or shredding, (2) milling, and/or (3) screening such agricultural fibers is achieved in a low consistency pulper.

In an embodiment reducing the size of such agricultural fibers to a desired length, and mechanically refining such agricultural fibers in preparation for pulping comprises hammermilling the agricultural fibers.

In an embodiment the method is performed without the use of ozone, and without any bleaching.

In an embodiment the agricultural fibers are incorporated into containerboard, chipboard, grayboard, or another rigid container board.

Another exemplary method includes providing non-wood agricultural feedstock material that includes agricultural fibers, and reducing the size of such agricultural fibers to a desired length, and mechanically refining such agricultural fibers; chemically pulping the agricultural fibers in an alkaline chemical pulping process to produce an agricultural fiber pulp, wherein chemically pulping the agricultural fibers is achieved at a temperature of less than 100° C. and at atmospheric pressure; and introducing the agricultural fiber pulp into a molded pulp product manufacturing machine to make a molded pulp product from the agricultural fiber pulp.

In an embodiment the molded pulp manufacturing machine performs at least one of wet pressing or thermoforming of the agricultural fiber pulp to form the molded pulp product.

In an embodiment the molded pulp product comprises at least one of an egg carton, a molded disposable "paper" plate, a food container, or a molded pulp product used for packaging consumer goods, wherein the molded pulp product is a disposable single use product.

Another embodiment is directed to a product comprising the liner, medium, tissue, towel, cardstock, chipboard, or other paper product formed by any of the methods described.

In an embodiment, the product comprises a box.

In an embodiment the product comprises a container that includes a corrugated portion.

Another embodiment is directed to a product, including liner, medium, tissue, towel, cardstock, chipboard, or other paper product, the liner, medium, tissue, towel, cardstock, chipboard, or other paper product including a non-wood agricultural feedstock material that includes agricultural fibers, the agricultural fibers having a particular length, the agricultural fibers having been mechanically refined and chemically pulped; and recycled paper (e.g., OCC) and/or virgin wood pulp.

In an embodiment, the recycled paper comprises OCC.

In an embodiment the liner, medium, tissue, towel, cardstock, chipboard, or other paper product is unbleached.

In an embodiment the non-wood agricultural feedstock material comprises at least one of corn stover, hemp, wheat straw, rice straw, soybean residue, cotton residue, switchgrass, miscanthus, DDGS, bamboo, or sugarcane bagasse.

In an embodiment the liner, medium, tissue, towel, cardstock, chipboard, or other paper product is liner, medium, or chipboard, and is in the form of a container.

In an embodiment the container comprises a corrugated portion that includes the non-wood agricultural feedstock material and the recycled paper and/or virgin wood pulp.

In an embodiment the container comprises a waterproofing agent.

In an embodiment, such a container or other article can have strength or other mechanical or physical properties as described herein (e.g., in the examples, or elsewhere).

Another exemplary embodiment is directed to a system including a separation and size reduction module configured to reduce the size of agricultural fibers within provided non-wood agricultural feedstock material to a desired fiber length, the separation and size reduction module being configured to cut, mill and/or screen the agricultural feedstock material; a chemical pulping module configured to chemically pulp the agricultural fibers in an alkaline chemical pulping process to produce an agricultural fiber pulp, wherein the chemical pulping module operates at a temperature of less than 100° C. and at atmospheric pressure; and (i) a papermaking machine configured to make liner, medium, tissue, towel, cardstock, chipboard, or other paper product, or (ii) a molded pulp product manufacturing machine to make a molded pulp product from the agricultural fiber pulp.

In an embodiment the molded pulp manufacturing machine performs at least one of wet pressing or thermoforming of the agricultural fiber pulp to form the molded is pulp product.

In an embodiment the molded pulp product comprises at least one of an egg carton, a molded disposable "paper" plate, a food container, or a molded pulp product used for packaging consumer goods, wherein the molded pulp product is a disposable single use product.

In an embodiment the separation and size reduction module is positioned in the system upstream from the chemical pulping module so that the system is configured to reduce the size of the agricultural fibers to a desired length before chemical pulping.

In an embodiment the separation and size reduction module is positioned in the system downstream from the chemical pulping module so that the system is configured to reduce the size of the agricultural fibers to a desired length after chemical pulping.

In an embodiment the provided non-wood agricultural feedstock material comprises at least one of corn stover, hemp, wheat straw, rice straw, soybean residue, cotton residue, switchgrass, miscanthus, DDGS, bamboo, or sugarcane bagasse.

In an embodiment the system is further configured to combine the agricultural fiber pulp with at least one of OCC pulp, other recycled paper, or virgin wood pulp to make the liner, medium, tissue, towel, cardstock, chipboard, or other paper product is liner, medium, or chipboard, and is in the form of a container.

In an embodiment the chemical pulping module comprises a 2-step cooking system, comprising:

a first reactor that operates at a low temperature of less than 100° C.;

wherein the system includes a screw press between the first reactor and a second reactor for removing at least a portion of black liquor generated in the first reactor;

the second reactor, where the second reactor operates at a low temperature of less than 100° C., the second reactor operating at a higher temperature than the first reactor, to produce the agricultural fiber pulp.

In an embodiment the chemical pulping module is configured to chemically is pulp the agricultural fibers with a sodium hydroxide or other active alkali concentration of less than 40 g/L, less than 20 g/L, or an active alkali (relative to the agricultural feedstock H material) value of less than 50%.

In an embodiment the chemical pulping module is configured to chemically pulp the agricultural fibers with a sodium hydroxide or other active alkali concentration of from 4 g/L to less than 40 g/L, from 4 g/L to 20 g/L, or from 4 g/L to 10 g/L, or an active alkali (relative to the agricultural feedstock material) value of from 10% to 30%.

In an embodiment the chemical pulping module is configured to chemically pulp the agricultural fibers with a sodium hydroxide or other active alkali concentration of from 4 g/L to less than 40 g/L, from 4 g/L to 20 g/L, or from 4 g/L to 10 g/L, or an active alkali (relative to the agricultural feedstock material) value of from 10% to 30%, for a period of time of at least 1 hour.

In an embodiment the chemical pulping module is configured to chemically pulp the agricultural fibers with a sodium hydroxide or other active alkali concentration of from 4 g/L to less than 40 g/L, from 4 g/L to 20 g/L, or from 4 g/L to 10 g/L, or an active alkali (relative to the agricultural feedstock material) value of from 10% to 30%, for a period of time of from 1 hour to 5 hours, at a temperature of less than 100° C., without addition of any acids.

In an embodiment the chemical pulping module comprises a continuous screw digester providing a residence time of from 1 to 5 hours.

In an embodiment the system provides a yield of the agricultural fibers in the liner, medium, tissue, towel, cardstock, chipboard, or other paper product of at least 40%, at least 50%, at least 60%, at least 70%, or at least 80% by weight.

In an embodiment the produced li liner, medium, tissue, towel, cardstock, chipboard, or other paper product includes at least 3% by weight of agricultural fibers.

In an embodiment the produced liner, medium, tissue, towel, cardstock, chipboard, or other paper product includes 3% to 95% by weight of agricultural fibers.

In an embodiment the produced liner, medium, tissue, towel, cardstock, chipboard, or other paper product includes 5% to 90% by weight of agricultural fibers.

In an embodiment the produced liner, medium, tissue, towel, cardstock, chipboard, or other paper product includes 3% to 95% by weight of agricultural fibers.

In an embodiment the produced liner, medium, tissue, towel, cardstock, chipboard, or other paper product includes 5% to 90% by weight of agricultural fibers.

In an embodiment the system is configured to produce to a corrugated paper container.

In an embodiment the separation and size reduction module is configured to (i) chop or shred, (2) mill, and/or (3) screen the agricultural fibers.

In an embodiment the separation and size reduction module includes a hammermill.

Features from any of the disclosed embodiments may be used in combination with one another, without limitation. For example, any of the compositional limitations described with respect to one embodiment may be present in any of the other described embodiments. In addition, other features and advantages of the present disclosure will become apparent to those of ordinary skill in the art through consideration of the following detailed description and the accompanying drawings.

The foregoing are presented only by way of example and are not intended to limit the scope of the invention in any way. Moreover, the embodiments disclosed herein do not constitute an exhaustive summary of all possible embodiments, nor does this summary constitute an exhaustive list of all aspects of any particular embodiment(s). Rather, this summary simply presents selected aspects of some example embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

BRIEF DESCRIPTION OF THE DRAWINGS

The appended drawings contain figures of example embodiments to further illustrate and clarify the above and other aspects, advantages and features of the present invention. It will be appreciated that these drawings depict only example embodiments of the invention and are not intended to limit its scope. The invention will be described and explained with additional specificity and detail through the use of the accompanying drawings.

DETAILED DESCRIPTION

Figure 1:
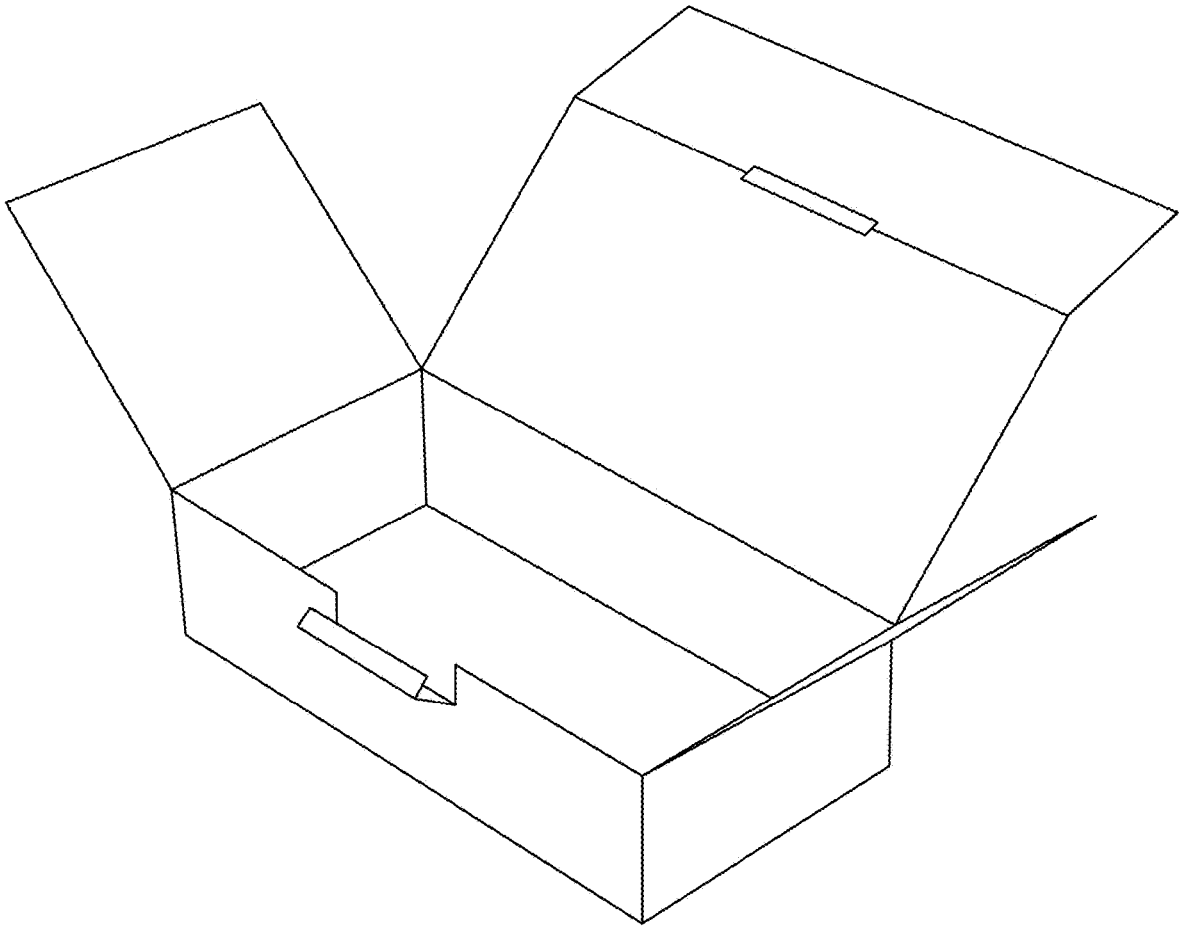
FIGS. 1-9 show example containers made from containerboard, according to various example embodiments of the invention.

Various disclosed embodiments are generally concerned with the production and use of feedstock blends, and products such as cardboard, paperboard, kraft paper or the like, made from feedstock blends, that may include one or more types of agricultural fibers and/or other non-wood fibers in various quantities. Example feedstock blends may additionally, or alternatively, include recycled paper and/or recycled cardboard, and forest products such as wood fibers. Unless specified in a particular claim, the scope of the invention is not limited to any particular feedstock blend or components however.

In some particular example embodiments, a system for producing containerboard is provided that fractionates and refines agricultural feedstocks to a pulp specification that may be useful in applications such as, but not limited to: blending with OCC (old corrugated containers which may or may not include wood fibers) and/or other recycled papers; blending with non-wood fibers, such as agricultural fibers; and, use as a pure species of one agricultural fiber.

In a first example embodiment, corn stover pulps are blended with OCC to produce a new pulp blend for use in producing containerboard. A second example embodiment of the invention uses a pulp of both corn stover and wheat straw, blended with OCC. In a third example embodiment, bast fibers from hemp straw are introduced to the corn stover-OCC blend of the first example embodiment noted above. These embodiments are presented only by way of example, and are not intended to limit the scope of the invention in any way. A wide variety of possible non-wood agricultural fibers are possible, including but not limited to corn stover, hemp, wheat straw, soybean residue, switchgrass, or DDGS (Distillers Dried Grains w/Solubles).

Example embodiments of the invention may provide various features, although no particular feature or group of features is required to be implemented in any particular embodiment. Following is a brief discussion of features, any one or more of which may be incorporated in an embodiment of the invention. The features noted in the following discussion are provided by way of illustration and are not intended to limit the scope of the invention in any way.

One or more example embodiments of the invention are directed to various types of containerboard that can be made by the processing of various non-wood feedstocks, such as one or more agricultural fibers for example, with or without being combined with traditional wood-based paper pulp, and without regard to whether or not the traditional wood-based paper pulp is recycled.

As another example, embodiments of the invention may enhance the performance characteristics of containerboard made with recycled materials. Embodiments of the invention may present alternatives to the use of trees as a feedstock for containerboard. Even where mechanical performance characteristics may not necessarily be enhanced as compared to use of conventional pulp materials (e.g., virgin wood pulp or OCC), the present embodiments provide a sustainability advantage, reducing use of wood and forest resources, allowing such materials to be put to higher use.

Example embodiments may provide a commercially viable use for agricultural residues that are left over from various types of grain farming such as corn, wheat, and soy beans, for example. Implementing this approach may provide a new income stream for the grower of those crops who might otherwise destroy those residues, or plow them under. Further, embodiments of the invention may enable the use of cover crops, as well as the ability to harvest and process the cover crops in an industrial setting. Implementation of this approach may further incentivize growers of these crops to increase the soil health of their fields.

The use of non-wood agricultural residues or other non-wood agricultural feedstock materials and fibers and other non-wood fibers in processes for producing is products which may have to be relatively strong to perform their intended function, such as containerboard used to make boxes for example, may be counterintuitive. This is a because agricultural materials and other non-wood fibers typically lack the strength and durability of wood fibers and other wood-based materials (e.g., houses are framed with wood, not corn stalks). Thus, the partial replacement, in some example embodiments of the invention, of relatively stronger wood based materials with relatively weaker agricultural feedstock materials runs counter to conventional wisdom. In still other embodiments, wood based fibers may be completely omitted, and such embodiments may include only agricultural materials and/or other non-wood fibers. In addition non-wood agricultural feedstock materials exhibit other significantly different characteristics from wood chips or fibers derived therefrom, e.g., as they are significantly less homogenous, containing a variety of structures making it further counter intuitive to process such materials together in a large batch.

Example embodiments of the invention embrace a production system which may implement particular conditions (e.g., chemical pulping conditions and other treatments, to preserve fiber length and strength) needed to enable effective processing to achieve the required physical, chemical, and/or performance characteristics of containerboard, and products made of containerboard. Embodiments of the invention may provide for a system and process that may include a production sequence of size reduction, mechanical refining, and an alkaline chemical pulping process, where the production sequence may serve to enhance the natural strength of the non-wood fiber inputs that are used to produce containerboard and products that include containerboard. In some embodiments, size reduction, mechanical refining and the like may be minimal before subjection to the alkaline chemical pulping process (cooking). In an embodiment, such size reduction, fractionating, and/or refining may be achieved within the modules associated with the papermaking machine, rather than in the pulp preparation process. For example, a relatively unrefined or "rough" pulp as produced by the present process may simply be fed into a pulper (skipping the detrashing module to which OCC may be fed) of the paper making process, joining with OCC coming from the detrashing module (should detrashing of the OCC be needed). Such a pulper may achieve the desired size reduction, fractionation, and/or refining, without the entity running the cooking process that produces the agricultural pulp fiber from having to perform such steps (which would be redundant), given the contemplated downstream use of the pulp product. In addition, embodiments of the invention embrace production processes that may limit the amount of water used in production by using closed loop circulation technologies.

A. Overview

The physical components of a corrugated paper container may include two types of paperboard, which may collectively be referred to as 'containerboard.' The two types of containerboard are testliner (also referred to simply as liner) and corrugated medium. Both types of containerboard are typically manufactured at paperboard mills out of either recycled wood pulp, virgin wood pulp, or a combination of recycled wood pulp and virgin wood pulp.

Industry data indicates that virgin wood pulps can maintain strength through multiple recycling processes (e.g., 7 recycles). However, the quality of recycled wood fibers diminishes with each re-pulping process, e.g., due to fiber shortening and other effects. To prolong the lifetime of the recycled material, a percentage of virgin fibers may be introduced which may help the finished containerboard meet performance characteristics acceptable in the market.

Thus, example embodiments of the invention include a wide variety of containerboard compositions that use virgin (or recycled) non-wood fibers as an alternative to virgin wood fibers. Such embodiments may, for example, enable reduced consumption of forest resources, such as wood fiber, while also providing for a relative improvement in the quality and longevity of the containerboard through the inclusion of non-wood fibers as a component of the containerboard.

B. General Aspects of Some Example Embodiments

Containerboard, example embodiments of which are disclosed herein, may be used in the manufacture of various types of corrugated materials and containers made of corrugated materials. The desired properties of containerboard may vary based on a number of considerations, such as the purpose of the corrugated container that is being produced. Corrugated containers are widely used for packing, storage, and transportation of goods. In one example application, corrugated containers intended for storage may need to have sufficient strength to accommodate stacking and resistance to crushing under an applied load.

In another example application, a box used for an e-commerce delivery in the mail system would need durability to withstand punctures and tears, while also being relatively lightweight so as to keep shipment costs down. Thus, such boxes and containers may have a relatively high strength-to-weight ratio.

In a third example application, corrugated containers used for transporting frozen foods would need insulative properties, and the ability to contain any fluid leakage without becoming saturated. Thus, some such frozen food containers may require the ability to be impregnated with, or otherwise accept, materials such as wax or another waterproofing agent which may serve to prevent leakage into, and out of, the container, while also preventing saturation of the box itself that could cause the corrugated material to fail.

Processes according to example embodiments of the invention that employ one or more types of non-wood fibers, may enable the production of containerboard and containerboard products to meet market demands such as those noted above.

C. Detailed Aspects of Some Example Embodiments

Recovering paper from a recycling stream may involve three major processes, namely, collection (whether residential or business), separation and sorting, and baling those materials of certain categories. These processes may be undertaken by one waste collection company, or by a waste collection company in conjunction with a specialized recycling company that handles the sorting and baling, and has ability to sell into the markets. According to the Institute of Scrap Recycling Industries, "*Guidelines for Paper Stock: PS*-2013-*Export Transactions*", herein incorporated by reference in its entirety, there are 52 different categories of waste paper. The highest volume of waste paper (g comes from category #11 Old Corrugated Containers, also referred to as "OCC" which is commonly traded in the market in large square bales, typically ranging from 700-2000 lbs.

As category #11 OCC may be the most commonly available type of recycled paper product, that material may be particularly well suited for use in various embodiments of the invention. However, in addition, or as an alternative, to the use of OCC, embodiments of the invention may use recyclable paper and paper products of any grade (e.g., pulp thereof), and/or may use any paper or paper products that have already been recycled using conventional recycling processes (e.g., recycled pulp). Examples of other typically encountered recycled paper products include category #12 DS OCC (double sorted OCC), category #13 DLK (double lined kraft), category #36 UOP (unsorted office paper), and category #37 SOP (sorted office paper). Other categories are also possible, examples of which are found in "*Guidelines for Paper Stock: PS*-2013-*Export Transactions*", already incorporated by reference in its entirety.

At least some embodiments may comprise unbleached products, such as containerboard for example, that are produced by processes and methods that do not use ozone, or other bleaching agents (e.g., no oxygen, chlorine, or other bleaching). The omission of bleaching agents from processes and products according to example embodiments of the invention may reduce production expenses, and may also contribute to production of a product with relatively greater strength and durability as compared with a product, such as printer paper and copier paper for example, that was produced in part with the use of a bleaching agent, where a high degree of whiteness or brightness is important. Embodiments of products that were produced without the use of ozone or other bleaching agents may be referred to herein as "unbleached".

It was noted earlier herein that example embodiments of the invention may employ non-wood components, such as agricultural fibers for example, which may also be referred to herein as "agricultural feedstock material" or "agricultural residue". Recovering agricultural residue is a process that takes place in a specific period of time after the harvest of the primary crop (e.g., corn). Typically, during the harvest of the main crop, the rest of the plant is cut from the ground. These materials can be gathered and baled in the field using techniques and equipment common to hay farmers and other agricultural baling operators. Some agricultural residues, such as wheat straw, already have a market. Wheat straw may be used, for example, for animal bedding or further processed in animal feed.

Note that as used herein, "agricultural residue" embraces, but is not limited to any portion of a primary crop that remains in/on/under a field after the primary crop has been harvested. In some cases, agricultural residue may consist only of portions of a primary crop, while in other cases, agricultural reside may also include, as a minority component, other plant material such as weeds and/or other non-crop plants. "Agricultural feedstock material" is a broader term, and would include non-wood agricultural materials that may be grown specifically for use as described herein (e.g., such as switchgrass, or other crops, that are not simply residues. All such materials may be used, as described herein.

In some cases, embodiments of the invention may employ one or more purposely grown fiber crops such as perennial grasses. Examples of such may include, but are not limited to miscanthus and/or switchgrass. Harvesting of such purposely grown fiber crops can involve the simultaneous process of cutting and baling at the time of harvest. Once the materials have been baled, they are ready for use in the production processes as described herein to become containerboard or other paper products as described herein (e.g., kraft paper).

With the foregoing in view, details are now provided concerning some particular illustrative embodiments of the invention. Such embodiments may include feedstock mixtures and blends, production processes, and intermediate and final products such as containerboard and products made of containerboard. Some example production processes may comprise three stages. Depending on the needs of the end user, one or more such stages may be omitted.

The first stage of some example production processes according to embodiments of the invention is fiber preparation. In the fiber preparation stage, bales of raw materials such as one or more agricultural feedstock materials that comprise, or consists of, fibers/fibrous material, may be run through up to three primary processes to reduce the fibers to a suitable size for pulping. These primary processes may comprise chopping or shredding, milling such as hammermilling, and screening. The processes of chopping, shredding and hammermilling will reduce the size of the fibers and/or the degree to which such fibers adhere to one another. Each of these three primary processes involves a cutting process, and at the end of each process is a screen with perforations or other openings which may be set at different sizes, such as from ⅛" to 2", so that the fiber lengths of the material that is being processed become smaller and more uniform with each successive process. It is noted that agricultural feedstock materials also contain a certain amount of ash, both extrinsic and intrinsic, which is not needed in the production of containerboard. The shredding and milling processes may help to remove ash, dirt, and other contaminants from the agricultural feedstock materials. Retention of some such materials in fibers, e.g., silica which may be present in corn stover or other agricultural feedstocks, may be desirable in some embodiments, e.g., for increased insulative value. After the milling and screening processes have been performed, it may or may not be necessary to perform additional screening to obtain optimal fiber lengths. By way of example, corn or wheat fibers from corn stover, wheat straw or similar cereals may have a fiber length that is relatively short, such as about 1 mm (e.g., 0.1 mm to 1.5 mm, or 0.5 mm to 1 mm). Hemp fibers may be significantly longer, e.g., from 3-6 mm in length. Hemp fibers may thus be similar in length to some soft-wood fibers (e.g., varieties of pine), while cereal fibers may be similar in length to some hard-wood fibers. It can be important to maintain a desired average fiber length, as decreasing fiber length through cutting or other processing can decrease strength properties of the finished containerboard. Pith materials (e.g., from the inside of stalks) may typically be shorter than the surrounding bast or other more exterior structural portions of the agricultural feedstock material. Such pith materials may be sufficiently short that they are screened out, as dust fines (e.g., particle sizes of less than 1 mm, less than 0.5 mm, less than 0.25 mm, or less than 0.1 mm). In an embodiment, such could be reintroduced into the papermaking process later (e.g., with pulp fibers, during production of liner or medium). By way of example, pith may account for 15-20% by weight of a given stalk's agricultural fibers. Pith size and concentration may of course depend on the identity of the agricultural feedstock material. Reintroduction of such fines at some point during papermaking can advantageously increase yield (usage of a greater fraction of the corn stover or other agricultural feedstock material).

The second stage of some example production processes may comprise pulping of the agricultural fibers, e.g., after any preliminary the fiber preparation stage has been completed. The pulping may involve chemical pulping and/or mechanical pulping. Certain fibers such as corn stover and wheat straw for example, may be pulped through a chemical process. One example chemical pulping process for agricultural fibers may comprise the following operations:

Washing the fibers with water.

impregnating the fibers with alkaline chemicals, such as sodium hydroxide at about 4 g/L to 40 g/L, 4 g/L to 20 g/L, 4 g/L to 10 g/L, 4 g/L to 9 g/L, 4 g/L to 8 g/L, or 8 g/L to about 20 g/L concentration within the alkaline liquor used to pulp the prepared agricultural feedstock material. Relatively lower concentrations, coupled with longer cooking times and relatively lower cooking temperatures, may be advantageous for providing overall higher yields, lower cost, and reduction in waste stream generation. Any of various additives may be included within the alkaline pulping liquor (e.g., sodium sulphide), although in an embodiment, no such additives other than the hydroxide (e.g., sodium hydroxide) or other alkali for extracting the lignin and hemicellulose are present (e.g., no peroxides, acids, enzymes, alcohols, etc.) The weight ratio of alkali to the agricultural feedstock material in the digester may be any suitable ratio, such as from 1:1 to 50:1, from 1:1 to 25:1, from 1:1 to 20:1, or 5:1 to 20:1. The weight ratio of active alkali to agricultural feedstock material may be from 5% to 50%, from 10% to 30%, from 15% to 25%, from 5% to 20%, or from 5% to 12% (e.g., 8% to 12%). In an embodiment, it is advantageous to extract the most lignin possible, with the least amount of alkali.

Cooking into a pulp, e.g., with a continuous screw digester, such as a vertical or horizontal screw digester. A continuous screw digester may be advantageous, as compared to a batch cooking digester process, although batch processes are also contemplated and within the scope of the present disclosure. In an embodiment, out of service bleaching towers (e.g., from shut-down copy paper or similar mills) could be used for pulping. Although cooking conditions may vary generally from about 60° C. to 180° C., from 60° C. to 150° C., or from 60° C. to 120° C., an advantageous aspect of some embodiments of the present disclosure is that cooking occurs at less than 100° C., such as from 60° C. to 100° C., from 60° C. to 99° C. from 65° C. to 99° C. or from 65° C. to about 95° C. In an embodiment, the cooking temperature may be less than 100° C., which may advantageously eliminate the need for a cold blow discharge tank (a blow tank), because the temperature exiting the digester is less than 100° C., particularly where the cooking is carried out at atmospheric pressure. Above such temperatures and under pressurized conditions, a steam explosion associated with exiting the digester can damage particularly non-wood fiber cellular structures, due to differences between non-wood cell structures and wood cell structures. The elimination of a blow tank and similar expensive components is an important aspect of the present disclosure, which seeks to eliminate the need for such expensive components, insofar as possible. The residence time in the digester may range from about 15 minutes to about 10 hours, from 30 minutes to about 5 hours, from 1 hour to 5 hours, or from 1 hour to 3 hours. Relatively shorter times may be used at relatively higher temperatures, and longer times at lower temperatures. As noted, relatively longer residence times at lower temperatures (e.g., less than 100° C.) may be advantageous, for increasing overall yield. In an embodiment, the cooking process is carried out in 2-steps, within 2 reactors, with a screw press therebetween, as described in applicant's U.S. Application No. 63/280,855, already incorporated by reference in its entirety.

refining at low consistency; and screen, press, and discharge the final pulp to storage tanks.

Where the alkali cooking process is carried out at moderate temperature and pressure (e.g., at atmospheric pressure, rather than under pressurized conditions) yield may actually be improved, and such conditions may negate the need for the typical cold blow discharge. Alternative systems and methods that include relatively high temperatures under pressurized conditions and inclusion of a cold blow discharge step result in significantly increased cost to the system. The elimination of such is an advantage of at least some embodiments according to the present disclosure.

In an embodiment, the yield of the agricultural fibers useable in liner, medium, or other paper product as compared to the starting agricultural feedstock material may be at least 40%, at least 50%, at least 60%, at least 70%, at least 80%, at least 85%, or at least 90% by weight. In an embodiment, yield may be from 60-65%. Yield can be increased as described herein (e.g., using relatively lower cooking temperature and longer residence times, reintroducing fines that may be screened out and later reintroduced during papermaking, etc.).

A mechanical pulping process may be used in place of, or in addition to, a chemical pulping process, and may take place before, simultaneously, or after, a chemical pulping process. Mechanical pulping processes may be employed for re-pulping OCC and other types of recovered paper. Of course, agricultural feedstock materials can also be processed by such methods. As noted above, a pulper may be used after chemical pulping/cooking of the agricultural feedstock fiber material to aid in achieving desired size and refinement characteristics, e.g., by introducing such agricultural pulp material into the pulper, with OCC, before processing through the papermaking machine. One example of a mechanical pulping process that may be employed in some embodiments of the invention may comprise the following operations:

pulper/de-trashing performed by a pulper/de-trashing module (detrashing may only be needed for the OCC inputs)

high density cleaning, such as with a grit separator;

screening—using a coarse screen, and then a fine screen;

cleaning, such as with two-stage fine cleaner banks;

thickening, such as with a disc filter or side hill screen;

fractionation, such as with fractionation screens or double nip thickeners;

refining, which may comprise either disc or conical refining; and/or discharging of the material to storage tanks.

Figure 23:
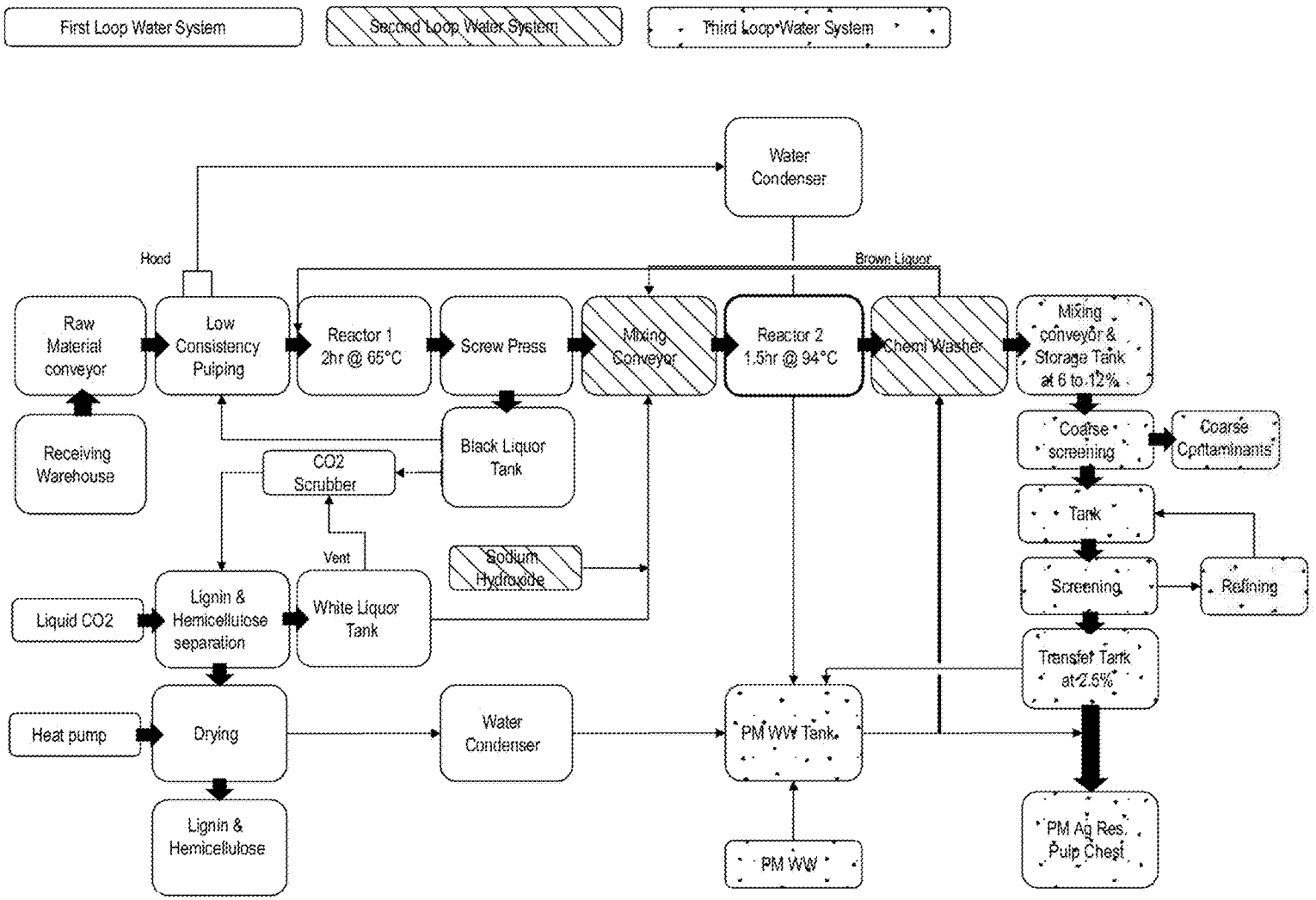
FIG. 23 is a flow chart of an example 2-step, low temperature cooking process for use in various exemplary embodiments of the invention.
Figure 24:
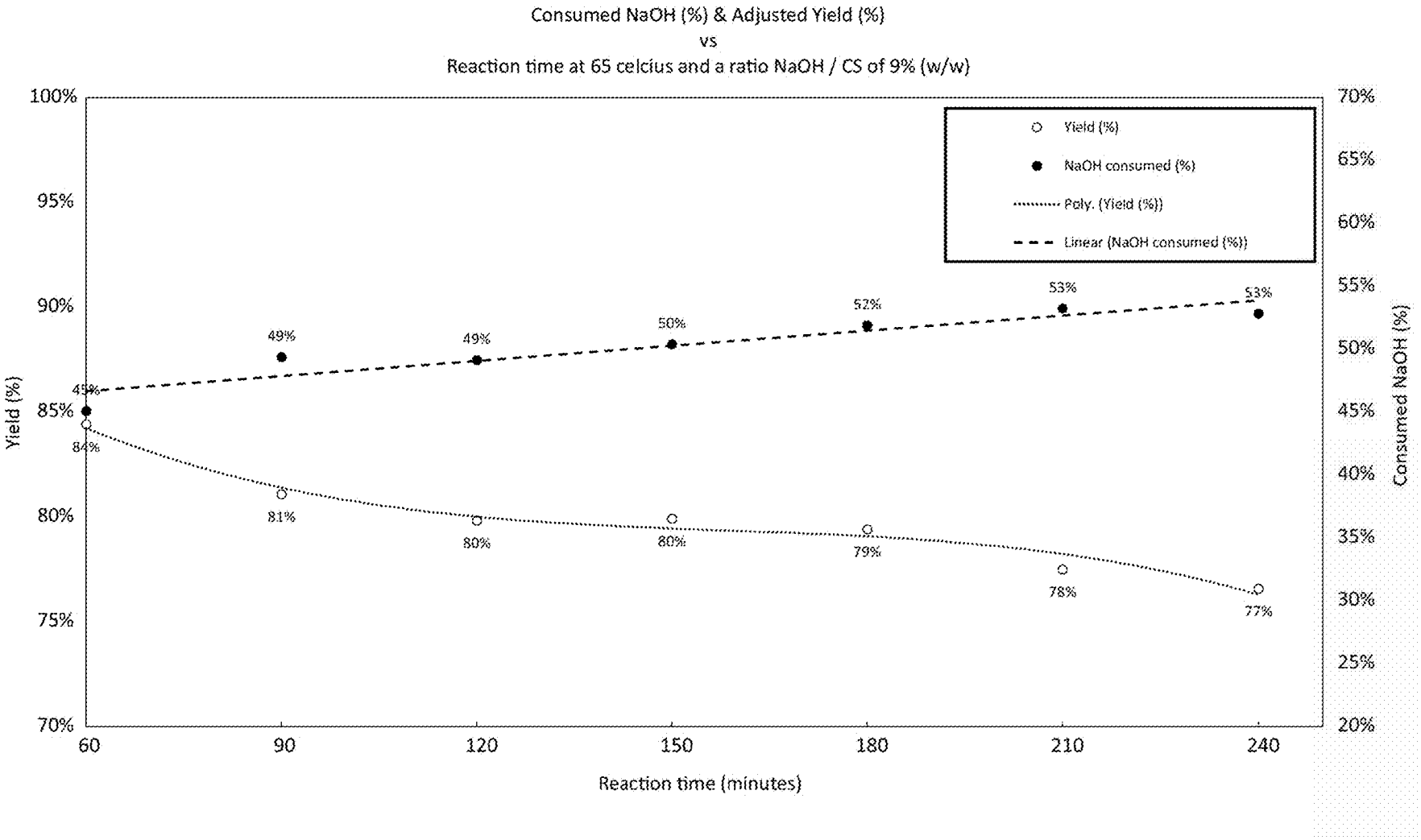
FIG. 24 shows yield and NaOH consumption for various reaction times at a reaction temperature of 65° C., exemplary of conditions in reactor 1 of a 2-step low temperature cooking process in an exemplary embodiment of the present invention.
Figure 25:
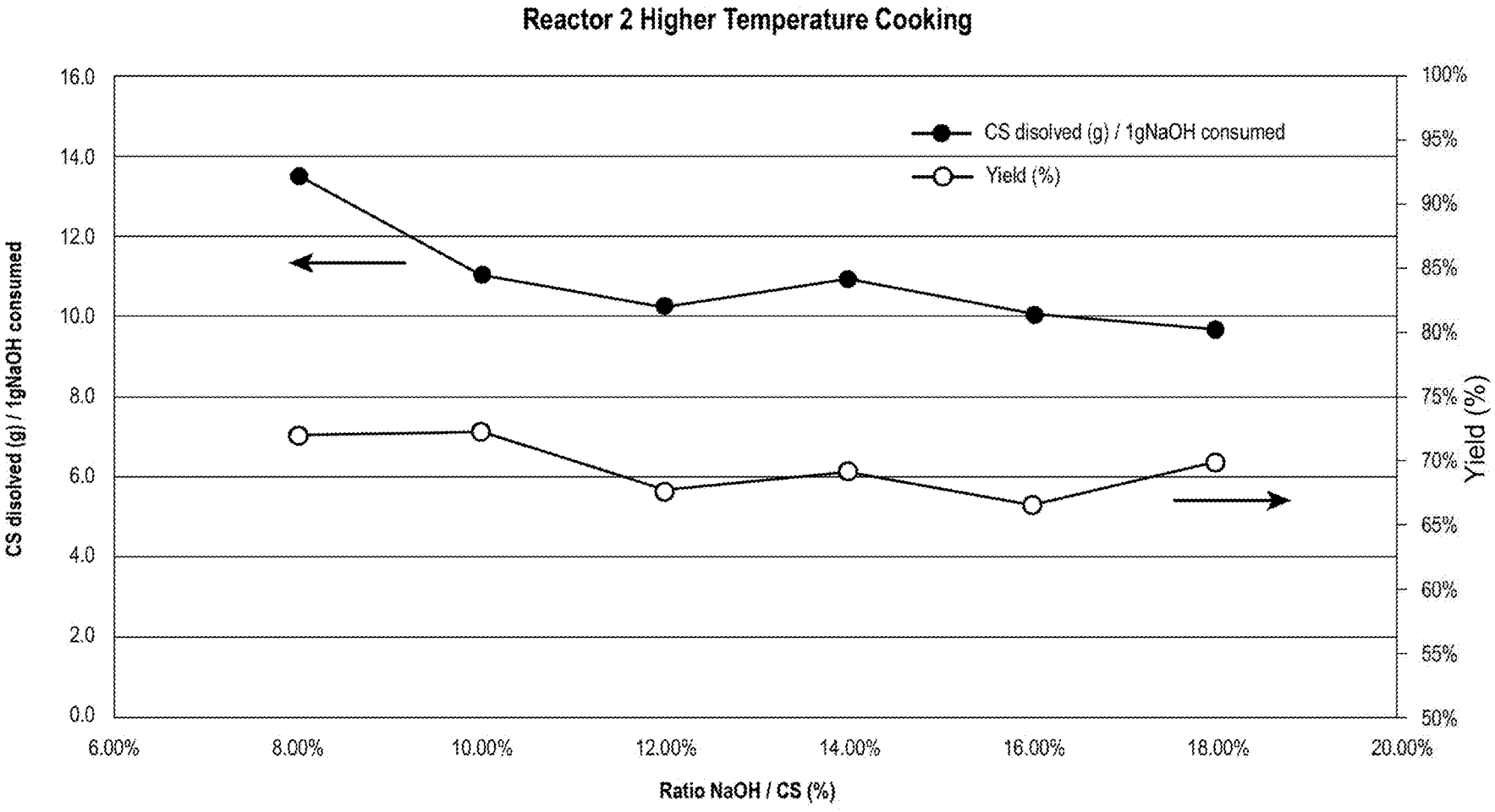
FIG. 25 shows the ratio of corn stover dissolved/g NaOH consumed, and yield, as a function of the ratio of NaOH to corn stover, at a reaction temperature of 113° C., exemplary of conditions in reactor 2, although the temperature in reactor 2 will more typically be about 95° C., rather than over 100° C.

FIGS. 23-25 show details relative to an exemplary 2-step, low temperature cooking process for use in the present invention. FIG. 23 shows a flow chart of a preparation process that includes a 2-step chemical pulping process. In particular, FIG. 23 illustrates a portion of a system and process for preparing non-wood agricultural feedstock material for use as a pulp, using principles as described herein (e.g., low temperature, low pressure, conservative use of caustic, minimization of generation of toxic byproducts in the liquor, etc). Non-wood agricultural feedstock material (e.g., corn stover or other) is delivered from a receiving warehouse to the raw material conveyor, and from there to the low consistency pulping module.

By way of example, the low consistency pulping module of FIG. 23 may operate at a relatively low consistency, e.g. less than 10%, less than 8%, less than 6%, or no more than about 5% consistency. The consistency may be at least 1%, at least 2%, or at least 3%, such as 4%. Retention time in the low consistency pulping module of FIG. 23 may be less than 20 minutes, less than 15 minutes, or less than 10 minutes, such as at least 3 minutes, or at least 5 minutes, such as 8 minutes. The temperature of the low consistency pulping module may be less than 100° C., less than 80° C., or less than 70° C., such as at least 30° C. at least 40° C., or at least 50° C., such as 50° C. to 70° C., or 60° C. to 70° C. (such as 65° C.).

The low consistency pulping module of FIG. 23 includes caustic (also referred to as alkali) (e.g., NaOH), which serves to begin separating the lignin and hemicellulose from the pulp fibers. The loading of alkali or caustic in the low consistency pulping module of FIG. 23 may be relatively low, such as less than 20%, less than 15%, less than 10%, at least 4%, at least 5%, or at least 6%, such as 8% relative to the mass of the corn stover or other non-wood agricultural feedstock material introduced into such is module. Lignin and hemicellulose that is separated from the fibers of the agricultural feedstock material during the short soak at elevated temperature in the low consistency a pulping module of FIG. 23 can be sent to a lignin and hemicellulose separation module, where it may eventually be recovered through precipitation or extraction using $CO_2$ (e.g., liquid $CO_2$), acetic acid or another acid, and/or ethanol (any of which may result in precipitation), as shown in FIG. 23. Recovered hemicellulose or lignin products can eventually be dried, to provide hemicellulose and/or lignin value added products, in an embodiment. In another embodiment, where no particular market for such materials may be present, the lignin and/or hemicellulose can simply be burned, e.g., providing a fuel source for heating the various reactors of the system of FIG. 23, for example. In an embodiment, such hemicellulose and/or lignin can be mixed with starch, and used as a coating layer on manufactured liner, providing increased strength and hydrophobicity (i.e., water barrier) to such a layer or material. In another embodiment, lignin can be a value added product, e.g., for use in manufacture of a desired plant-based resin material.

Removal of the lignin and hemicellulose from the pulp as quickly as possible, e.g., which is aided by inclusion of 3 modules (low consistency pulping, reactor 1, reactor 2) which perform such is beneficial in minimizing caustic consumption, as caustic in the presence of lignin (or hemicellulose) will continue to be consumed, even after the lignin or hemicellulose has already been separated from the pulp fibers. It is therefore beneficial to remove and separate the lignin and hemicellulose from the pulp structures as quickly as possible, to maximize efficient use of the caustic alkali material.

The low consistency pulping module may not operate as a pulper in the traditional sense, as it does not actually produce a pulp, but instead produces a material that requires further processing, to actually be considered a pulp (e.g., in reactors 1 and 2). Rather, this preliminary module serves to condition the corn stover or other non-wood agricultural feedstock material, shredding it to a smaller size (although still relatively large), creating a slurry in which the corn stover or similar material is shredded, and wetted, e.g., with average fragments being reduced in length or other size dimension to perhaps 0.5 to 1.5 inch (1.3 to 3.8 cm), creating a slurry having a consistency that is pumpable through the remainder of the system. Such a low consistency pulping module is an example of the first stage described herein, for reducing the size of the agricultural fibers to a desired length, and performing some degree of mechanical refining, preparatory to chemical pulping to be performed thereafter. As some caustic can be present in this module, a significant portion of the "fast" lignin, that portion which is most easily extracted, can be extracted from the corn stover or other agricultural feedstock in this stage of the process as well. The low consistency pulping module can include an extraction plate having holes formed therein, a rotor, stator (with the extraction plate positioned therebetween), as will be appreciated by those of skill in the art. The extraction plate openings may be configured to allow passage of materials with a size, e.g., from 0.25 inch to 1 inch (e.g., about 0.5 inch). Desired operation of the low consistency pulping module can be adjusted by adjusting various parameters for components of this module, such as extraction plate hole size or shape, density of holes in the plate, the gap between the plate and the rotor, as well as other parameters that effect the degree of shredding, how much lignin is extracted, and the like. The low consistency pulper differs from the subsequent reactor in that the pulper is particularly configured to wet the agricultural fiber feedstock material, mix the materials, and impregnate the feedstock material with the alkali liquor. The pulper is well agitated, providing a vortex, to sink the lightweight corn stover or similar feedstock material. While the pulper may include alkali caustic material to begin removal of the lignin, the pulper does not provide a reliable, well defined residence time, as does the reactor. In addition, the pulper is well agitated, while the reactor (e.g., a downflow reactor) may not be mixed. Rather, feedstock material simply exits the pulper once it is small enough to pass through the extraction plate (e.g., about 0.5 inch). The average residence time of the pulper may be, for example, 6-8 minutes, although this of course varies for individual volumes of feedstock material, depending on when the needed size reduction is achieved.

The pulp materials separated from the lignin and hemicellulose can be fed into reactor module 1, as shown in FIG. 23, for further dissolution of lignin/hemicellulose, and further refining of the pulp fiber component of the corn stover or similar agricultural feedstock material. Reactors 1 and 2 may advantageously be configured as upflow or downflow tube reactors (e.g., vertical screw digesters), rather than horizontal screw digester type reactors, commonly used in wood pulp manufacture (which are expensive, difficult to seal, etc.). A downflow reactor may be advantageous as it allows filling of a portion of the reactor (rather than full filling), to reduce retention time within the reactor. Reactor 1 may be sized to provide a retention time for the components therein, of at least 30 minutes, at least 40 minutes, at least 60 minutes, at least 90 minutes, no more than 5 hours, no more than 4 hours, no more than 3 hours, or no more than 2.5 hours, such as 2 hours. The consistency of the material in reactor 1 may be similar to that in the low consistency pulping module (e.g., 4%). The loading of caustic present in reactor 1 may be similar to that in the low consistency pulping module (e.g., 8-10% by weight of the corn stover or other non-wood agricultural feedstock). The temperature in reactor 1 may also be similar to that in the low consistency pulping module (e.g., 65° C.). FIG. 24 illustrates data for such a reactor 1, showing yield and percentage of NaOH consumed (e.g., relative to starting NaOH). As shown, if the retention time is too long, yield begins to drop, and consumption of NaOH increases, representing the transition between the extraction of the fast lignin (more easily extracted) and the slow lignin (more difficult to extract). As such, in an embodiment, the residence time is maintained at about 2 hours (e.g., the start of the inflection relative to yield, as shown in FIG. 24). The data in FIG. 24 was obtained with a caustic loading of 9% NaOH relative to the mass of the corn stover feedstock material present in reactor 1.

The material exiting from reactor 1 is fed into a screw press, as shown in FIG. 23, separating the pulp material from the black liquor. Such a step can be important to the overall process, as it removes dissolved lignin from the process, before introduction into the second reactor. By removing reaction products before introduction into reactor 2, the efficient use of caustic is significantly improved, allowing efficient removal of lignin and hemicellulose while minimizing damage to the pulp fibers. As noted above, the black liquor produced by the present process is significantly less toxic than produced in other processes that employ higher temperatures and/or pressures. The black liquor that is produced is sent to the black liquor tank, which can then be divided, with a portion recirculated to the low consistency pulping module and another portion sent to the lignin and hemicellulose separation module, e.g., as such stream includes significant fractions of lignin and hemicellulose (which color the liquor a dark brown color), which can be recovered for use as a value added product. By way of example, as much as about 25% by weight of corn stover agricultural feedstock material may be recoverable as lignin and/or hemicellulose. For this reason, a 60-65% yield of pulp fiber may be very good (85-90% yield for lignin+pulp fiber).

Pulp exiting the screw press can be sent to a mixing conveyor, as shown in FIG. 23. The screw press may operate at a consistency of 4% at the feed end and a 30% consistency at the accept. More broadly, the accept may range from 10% to 50% consistency, or from 20% to 40% consistency. The mixing conveyor may receive white liquor from the lignin and hemicellulose separation module, and/or liquid from the chemiwasher, as shown in FIG. 23. As a chemiwasher is an expensive module, in an embodiment, the chemiwasher may be replaced with a screw press. The accept consistency from the mixing conveyor may be about 5-6%, with dilution occurring principally from the liquid from the chemiwasher and the white liquor, as well as from fresh caustic that is added at this point, to adjust the caustic ratio to a higher value than in the low consistency pulping module or reactor 1. For example, the caustic ratio may be increased to a value of greater than 10%, but less than 15%, such as 12% (relative to the corn stover mass), at this point, for entry into reactor 2. Reactor 2 may be an upflow or downflow tube reactor (e.g., vertical screw digester), as may be reactor 1. The retention time in reactor 2 may be less than that for reactor 1, e.g., about 90 minutes, but at higher temperature. As noted, the consistency of material in reactor 2 may be higher than in the previous modules, e.g., such as at a value of 5-6%, by mass. Temperature in reactor 2 may be higher than in reactor 1 and the low consistency pulping module, but still less than 100° C., such as from 90° C. to 99° C., or 92° C. to 96° C., 94° C. to 96° C., such as about 95° C. FIG. 25 illustrates data from an exemplary reactor 2. FIG. 25 shows efficiency of the use of NaOH, as to how many grams of corn stover are dissolved or treated, per gram of NaOH consumed, at different caustic loading values. FIG. 25 also shows the effect of such factors on yield (grams of pulp produced divided by grams of corn stover feedstock fed into the system).

Although the data in FIG. 25 was obtained at a temperature of 113° C., it is advantageous for reactor 2 to operate at a temperature of less than 100° C., so as to minimize the generation of toxic byproducts in the black liquor, increase yield, increase efficient use of caustic, and to preserve fiber length and a freeness value in a range of 200 to 500 mL CSF, 200 to 450 mL CSF, 200 to 300 mL CSF, at least 300 mL CSF, such as 300-500 mL CSF, from 350-400 mL CSF, or 375-425 mL CSF. Material exiting reactor 2 is sent to the chemiwasher (or a screw press), where any black liquor can be countercurrent recycled back to the inlet of reactor 1, and/or the mixing conveyor, as shown (FIG. 23). Pulp exiting the chemiwasher (or a screw press) is ready for sending to a mixing conveyor and storage tank (e.g., at 3.5% consistency), where it may optionally be subjected to coarse screening (e.g., to remove cob pieces or other coarse fractions), refining, fines screening, and dewatering modules of the papermaking machine system in which the pulp is eventually incorporated into paper products being produced on the papermaking machine.

The first reactor may be agitated, while the second reactor may provide pulping without agitation.

The coarse screening, refining, and/or fine screening modules may serve to fractionate the pulp materials, based on fiber length, or diameter. By way of example, refining may be achieved with a double disk refiner with low intensity refining plates, as will be appreciated by those of skill in the art. The coarse screening step may serve to separate that portion of the pulp that should be sent to the refiner. The small fraction passing through the coarse screen may not necessarily be fed into the refiner, as the small components do not need refining. Because corn stover and similar agricultural feedstock materials are not homogenous, as would be a wood feedstock, various different fiber lengths, as well as even non-fiber structures may be present in the pulp before fractionation. It may be desirable to remove some such structures, during screening, for example. For example, cobs are largely formed from nonfibrous material, including a large fraction of parenchyma cells, which appear rather as generally spherical or rounded particulates. Cobs may account for at least 10% by weight of some corn stover. In an embodiment, it would be advantageous to harvest corn stover in a way that would leave the cobs on the field. Where cob particulates (e.g., in the form of parenchyma cells) are included in the pulp material exiting the chemiwasher (or a screw press) with the pulp, they can be separated from the pulp, as fines, using washing, if desired. Such materials can be added back into the pulp before introduction of pulp into the blend chest, to increase yield, if desired. By way of example, a given pulp product prepared from corn stover included a size distribution where 23% by weight of the material passed through a 200 mesh (75 micron opening) screen. Most if not all of these fines are believed to be parenchyma. In an embodiment, it may be beneficial to maintain such parenchyma in larger chunks (e.g., 10-20 parenchyma cells), rather than having them be present as smaller fines, as individual parenchyma cells. Such may aid in increasing the freeness value, e.g., to greater than 300, or greater than 400 mL CSF.

Figure 2:
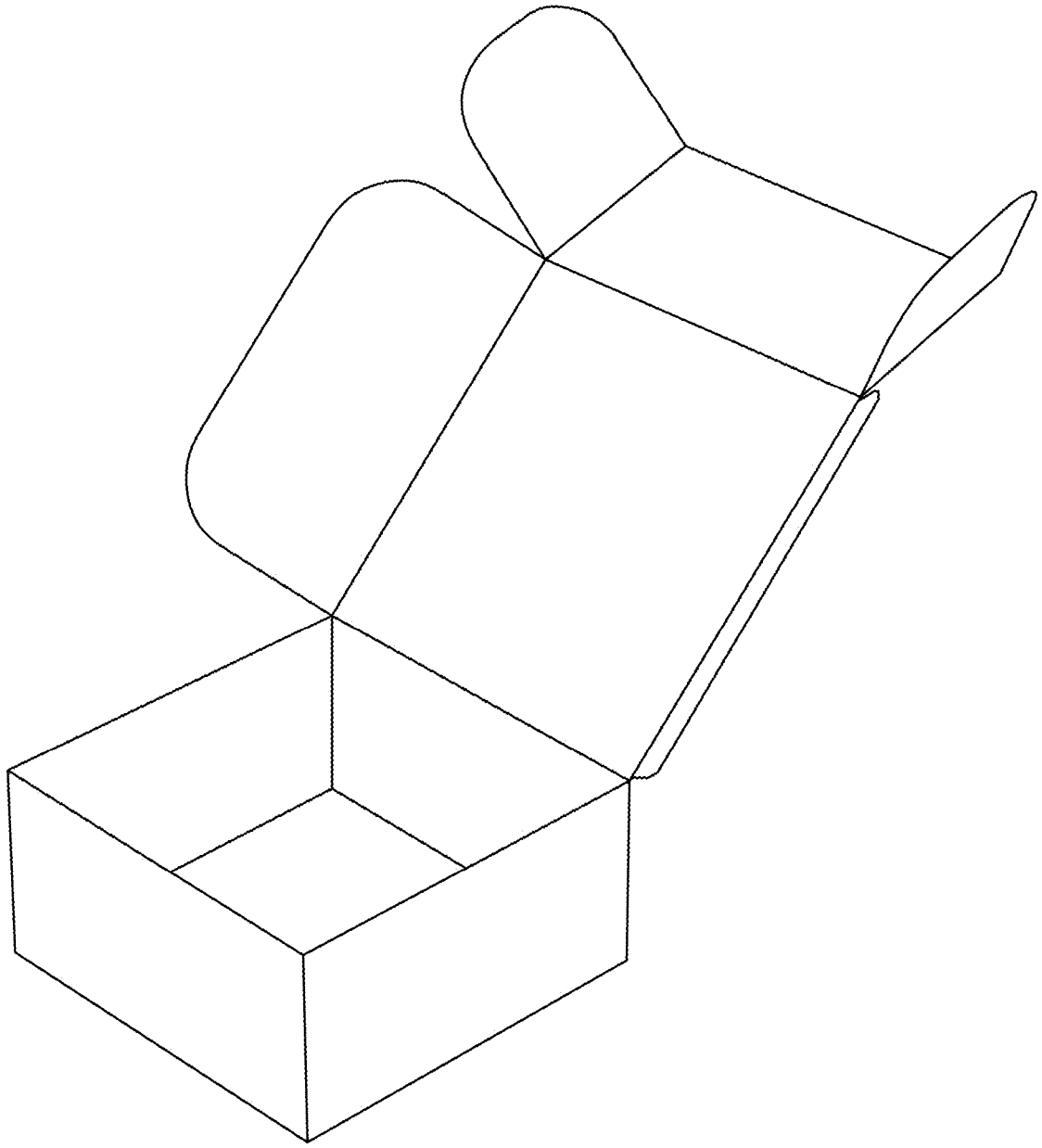
Figure 3:
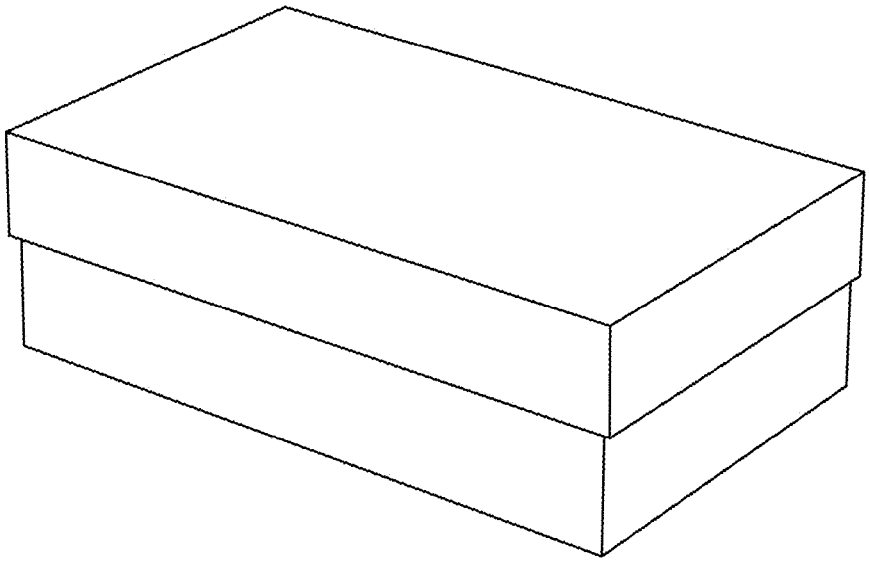
Figure 4:
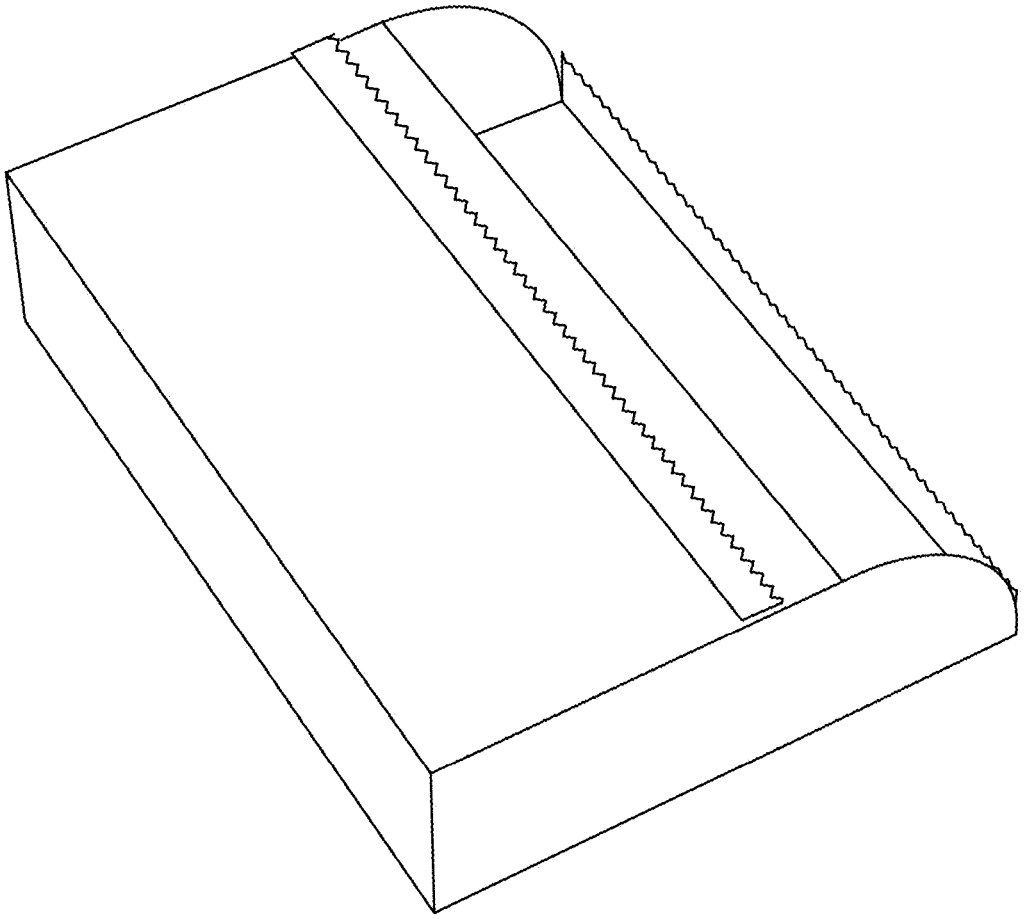
Figure 5:
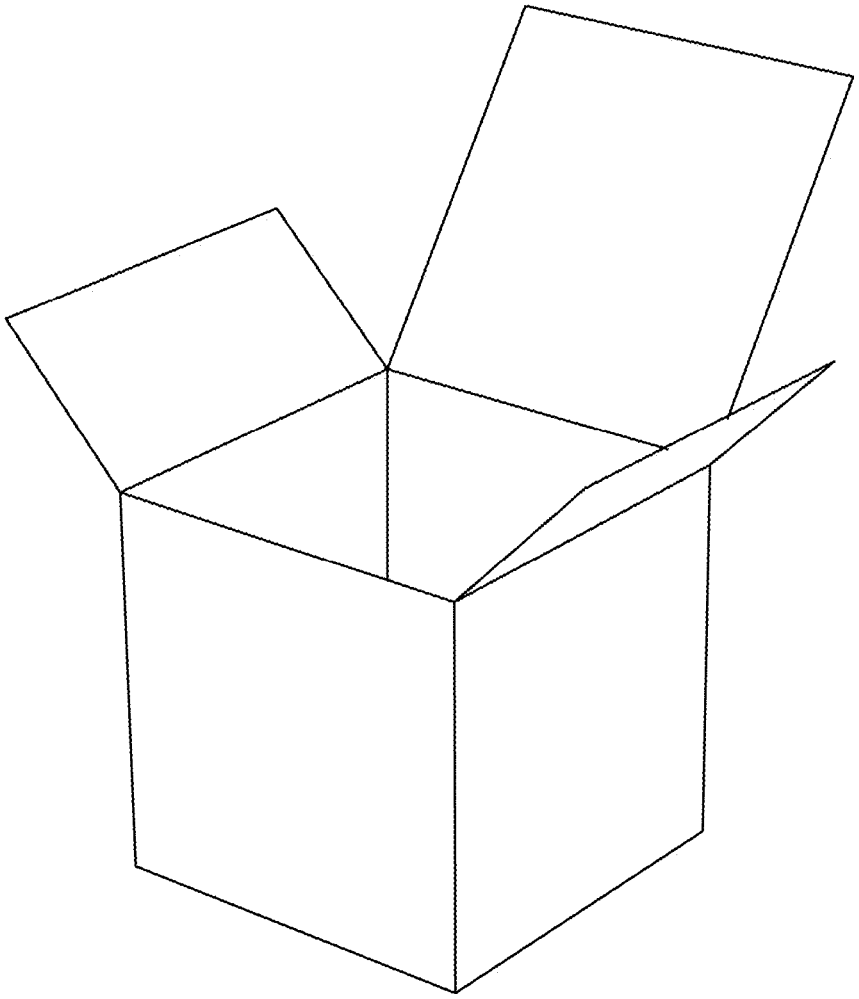
Figure 6:
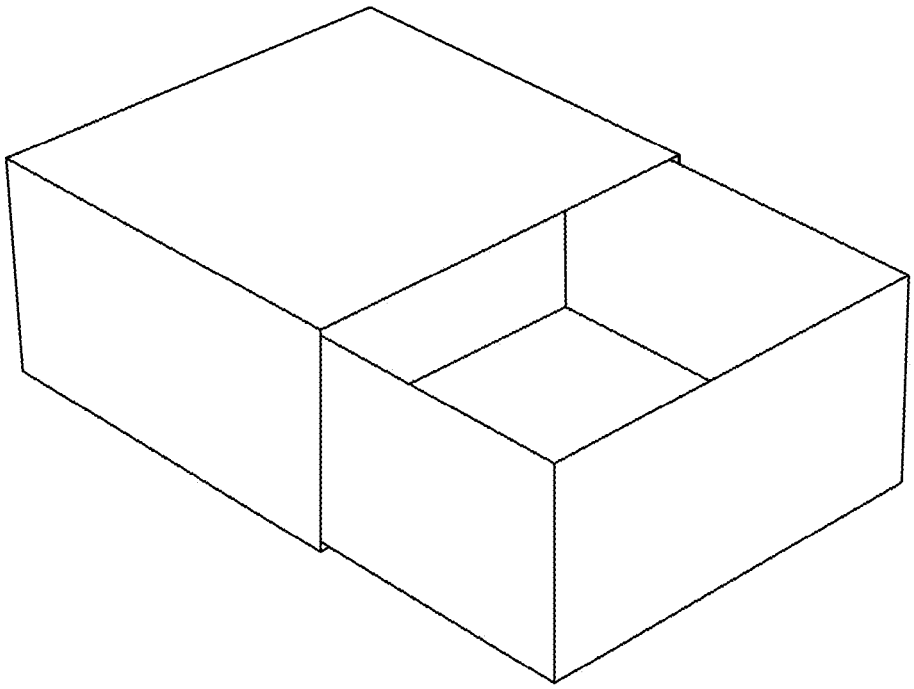
Figure 7:
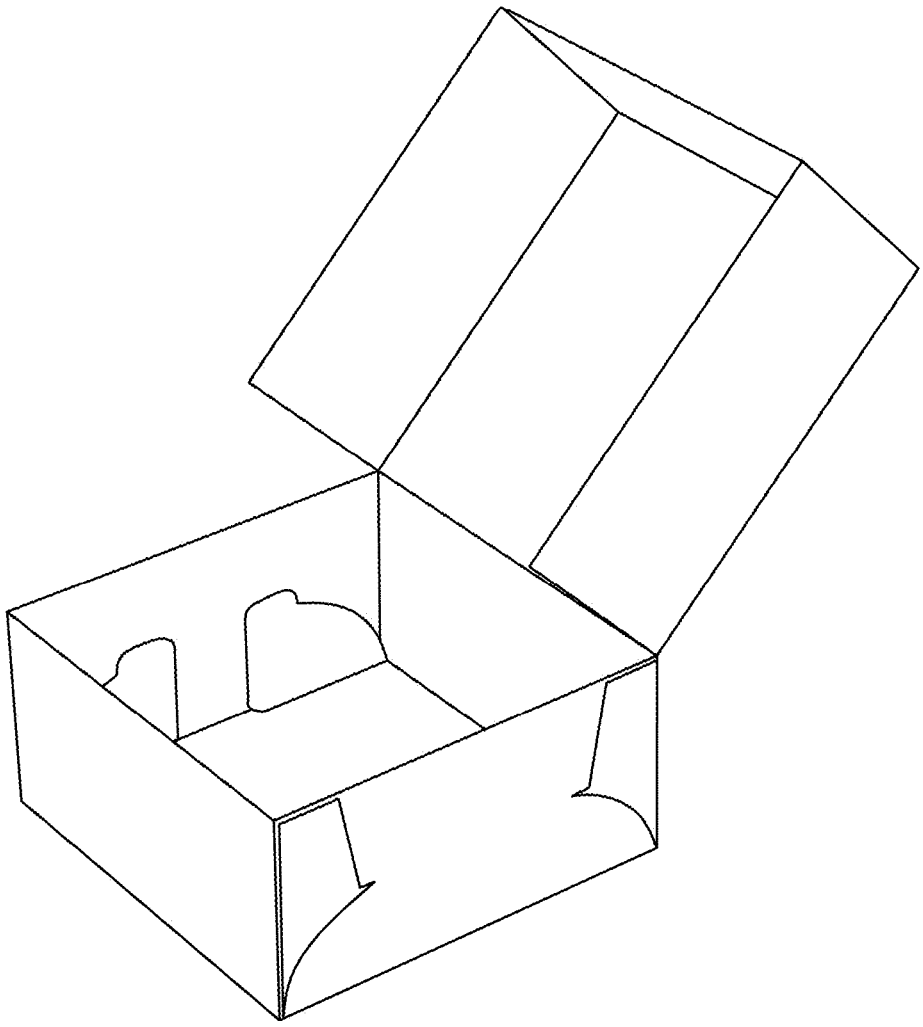
Figure 8:
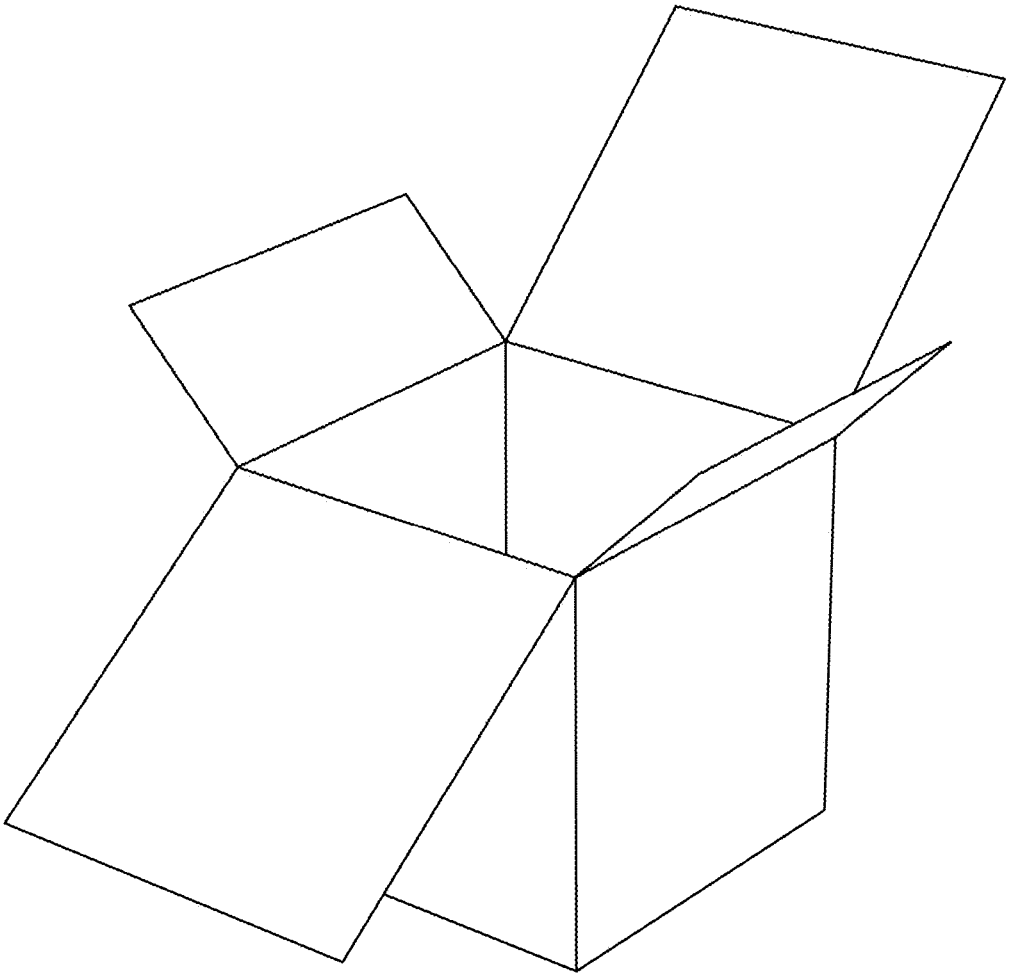
Figure 9:
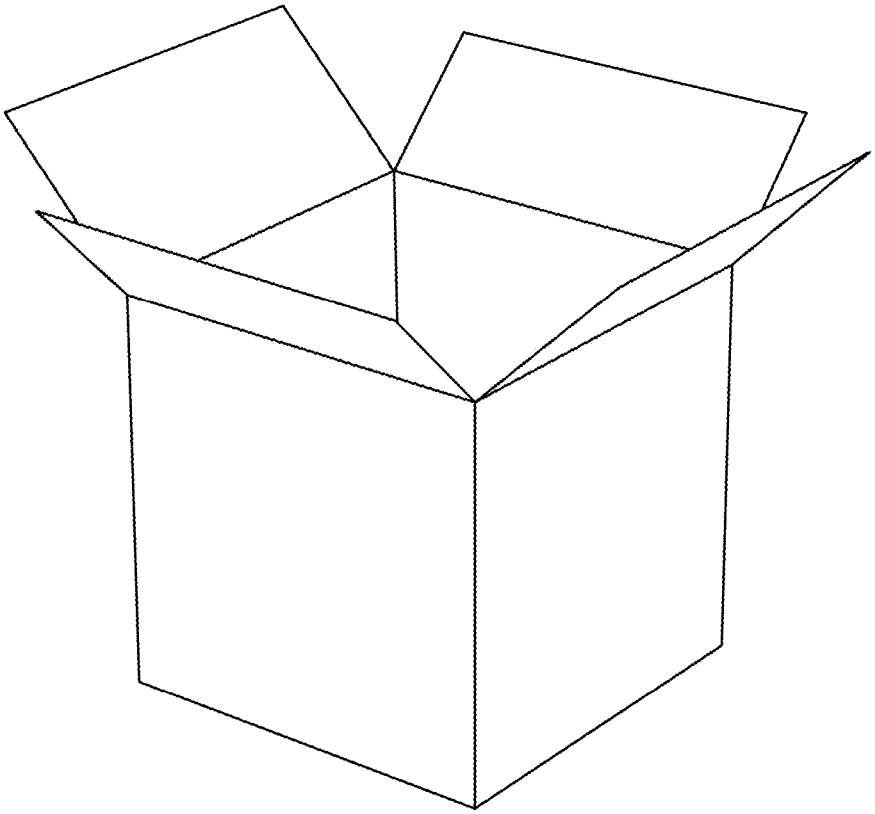

While FIG. 23 illustrates module components for use in recovering lignin and hemicellulose, it will be appreciated that such steps are optional. That said, recovery of lignin and/or hemicellulose from the liquor fractions they are dissolved in can be a beneficial aspect of the present invention. By way of example, the black liquor may be filtrated, and the filtrate can be mixed under pressure with $CO_2$ (e.g., liquid $CO_2$) in a static mixer, to decrease pH. Acidification using alternate means could also be used. The lignin and hemicellulose will precipitate at low pH (e.g., pH of 3-5, such as 4), and can then be separated by filtration and/or centrifugation. The streams including the hemicellulose and lignin can be thickened by evaporation under vacuum, heating, or the like. The water from such processes may be condensed and reused. The white liquor can be processed in a tank to degas the $CO_2$ (e.g., by simple agitation to degas the $CO_2$) and increase the pH of the resulting liquid. The vented $CO_2$ can be processed in a $CO_2$ scrubber with a small portion of black liquor (at a higher pH). The final white liquor alkali content can be adjusted with NaOH, and sent to the mixing conveyor, as shown in FIGS. 2A-2B. If desired, hemicellulose can be extracted using ethanol, or another suitable medium for extraction. Alternative to $CO_2$, a weak acid, such as an organic acid (e.g., acetic acid) may be used to drop the pH and precipitate the lignin and/or hemicellulose. In an embodiment, no acids (particularly strong mineral acids, such as hydrochloric acid, sulfuric acid, nitric acid, or phosphoric acid) are used in producing the pulp.

FIG. 23 shows conveyance (e.g., immediate conveyance) of the pulp product into the pulp chest of a paper making machine (e.g., where the cooking process is provided in a plant, side-by-side relative to the papermaking plant). As noted herein, some additional refinement of the agricultural pulp material can be achieved in the pulper of the papermaking plant (e.g., after introduction into the pulp chest thereof, for example, with OCC). It will be appreciated that the pulp product as produced in the 2-step cooking process could alternatively be packaged as wet lap bales, or dry bales of the prepared pulp product, or otherwise prepared for use in a wide variety of downstream processes.

Depending upon the embodiment, multiple types of pulp may be produced in either parallel or staggered production lines, and combined together later. Such may be particularly advantageous where the different types of pulp require different processing (e.g., relatively short fiber cereal agricultural feedstock materials, as compared to long fiber hemp agricultural material). After the pulping process, if multiple types of pulp are combined, the relative amounts of the different pulps can be adjusted at variable percentages, in a stock preparation system. In an example mixing process in which pulps of two or more different types are combined together, a first operation may involve the use of an agitated blend chest that can mix multiple pulps, at various percentages depending on desired containerboard characteristics. The blended stock may then pass to a machine chest, and is then diluted just before being discharged across a wire screen to the headbox of a paper production machine.

The third stage of some example production processes may comprise production of a product, such as containerboard for example, on paper machines which may, or may not be conventional paper machines typically used in the industry today. Example paper machines that may be employed in connection with some embodiments of the invention may comprise multiple sections, listed hereafter in order from upstream to downstream in the production process: headbox; forming section; press section; drying section; and, reel section.

In the production process, water from the pulps is drained and the material is then pressed into a continuous sheet that winds onto a reel at the end of the paper machine. The resulting product from this paper machine may be a jumbo roll of containerboard, such as testliner, medium (e.g., for corrugation), or even a corrugated multi-layer material (liner+corrugated medium). These paper machines can produce either a single-ply or multi-ply sheet. In a multi-ply sheet the different plies may be provided with different compositional characteristics (e.g., greater fraction of agricultural fibers in one ply than another). When producing a corrugated container, the liner may similarly have different compositional characteristics than the corrugated medium (e.g., greater fraction of agricultural fibers in one layer than the other). The roll widths may vary in length from about 90" to about 250," although larger or smaller widths may be employed. The basis weights of this paper generally range from about 100 gsm to about 250 gsm, or from 20.5# to 51.2#. In an embodiment, the basis weight is greater than that of typical copy paper, e.g., at least 100 gsm. In further contrast relative to a typical copy paper process, there is typically no need for any acid treatments, oxidation (e.g., ozone) or bleaching treatments for the pulp (e.g., in contrast to U.S. Pat. No. 6,302,997 to Hurter, as well as other processes that require relatively high whiteness or brightness).

At this point, the containerboard is now ready for use in a corrugation process, and can be made into a box or other product that includes a corrugated portion. The containerboard may also be used for other paper products such as, but not limited to, protective inserts, sacks and bags, mailing envelopes, and cards and tags. Some example container products that may be produced using the pulp blends and processes of example embodiments are shown in FIGS. 1-9. It will be apparent that numerous other possibilities also exist.

D. Further Aspects of Some Example Processes

With reference next to FIGS. 10A-11B, and Table 1, further details are provided concerning some example production processes according to various embodiments of the invention. As shown in Table 1, a variety of combinations of materials, or feedstock, may be employed by embodiments of the invention. In general, different combinations of feedstock materials, such as may be used in producing materials such as containerboard and/or other paper products, may be defined by combining the materials in any one or more rows of Table 1 with the materials in any one or more columns of Table 1. The relative percentages of components may vary from one embodiment to another.

TABLE 1

| | OCC | Wheat or rice residue (wheat or rice straw) | Corn residue (corn stover) | Hemp fiber | Soybean or cotton residue | Virgin wood pulp | Non-virgin wood pulp | Distillers Dried Grains w/ Solubles (DDGS) | Switchgrass or miscanthus | Other (bamboo, sugarcane bagasse, etc.) |
|---|---|---|---|---|---|---|---|---|---|---|
| OCC | | X | X | X | X | X | X | X | X | X |
| Wheat or rice residue (wheat or rice straw) | X | | X | X | X | X | X | X | X | X |
| Corn residue (corn stover) | X | X | | X | X | X | X | X | X | X |
| Hemp fiber | X | X | X | | X | X | X | X | X | X |
| Soybean or cotton residue | X | X | X | X | | X | X | X | X | X |
| Virgin wood pulp | X | X | X | X | X | | X | X | X | X |
| Non-virgin wood pulp | X | X | X | X | X | X | | X | X | X |
| Distillers Dried Grains w/Solubles (DDGS) | X | X | X | X | X | X | X | | X | X |
| Switchgrass or miscanthus | X | X | X | X | X | X | X | X | | X |
| Other (bamboo, sugarcane bagasse, etc.) | X | X | X | X | X | X | X | X | X | X |

In an example embodiment, the feedstock percentages for various agricultural fiber materials may be as follows: corn=30% (+/−5%); wheat=20% (+/−5%); and, OCC=50% (+/−5%). Note that these percentages may refer to weight percentages of the raw materials, as measured prior to commencement of a paper production process. Any of the selected feedstocks may range from, for example, at least 3%, 5% to 95%, 10% to 90%, 15% to 85%, 20% to 80%, 25% to 75%, 30% to 70%, 35% to 65%, 40% to 60%, or 45% to 55%. Exemplary values for any feedstock may include 3%, 5%, 10%, 15%, 20%, 25%, 30%, 35%, 40%, 45%, 50%, 55%, 60%, 65%, 70%, 75%, 80%, 85%, 90%, or 95%. Additional ranges may be formed by selecting any 2 of such values.

The components and associated reference numbers for FIGS. 10A, 108, 11A, and 118 are shown below.

FIG. 10A

102—Processing Line for Wheat Straw
104—Cutting
106—Milling
108—Screening
110—Washing
112—De-Watering
114—Pressurized Feeder
116—NaOH Application
118—Digester
120—Cold Blow Discharge
122—Chemical Washer
124—Screening
126—De-watering
128—Pulp Storage
130—Processing Line for OCC
132—Low Consistency Pulping
134—Pulper De-Trashing
136—High Density Cleaning Module
138—Coarse Screening
140—Low Density Cleaning
142—Fines Screening
144—Thickening
146—Pulp Storage
148—Agitated Blend Chest
150—Agitated Machine Chest
152—Paper Machine Headbox
154—Rejects Handling

FIG. 10B

202—Processing Line for Wheat Straw (Wet)
204—Low Consistency Pulping
206—Dump Chest
208—High Density Cleaning Module
210—De-Watering
212—Digester Feeder
214—NaOH Application
216—Digester
218—Chemical Washer
220—Fines Screening
222—Pulp Storage
148—Agitated Blend Chest
150—Agitated Machine Chest
152—Paper Machine Headbox
130—Processing Line for OCC
132—Low Consistency Pulping
134—Pulper De-Trashing
136—High Density Cleaning Module
138—Coarse Screening
140—Low Density Cleaning
142—Fines Screening
144—Thickening
146—Pulp Storage

Figure 10A:
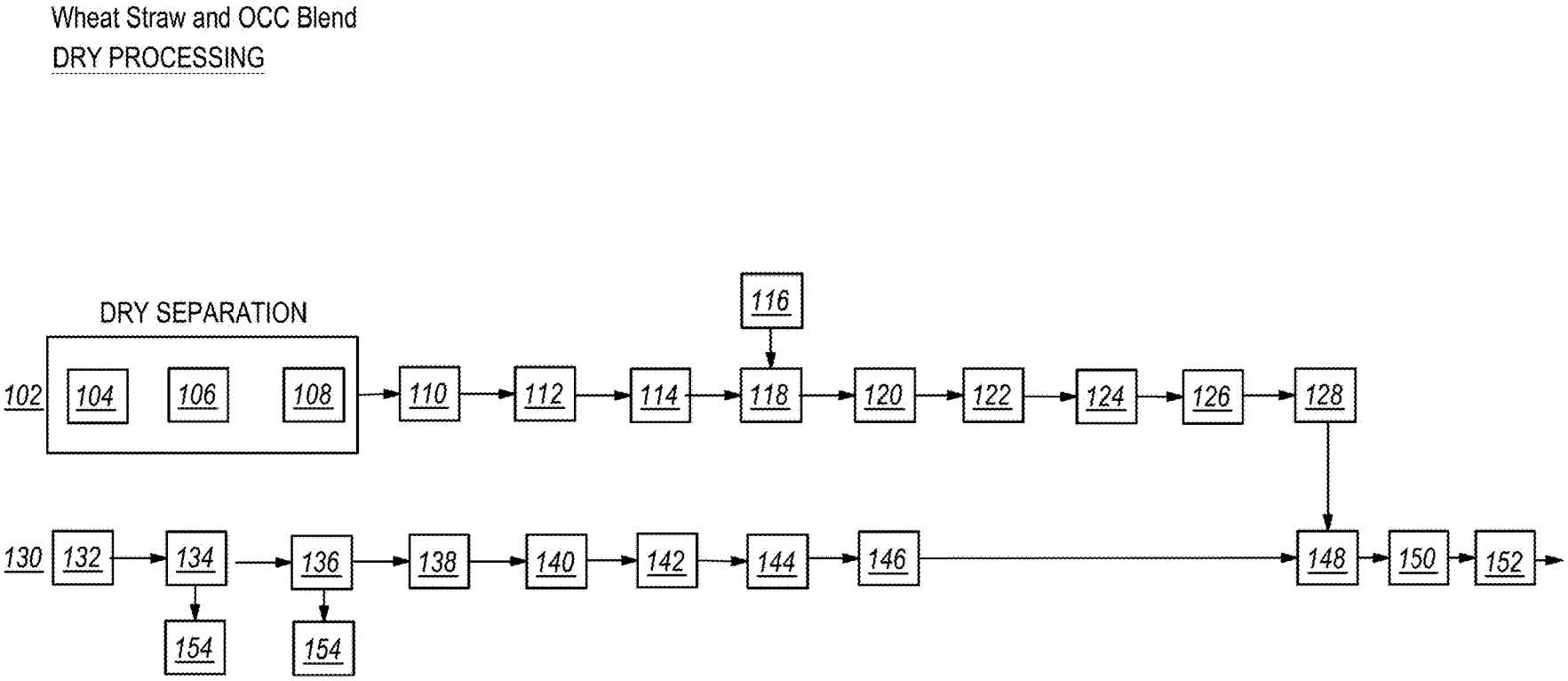
FIG. 10A is a process flow diagram for an example production process according to an exemplary embodiment of the invention.
Figure 10B:
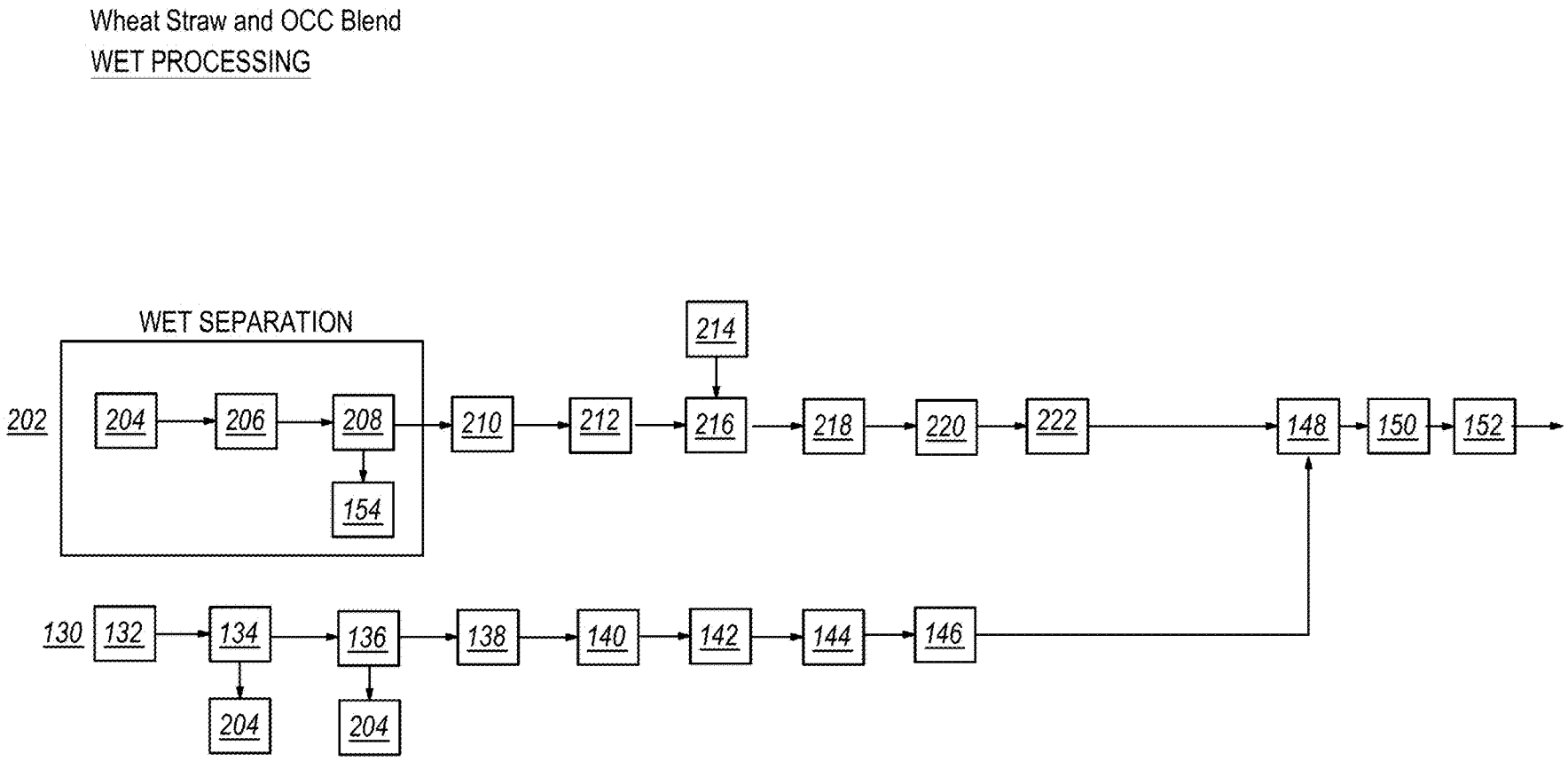
FIG. 10B is a process flow diagram for another example production process according to an exemplary embodiment of the invention.
Figure 11A:
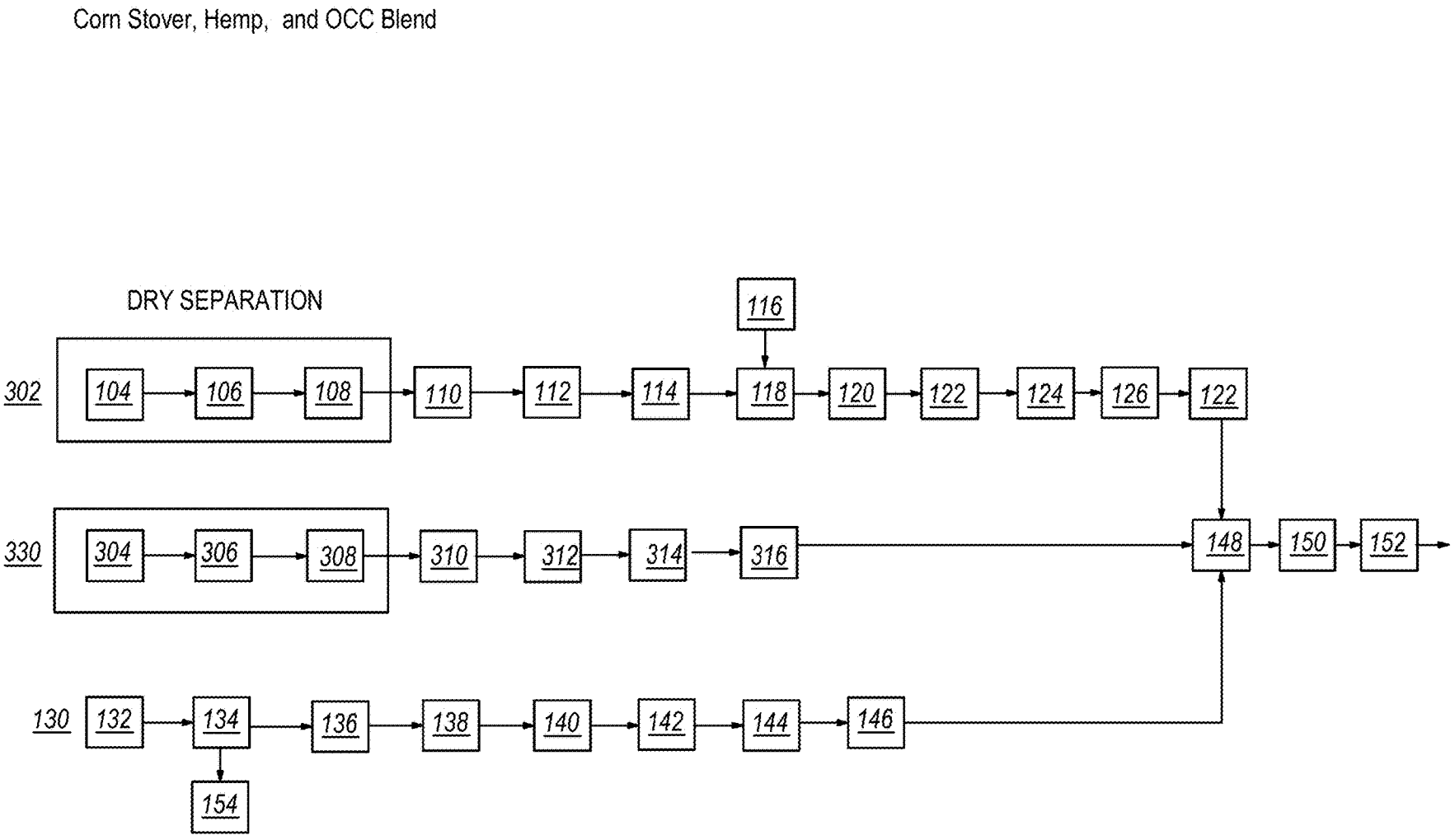
FIG. 11A is a process flow diagram for another example production process according to an exemplary embodiment of the invention.
Figure 11B:
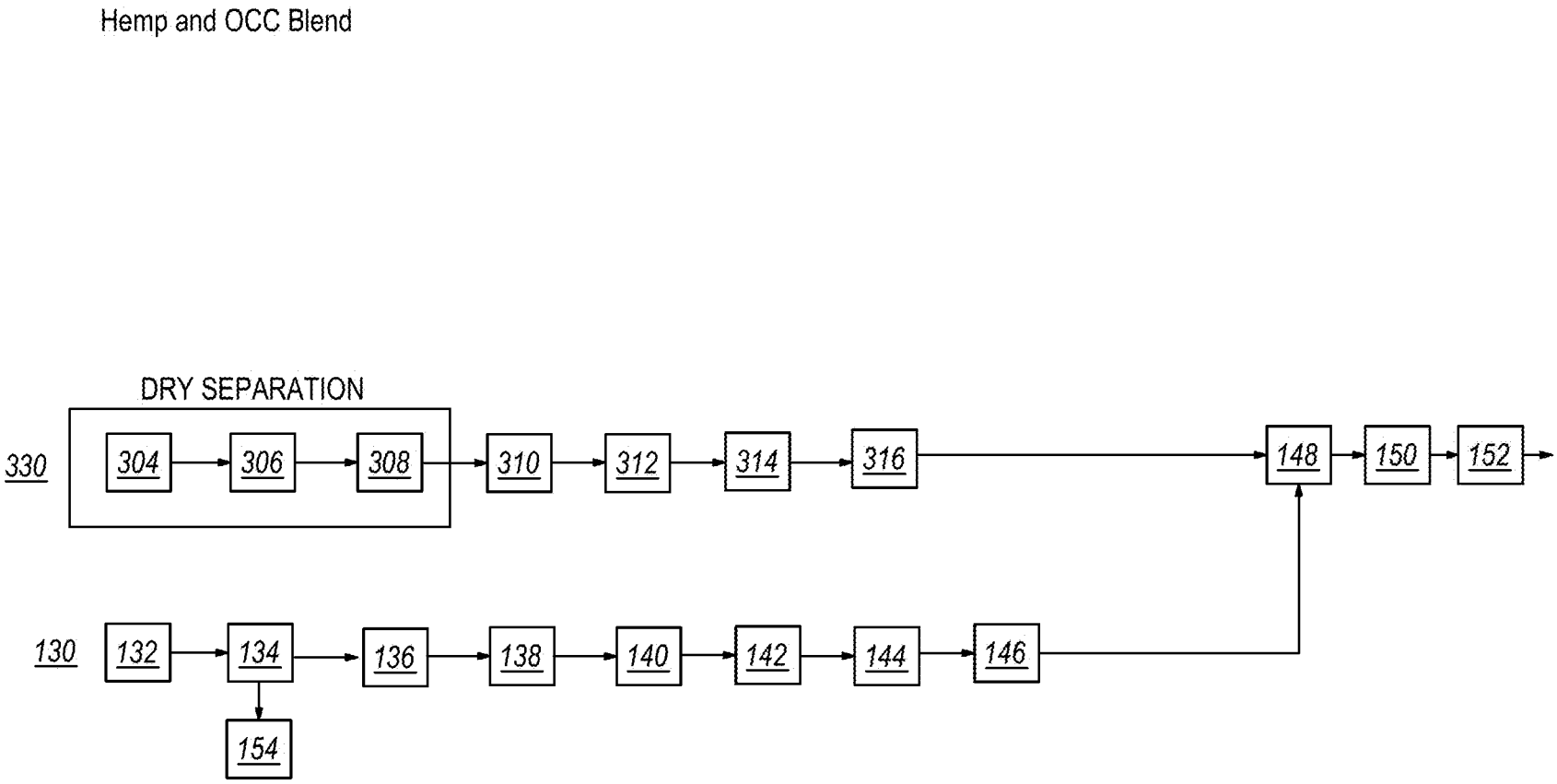
FIG. 11B is a process flow diagram for another example production process according to an exemplary embodiment of the invention.

148—Agitated Blend Chest
150—Agitated Machine Chest
152—Paper Machine Headbox
154—Rejects Handling
FIG. 11A
302—Processing Line for Corn Stover
104—Cutting
106—Milling
108—Screening
110—Washing
112—De-Watering
114—Pressurized Feeder
116—NaOH Application
118—Digester
120—Cold Blow Discharge
122—Chemical Washer
124—Screening
126—De-watering
128—Pulp Storage
330—Processing Line for Hemp
304—Cutting
306—Milling
308—Screening
310—Hydro-Pulping
312—Low Consistency Refiner
314—Screening
316—Pulp Storage
148—Agitated Blend Chest
150—Agitated Machine Chest
152—Paper Machine Headbox
130—Processing Line for OCC
132—Low Consistency Pulping
134—Pulper De-Trashing
136—High Density Cleaning Module
138—Coarse Screening
140—Low Density Cleaning
142—Fines Screening
144—Thickening
146—Pulp Storage
154—Rejects Handling
FIG. 11B
330—Processing Line for Hemp
304—Cutting
306—Milling
308—Screening
310—Hydro-Pulping
312—Low Consistency Refiner
314—Screening
316—Pulp Storage
148—Agitated Blend Chest
150—Agitated Machine Chest
152—Paper Machine Headbox
130—Processing Line for OCC
132—Low Consistency Pulping
134—Pulper De-Trashing
136—High Density Cleaning Module
138—Coarse Screening
140—Low Density Cleaning
142—Fines Screening
144—Thickening
146—Pulp Storage
154—Rejects Handling Some of the examples shown in FIGS. 10A-11B may suggest use of pressurized digesters, although it will be appreciated that no pressure, low temperature methods as described herein may provide distinct advantages. Such examples as shown in the Figures were preliminary systems that were evaluated, and improved upon. With attention to FIGS. 10A-11B, various processes are disclosed for processing feedstock such as OCC, wheat, corn, and hemp. As shown there, each agricultural feedstock material may be processed separately up through respective pulping stages (due to different pulping conditions needed for each material), after which the pulped materials may be combined with each other, such as in an agitated blend chest for example. After this combination, the resulting mixture may then be further processed, as shown in FIGS. 10A-11B. This further processing may comprise providing the mixture to an agitated machine chest, and the headbox of a paper machine, as discussed elsewhere herein, for the production of containerboard or other paper product.

For example, FIG. 10A shows an exemplary blend chart for processing a non-wood agricultural feedstock such as wheat straw, for blending with OCC to form a desired containerboard or other paper product. FIG. 10A shows a series of dry separation steps (cutting, milling, and/or screening), prior to washing and dewatering steps, preliminary to the digester. Such steps may be optional, or more limited as described, depending on the quality of the agricultural pulp fiber to be provided to the papermaking process. FIG. 10B is similar to 10A, but specifically illustrates wet processing steps (e.g., low-consistency pulping, a dump chest, and a high density cleaning module) before alkali digestion/pulping of the wheat straw. FIG. 11A illustrates processing of a non-wood agricultural feedstock such as corn stover and hemp, while FIG. 11B illustrates processing of hemp, in either case to be combined with OCC to form a desired containerboard or other paper product from a blend of such pulp fibers. As in FIG. 10A, FIGS. 11A-11B show dry separation steps for size reduction of the hemp and corn stover agricultural feedstock materials, prior to alkali pulping (e.g., a 2-step cooking process as described herein). While such size reduction steps are shown as occurring prior to the digester/pulping step, it will be appreciated that in an alternative embodiment, such preliminary size reduction steps may be optional, as screening or other steps for separation or size reduction may be performed after the digestion step. In other words, screening or other size reduction can occur after pulping, allowing the pulping step to accomplish at least some of the needed size reduction. In addition, as noted herein, some final size reduction or refining could be achieved in an OCC pulper, preliminary to and associated with the papermaking machine.

By way of example, in the case of a corn stover process similar to that seen in FIG. 11A, rather than performing the illustrated dry separation steps illustrated, the corn stover may simply be wetted (illustrated washing step) to remove dirt therefrom, and proceed to the digester. The illustrated screening step after pulping/digestion of the wet pulped corn stover can serve to accomplish similar results as the optional dry separation steps. Such a screening step can be important somewhere in the process (before and/or after alkali pulping) due to the non-homogenous fiber or particle size characteristics of the contemplated agricultural feedstock materials. Such non-homogenous characteristics differ from typical wood materials used in pulping, which materials are largely homogenous in particle or fiber sizes, by comparison.

The freeness of the employed pulps, or pulp blends may be any desired value. By way of example, the freeness of such may be from 200 to 500 mL CSF, 200 to 450 mL CSF, 200 to 300 mL CSF, at least 300 mL CSF, such as 300-500 mL CSF, from 350-400 mL CSF, or 375-425 mL CSF. Higher freeness values correspond to faster drainage of the water from the paper making pulp mixture. Where freeness is too low, this may interfere with the ability to effectively form the desired containerboard. Where freeness is too high, drainage may be so fast that it can result in a product with poor strength characteristics, and uneven dispersion of pulp fibers.

Advantageously, any residual alkali (e.g., hydroxide) within the pulp may be removed through a washing or other suitable step, so that the final produced containerboard, and the pulp fibers from which such is formed may have a pH value of about 7 (e.g., 6 to 8, such as 6.5 to 7.5).

E. Testing, Experiments, and Trials

Any reference to ASTM, ISO, TAPPI or other standards refers to the latest update to any such standard, unless otherwise indicated. Any such referenced standards are herein incorporated by reference in their entirety.

Trial 1.

An exemplary fiber preparation process for hemp and corn stover was evaluated. A standard silage chopper with a 2" screen was used for fiber preparation of both hemp and corn stover materials. The goal of the trial was to test pure hemp, pure corn stover, and OCC at various levels of refinement, as well as to evaluate a range of blends of such raw materials for testing. When testing hemp, it was found that the long fibers roped around the agitator, which may have been responsible at least in part for lower than optimum strength results for hemp. A total of 17 blends were prepared and tested. It was observed at the end of the first complete set that the freeness of the OCC was abnormally high, about 700 mL CSF. Reducing the freeness may improve homogenous dispersion of fibers, and the strength of the paper product. A second batch formed from the same blends was prepared, using OCC that had been refined down to a freeness value of about 450 mL CSF.

Trial 1 Corn Stover Digester

A shipment of raw chopped hemp stalks (cat. 1) and corn stover from Murray State University in Kentucky was used for Trial 1. 350 g of oven dried corn stover was alkali digested in a 5 L batch digester with 20% active alkali (relative to the hemp, by weight), at a liquor to chip ratio of 6:1 (no sodium sulfide added). The digester used a small pump to recirculate liquor through the bed of chips. One corn stover cook was also completed with this batch digester setup, but recirculation problems were observed on the second attempt. To reduce this problem, in the next batch, the corn stover was first wet de-pithed by soaking the chips in hot water (approx. 115° F.) and refining them in a chip refiner with the gap set to 0.060 inch. Resultant chips were collected, air dried, and sifted through a 1/16th inch mesh screen. A cook with the de-pithed chips was attempted, but abandoned early due to continued poor liquor recirculation.

The corn stover cooks were completed by decreasing the amount of chips in the digester to 200 g (on an oven dried basis), and increasing the liquor to chip ratio (L:C or L:W) to 9:1. For each cook, the pH was monitored before and after each cook, and the liquor tested for residual alkali. The first corn stover cook had a calculated H-factor of 245 and a residual alkali (RA) of 10.9 g/L $Na_2O$. H-factor is a pulping variable measurement that combines cooking temperature and time into a single variable, and its calculation will be apparent to those of skill in the art. There was concern that the fibers were over-cooked, and precipitation of lignin may be occurring. The remaining cooks were lowered to a calculated H-factor of 132 and the active alkali percentage lowered to 15% (relative to the corn stover, by weight), as shown in Table 2. The corn stover cook temperature was 160° C.

TABLE 2

| Sample | Chips (g) OD | Digester (L) | % Active Alkali (relative to Chips) | L:W | Calc. H-Factor | Residual Alkali (#/ft$^3$ $Na_2O$) | Residual Alkali (g/L $Na_2O$) |
|---|---|---|---|---|---|---|---|
| Corn Stover 1 | 350 | 5 | 20 | 6 | 245 | 0.682 | 10.93 |
| Corn Stover 2 | 200 | 5 | 20 | 9 | 132 | 0.461 | 7.39 |
| Corn Stover 3 | 200 | 5 | 20 | 9 | 132 | 0.447 | 7.16 |
| Corn Stover 4 | 450 | 10 | 15 | 9 | 132 | 0.248 | 3.97 |
| Corn Stover 5 | 450 | 10 | 15 | 9 | 132 | 0.171 | 2.75 |
| Corn Stover 6 | 450 | 10 | 15 | 9 | 132 | 0.234 | 3.75 |

Trial 1 Hemp Digester

For the hemp digestion. Trial 1 started with Category 1 hemp: rough chopped stalks—pre CBD extraction. While these broke down well in the digester, the bast fibers were very long and screened out. The bast fibers would be expected to increase the tear strength of paper with proper distribution (i.e., minimal or no clumping) in the sheet. Traditional papermaking does not handle long fibers (>5 mm length) well and can result in roping of fibers in the stock approach system or poor dispersion during sheet formation. After testing the residual alkali from the first sample (Hemp Cat. 1-1) it was observed that there was alkali left, and that the cook time should be increased. The cooking conditions and residual alkali testing for the hemp fibers are referenced in Table 3. The hemp cook temperature was 170° C.

TABLE 3

| Sample | Chips (g) OD | Digester (L) | % Active Alkali (relative to Chips) | L:W | Calc. H-Factor | Residual Alkali (#/ft$^3$ $Na_2O$) | Residual Alkali (g/L $Na_2O$) |
|---|---|---|---|---|---|---|---|
| Hemp Cat. 1-1 | 350 | 5 | 20 | 5 | 132 | 0.899 | 14.39 |
| Hemp Cat. 1-2 | 350 | 5 | 20 | 5 | 397 | 0.790 | 12.65 |
| Hemp Cat. 1-3 | 350 | 5 | 20 | 5 | 397 | 0.828 | 13.26 |
| Hemp Cat. 4-1 | 635.5 | 10 | 20 | 6 | 627 | 0.599 | 9.60 |
| Hemp Cat. 4-2 | 650 | 10 | 20 | 6 | 704 | 0.589 | 9.43 |
| Hemp Cat. 4-3 | 650 | 10 | 20 | 6 | 704 | 0.560 | 8.97 |

After each cook, the free-flowing black liquor was collected for further analysis. The chips were washed with a known amount of hot tap water and the filtrate collected. Chips were refined in a Sprout-Waldron 105-A 12" Refiner with a 0.010" gap. Before every refining, the refiner was heated, and the gap checked using a feeler gauge. Resultant fibers were screened for 20 minutes through an 0.008" Somerville flat screen, with the cuts parallel to the direction of flow. Accept and reject fibers were collected; yield, Kappa, and percent Ash were determined on the accept fibers (Table 4). From the yield and collected black liquor and wash, the amount of black liquor, total suspended solids, and total dissolved solids in a sample from each type of fiber were calculated (Table 5).

TABLE 4

| | Yield-Overall | | Yield-Collected | | | | |
|---|---|---|---|---|---|---|---|
| Sample | Accept (%) | Reject (%) | Accept (%)2 | Reject (%)3 | Freeness | Kappa | Ash (%) |
| Corn Stover | 37.53 | 0.15 | 99.61 | 0.39 | 294.17 | 11.02 | 6.08 |
| std.dev | 1.76 | 0.20 | 0.51 | 0.51 | 60.45 | 3.52 | |
| Hemp Cat-1 | 42.09 | 2.93 | 93.33 | 6.67 | 573.33 | 89.40 | 3.41 |
| std.dev | 4.30 | 1.72 | 4.34 | 4.34 | 20.82 | 19.03 | |
| Hemp Cat-4 | 39.60 | 0.50 | 98.73 | 1.27 | 568.33 | 99.00 | 7.64 |
| std.dev | 2.99 | 0.25 | 0.70 | 0.70 | 30.14 | 5.03 | |

TABLE 5

| Sample | Black Liquor Total Solids (%) | Total Suspended Solids | Total Dissolved Solids |
|---|---|---|---|
| Corn Stover | 7.88 | 247.81 | 35.52 |
| Hemp Cat-1 | 11.81 | 378.88 | — |
| Hemp Cat-4 | 11.17 | 596.21 | 46.53 |

After producing more than 700 g of accept hemp and corn stover fibers, a PFI mill study was performed on each fiber type to test freeness vs handsheet physical strength. Each fiber was refined at 0, 250, 500, and 1000 revolutions (e.g., in the PFI mill). If the freeness dropped below 200, the study was stopped. Table 6 reports the fiber refining vs. freeness, with each fiber type being tested in duplicate.

TABLE 6

| Sample | Revolutions | Average Freeness |
|---|---|---|
| Corn Stover | 0 | 310 |
| Corn Stover | 250 | 180 |
| Hemp Cat-1 | 0 | 485 |
| Hemp Cat-1 | 250 | 395 |
| Hemp Cat-1 | 500 | 390 |
| Hemp Cat-1 | 1000 | 345 |
| Hemp Cat-4 | 0 | 475 |

TABLE 6-continued

| Sample | Revolutions | Average Freeness |
|---|---|---|
| Hemp Cat-4 | 250 | 365 |
| Hemp Cat-4 | 500 | 355 |
| Hemp Cat-4 | 1000 | 320 |

The fibers from each revolution point were formed into handsheets following the procedure written in TAPPI T205. After the handsheets dried and cured to 73° F. and 50% relative humidity, the paper was tested for its physical properties: basis weight, caliper, density, tear, tensile, burst, and taber stiffness, following TAPPI Standards T220 and T566. Table 7 reports the average results from testing. From this data, it was concluded that separate refining of the fiber types may be helpful in achieving optimal strength properties in a mixed fiber paper.

TABLE 7

| Sample | Basis weight (gsm) | Caliper (0.001") | Density (g/cm$^3$) | Taber Stiffness (TSU) | Tear Index (m•Nm$^2$/g) | Burst Index (kPa•m$^2$/g) | Tensile Index (N•m/g) |
|---|---|---|---|---|---|---|---|
| Hemp Cat-4 0 Rev | 62.88 | 5.59 | 0.443 | 0.498 | 4.88 | 1.67 | 37.21 |
| Hemp Cat-4 250 Rev | 63.29 | 5.31 | 0.469 | 0.586 | 4.36 | 2.19 | 47.30 |
| Hemp Cat-4 500 Rev | 63.21 | 4.88 | 0.510 | 0.606 | 4.63 | 2.31 | 47.46 |
| Hemp Cat-4 1000 Rev | 64.93 | 4.82 | 0.530 | 0.637 | 4.63 | 2.77 | 52.22 |
| Hemp Cat-4 3000 Rev | 67.35 | 4.84 | 0.548 | 0.571 | 4.40 | 3.26 | 62.85 |
| Corn Stover 0 Rev | 65.05 | 4.84 | 0.529 | 0.509 | 6.95 | 4.85 | 87.90 |
| Corn Stover 250 Rev | 66.76 | 4.49 | 0.586 | 0.528 | 6.17 | 5.14 | 82.67 |
| Hemp Cat-1 0 Rev | 59.35 | 4.86 | 0.481 | 0.436667 | 6.15 | 2.75 | 52.38 |
| Hemp Cat-1 250 Rev | 59.76 | 4.80 | 0.490 | 0.521667 | 5.44 | 3.33 | 57.30 |
| Hemp Cat-1 500 Rev | 57.46 | 4.38 | 0.517 | 0.6 | 6.03 | 3.68 | 61.45 |
| Hemp Cat-1 1000 Rev | 55.78 | 4.24 | 0.518 | 0.503333 | 5.23 | 3.79 | 67.07 |

17 handsheet samples including varying amounts of OCC, corn stover, and hemp were formed, outlined in Table 8. The OCC and corn stover were un-refined, and the hemp was refined in the PFI mill for 250 revolutions. Sample 9 was a control, formed from 100% OCC.

TABLE 8

| Sample | OCC (%) | Hemp (%) | Corn (%) |
|---|---|---|---|
| 1 | 75.0 | 25.0 | 0.0 |
| 2 | 75.0 | 0.0 | 25.0 |
| 3 | 50.0 | 0.0 | 50.0 |
| 4 | 50.0 | 25.0 | 25.0 |
| 5 | 58.3 | 33.3 | 8.3 |

TABLE 8-continued

| Sample | OCC (%) | Hemp (%) | Corn (%) |
|---|---|---|---|
| 6 | 66.7 | 16.7 | 16.7 |
| 7 | 75.0 | 0.0 | 25.0 |
| 8 | 50.0 | 50.0 | 0.0 |
| 9 | 100.0 | 0.0 | 0.0 |
| 10 | 83.3 | 0.0 | 16.7 |
| 11 | 58.3 | 8.3 | 33.3 |
| 12 | 83.3 | 16.7 | 0.0 |
| 13 | 66.7 | 16.7 | 16.7 |
| 14 | 66.7 | 16.7 | 16.7 |
| 15 | 50.0 | 25.0 | 25.0 |
| 16 | 66.7 | 33.3 | 0.0 |
| 17 | 66.7 | 16.7 | 16.7 |

Figure 12:
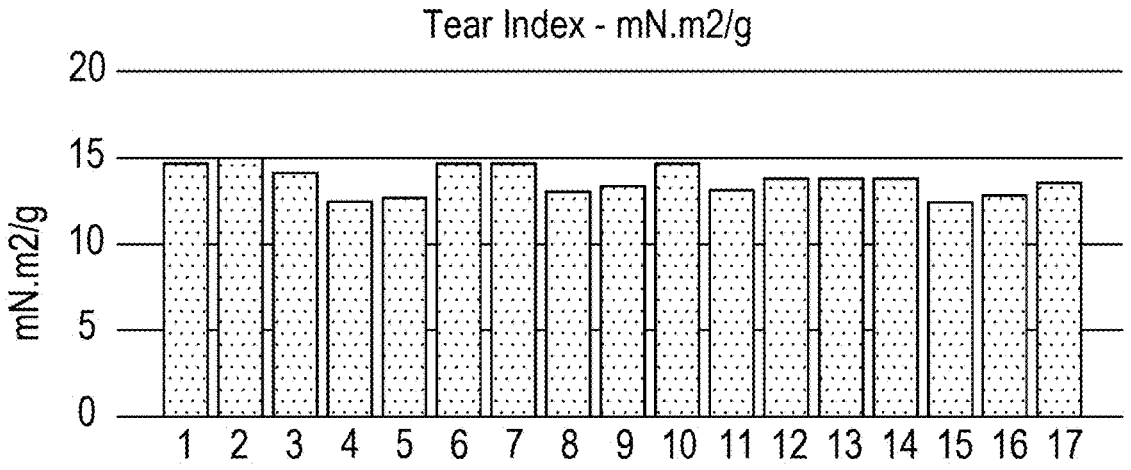
FIGS. 12-17 provide strength properties for handsheets formed during Trial 1, as described in the Examples section of the present application.
Figure 13:
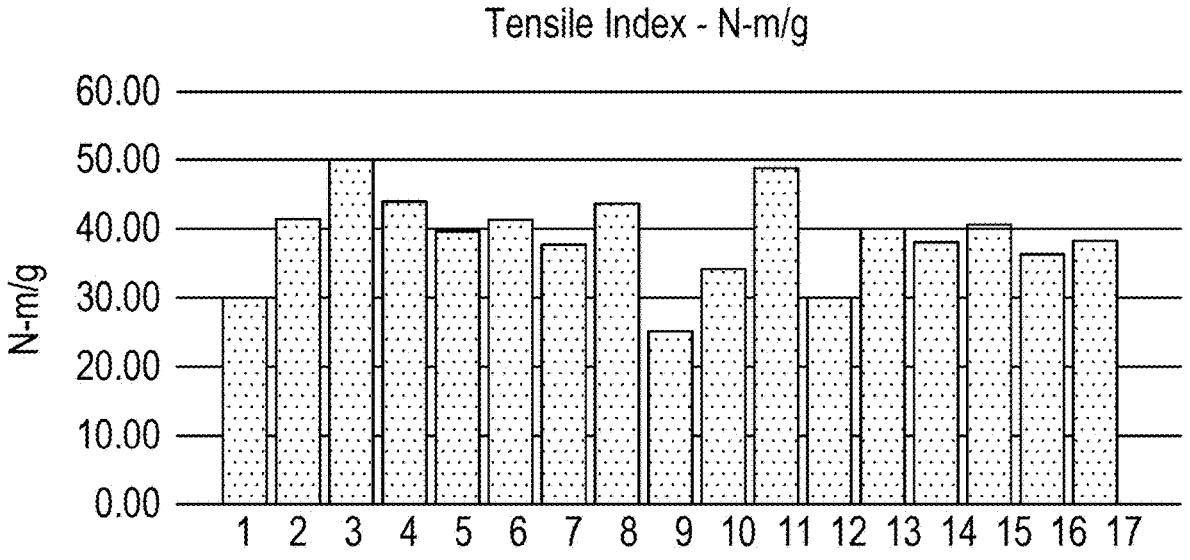
Figure 14:
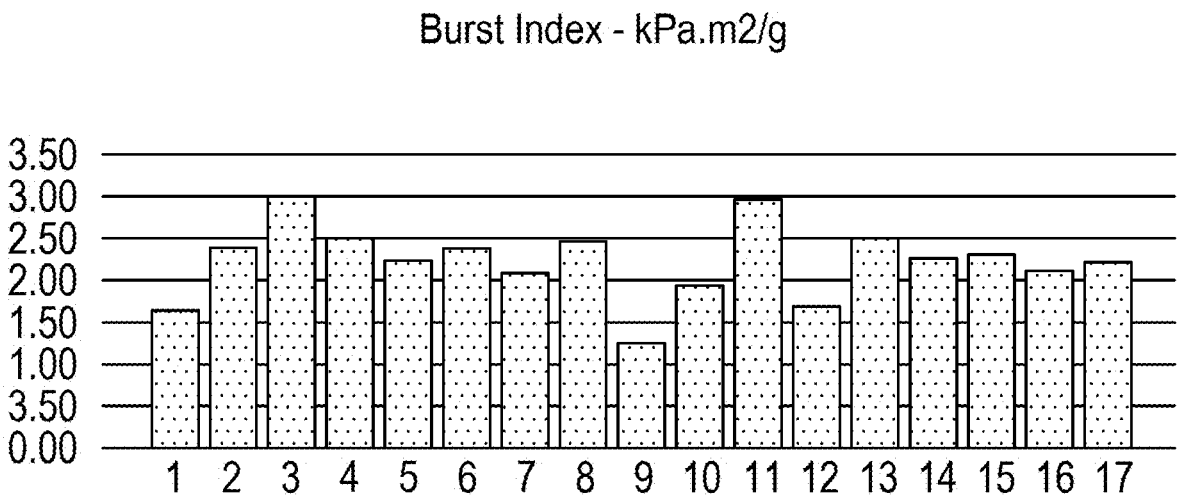

15 handsheets were produced from each set of blended fibers. The 10 best handsheets were tested for physical strength properties. The best handsheets were chosen from a standard deviation of the grammage, with no damage to the sheets. These properties were used to determine how adding hemp or corn stover fibers to the OCC would affect the strength properties of the product. FIGS. 12-14 show resulting properties for tear index, tensile index, and burst index. The data indicates that adding both corn stover and hemp increases the strength properties to create a stronger paper than 100% OCC. Samples 3 and 11 show a significant increase on tensile and burst strengths. Both samples have a high addition of corn stover, 50% and 33.3% additions by weight, respectively. Samples 1, 2, 6, 7 and 10 show an increase in tear strength. These samples included up to 25% corn stover fibers, and/or hemp fibers.

Figure 15:
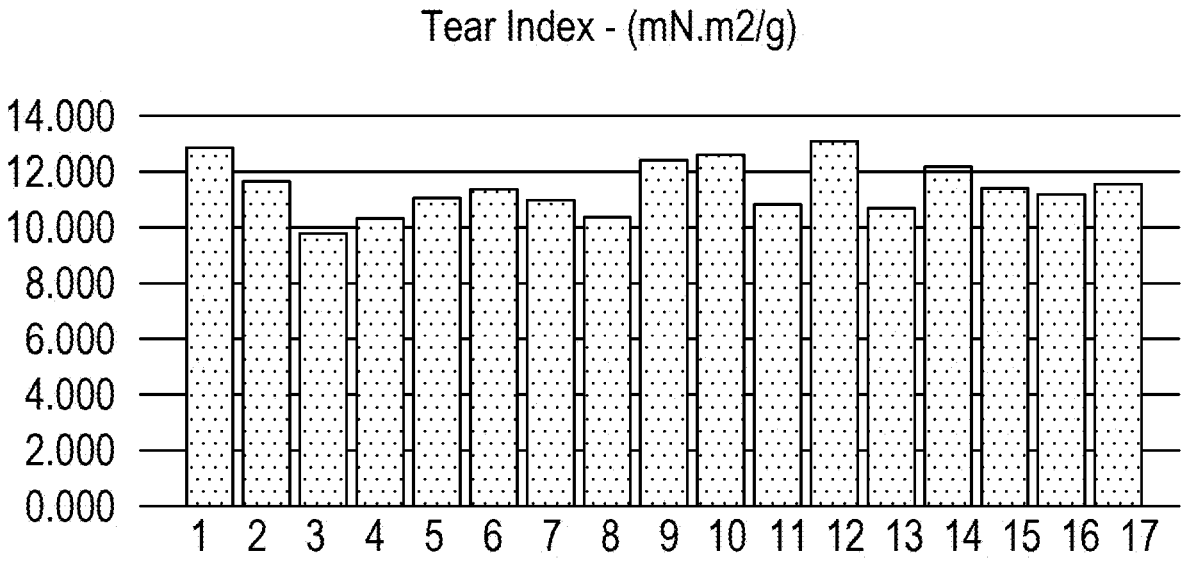
Figure 16:
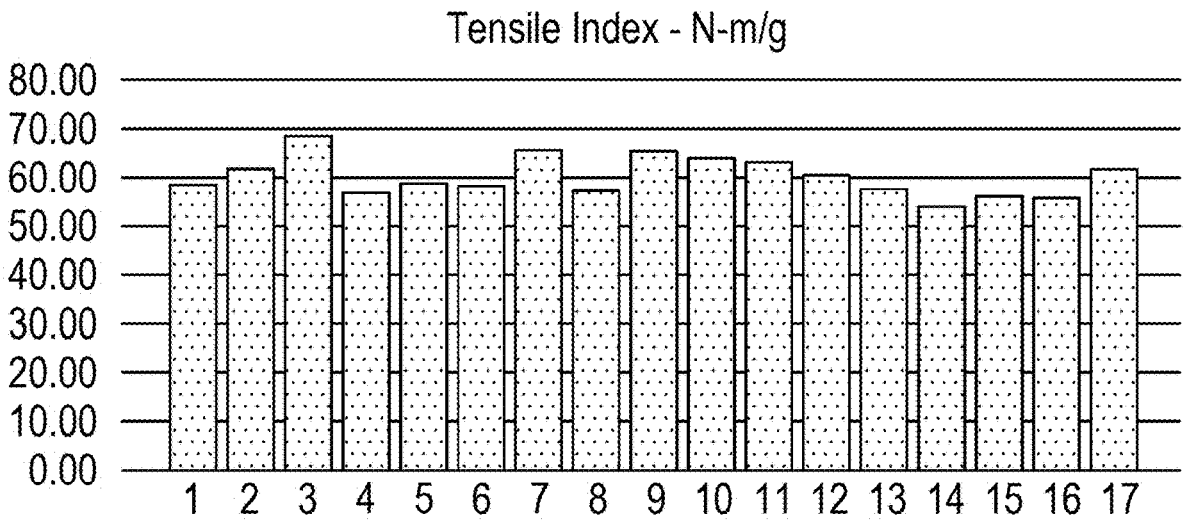
Figure 17:
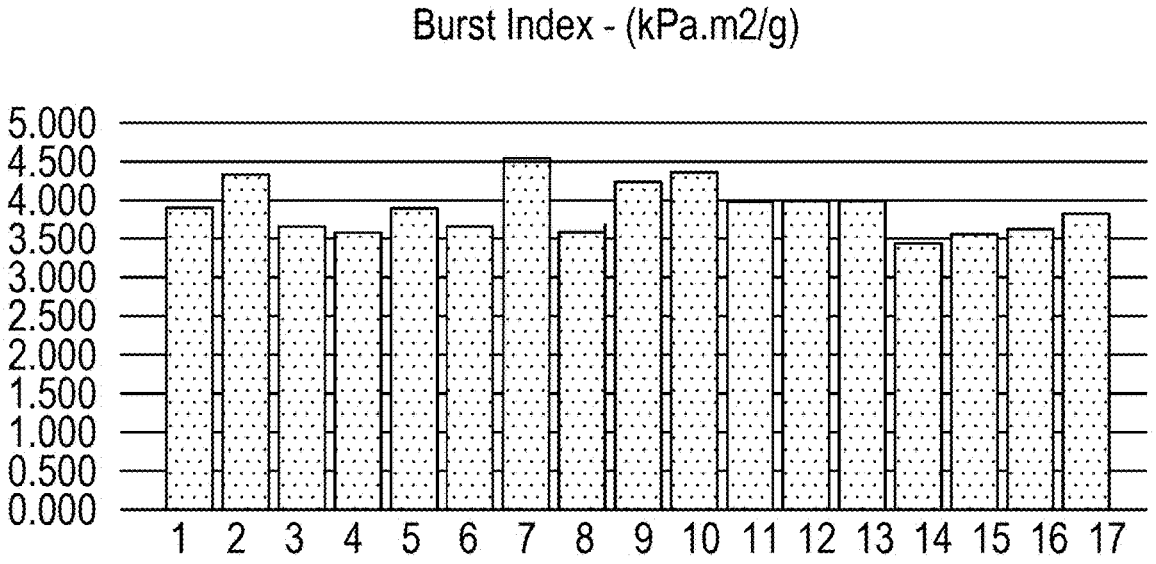

The first blended handsheet study used OCC as received from a local papermill. After the first set was tested, it was found that the provided OCC had a higher freeness (755 mL CSF) than expected for typical OCC. The trial was redone with the OCC refined to a freeness of 435 mL CSF. The same blends and testing procedures were used. FIGS. 15-17 show the resulting data for tear index, tensile index and burst index for the second set of tests (with lower OCC freeness). FIGS. 12-14 show the resulting data with the OCC having a higher freeness.

Table 9 shows grammage, basis weight, caliper and density measurements for each of the first 17 samples (where the OCC exhibited higher freeness).

TABLE 9

| Sample | Grammage g | Basis Wt. (gsm) | Caliper (0.001") | Density g/cm$^3$ |
|---|---|---|---|---|
| 1 | 1.251 | 62.56 | 6.60 | 0.371 |
| 2 | 1.256 | 62.81 | 5.69 | 0.435 |
| 3 | 1.266 | 63.28 | 5.49 | 0.453 |
| 4 | 1.241 | 62.05 | 5.51 | 0.448 |
| 5 | 1.234 | 61.69 | 5.48 | 0.445 |
| 6 | 1.227 | 61.36 | 5.72 | 0.425 |
| 7 | 1.240 | 62.02 | 5.94 | 0.409 |
| 8 | 1.206 | 60.29 | 5.28 | 0.448 |
| 9 | 1.327 | 66.33 | 6.77 | 0.386 |
| 10 | 1.269 | 63.45 | 6.15 | 0.403 |
| 11 | 1.260 | 63.02 | 5.46 | 0.456 |
| 12 | 1.245 | 62.27 | 6.35 | 0.387 |
| 13 | 1.182 | 59.09 | 5.24 | 0.447 |
| 14 | 1.278 | 63.89 | 5.66 | 0.444 |
| 15 | 1.196 | 59.79 | 5.55 | 0.426 |
| 16 | 1.216 | 60.78 | 5.40 | 0.447 |
| 17 | 1.260 | 63.00 | 5.54 | 0.446 |

Tables 10-11 report various characteristics for the paper formed from the blends of Table 9.

TABLE 10

| Sample | Tear (mN) | Tear Index mN.m$^2$/g | Tensile N | Tensile Strength kN/m | Tensile Index N.m/g | Stretch % | TEA J/m$^2$ | Freeness CSF |
|---|---|---|---|---|---|---|---|---|
| 1 | 923.37 | 14.77 | 28.14 | 1.88 | 29.98 | 1.63 | 20.58 | 690 |
| 2 | 937.21 | 14.93 | 38.54 | 2.57 | 40.89 | 1.95 | 32.84 | 625 |
| 3 | 886.74 | 14.01 | 47.63 | 3.18 | 50.18 | 2.09 | 43.89 | 535 |
| 4 | 769.17 | 12.40 | 40.73 | 2.72 | 43.75 | 1.98 | 36.97 | 580 |
| 5 | 780.62 | 12.65 | 36.32 | 2.42 | 39.25 | 1.97 | 30.31 | 580 |
| 6 | 896.73 | 14.61 | 37.79 | 2.52 | 41.06 | 1.79 | 28.87 | 620 |
| 7 | 911.1 | 14.69 | 34.87 | 2.32 | 37.48 | 1.85 | 28.60 | 640 |
| 8 | 777.94 | 12.93 | 39.14 | 2.61 | 43.29 | 2.02 | 34.67 | 590 |
| 9 | 880.8 | 13.28 | 24.76 | 1.65 | 24.88 | 1.36 | 13.84 | 755 |
| 10 | 934.24 | 14.62 | 32.46 | 2.16 | 34.11 | 1.79 | 23.73 | 675 |
| 11 | 826.15 | 13.11 | 46.31 | 3.09 | 49.00 | 2.00 | 41.31 | 560 |
| 12 | 859.5 | 13.82 | 27.82 | 1.85 | 29.80 | 1.47 | 18.31 | 695 |
| 13 | 815.46 | 13.80 | 35.32 | 2.35 | 39.85 | 1.67 | 26.36 | 605 |
| 14 | 883.73 | 13.83 | 35.85 | 2.39 | 37.42 | 1.96 | 30.28 | 620 |
| 15 | 737.1 | 12.32 | 36.01 | 2.40 | 40.17 | 1.85 | 30.43 | 565 |
| 16 | 772.73 | 12.71 | 32.75 | 2.18 | 35.93 | 1.75 | 26.00 | 580 |
| 17 | 852.09 | 13.52 | 36.08 | 2.41 | 38.18 | 1.93 | 31.51 | 605 |

TABLE 11

| | | | Burst Index | | | | Stiffness | |
|---|---|---|---|---|---|---|---|---|
| Sample | Burst PSI | Burst kPa | kPa.m$^2$/g | Taber left | Taber Right | Taber Average | TSU | (mN m) |
| 1 | 14.91 | 102.81 | 1.64 | 6.66 | 4.84 | 5.75 | 0.58 | 56387.95 |
| 2 | 21.33 | 147.07 | 2.34 | 6.04 | 4.74 | 5.39 | 0.54 | 52857.57 |
| 3 | 27.49 | 189.52 | 3.00 | 6.24 | 5.14 | 5.69 | 0.57 | 55799.55 |
| 4 | 22.58 | 155.68 | 2.51 | 6.38 | 5.02 | 5.7 | 0.57 | 55897.62 |
| 5 | 19.94 | 137.49 | 2.23 | 6.98 | 4.1 | 5.54 | 0.55 | 54328.56 |
| 6 | 20.94 | 144.36 | 2.35 | 6.86 | 4.52 | 5.69 | 0.57 | 55799.55 |
| 7 | 18.57 | 128.01 | 2.06 | 6.72 | 4.14 | 5.43 | 0.54 | 53249.84 |
| 8 | 21.43 | 147.78 | 2.45 | 6.18 | 4.06 | 5.12 | 0.51 | 50209.79 |
| 9 | 12.00 | 82.76 | 1.25 | 7.34 | 4.3 | 5.82 | 0.58 | 57074.41 |
| 10 | 17.71 | 122.09 | 1.92 | 6.44 | 4.12 | 5.28 | 0.53 | 51778.85 |
| 11 | 26.95 | 185.81 | 2.95 | 6.32 | 4.18 | 5.25 | 0.53 | 51484.65 |
| 12 | 15.29 | 105.41 | 1.69 | 5.98 | 4.48 | 5.23 | 0.52 | 51288.52 |
| 13 | 21.34 | 147.10 | 2.49 | 4.18 | 2.94 | 3.56 | 0.36 | 34911.50 |
| 14 | 20.71 | 142.80 | 2.23 | 6.32 | 3.62 | 4.97 | 0.50 | 48738.80 |
| 15 | 19.84 | 136.79 | 2.29 | 6.56 | 3.42 | 4.99 | 0.50 | 48934.93 |
| 16 | 18.33 | 126.40 | 2.08 | 7.28 | 3.84 | 5.56 | 0.56 | 54524.70 |
| 17 | 20.12 | 138.72 | 2.20 | 6.94 | 2.82 | 4.88 | 0.49 | 47856.21 |

Table 12 shows grammage, basis weight, caliper and density measurements for each of the second 17 samples (where the OCC exhibited lower freeness).

TABLE 12

| Sample | Grammage g | Basis Wt. (gsm) | Caliper (0.001") | Density g/cm$^3$ |
|---|---|---|---|---|
| 1* | 1.271 | 63.56 | 5.09 | 0.491 |
| 2* | 1.258 | 62.89 | 4.85 | 0.508 |
| 3* | 1.250 | 62.49 | 4.87 | 0.502 |
| 4* | 1.168 | 58.42 | 4.91 | 0.471 |
| 5* | 1.208 | 60.41 | 4.74 | 0.509 |
| 6* | 1.274 | 63.71 | 5.33 | 0.472 |
| 7* | 1.194 | 59.68 | 4.80 | 0.492 |
| 8* | 1.186 | 59.30 | 4.85 | 0.482 |

TABLE 12-continued

| Sample | Grammage g | Basis Wt. (gsm) | Caliper (0.001") | Density g/cm$^3$ |
|---|---|---|---|---|
| 9* | 1.227 | 61.33 | 4.97 | 0.486 |
| 10* | 1.224 | 61.18 | 4.86 | 0.497 |
| 11* | 1.277 | 63.87 | 4.93 | 0.509 |
| 12* | 1.187 | 59.37 | 5.17 | 0.456 |
| 13* | 1.251 | 62.55 | 4.93 | 0.496 |
| 14* | 1.192 | 59.59 | 4.74 | 0.498 |
| 15* | 1.158 | 57.90 | 4.93 | 0.467 |
| 16* | 1.217 | 60.86 | 5.01 | 0.479 |
| 17* | 1.195 | 59.77 | 4.77 | 0.494 |

Tables 13-14 reports various characteristics for the paper formed from the blends of Table 12.

TABLE 13

| Sample | Tear (mN) | Tear Index mN.m$^2$/g | Tensile N | Tensile Strength kN/m | Tensile Index N.m/g | Stretch % | TEA J/m$^2$ | Freeness CSF |
|---|---|---|---|---|---|---|---|---|
| 1* | 817.82 | 12.90 | 55.53 | 3.70 | 58.21 | 2.55 | 64.77 | 470.00 |
| 2* | 736.29 | 11.70 | 57.84 | 3.86 | 61.29 | 2.47 | 67.55 | 410.00 |
| 3* | 608.60 | 9.74 | 64.13 | 4.28 | 68.41 | 2.36 | 65.82 | 415.00 |
| 4* | 605.77 | 10.37 | 49.46 | 3.30 | 56.40 | 2.26 | 50.78 | 420.00 |
| 5* | 665.39 | 11.02 | 53.35 | 3.56 | 58.90 | 2.68 | 65.32 | 405.00 |
| 6* | 723.69 | 11.36 | 55.56 | 3.70 | 58.12 | 2.23 | 55.42 | 415.00 |
| 7* | 656.10 | 10.99 | 58.60 | 3.91 | 65.47 | 2.19 | 55.92 | 350.00 |
| 8* | 615.99 | 10.39 | 50.79 | 3.39 | 57.10 | 2.24 | 51.04 | 455.00 |
| 9* | 762.76 | 12.44 | 59.96 | 4.00 | 65.19 | 2.47 | 64.94 | 435.00 |
| 10* | 769.87 | 12.58 | 58.64 | 3.91 | 63.91 | 2.53 | 65.79 | 420.00 |
| 11* | 689.59 | 10.80 | 60.09 | 4.01 | 62.70 | 2.12 | 56.41 | 385.00 |
| 12* | 779.40 | 13.12 | 53.83 | 3.59 | 60.48 | 2.47 | 50.05 | 475.00 |
| 13* | 672.09 | 10.75 | 53.70 | 3.58 | 57.24 | 2.41 | 59.00 | 360.00 |
| 14* | 723.49 | 12.15 | 48.30 | 3.22 | 54.03 | 2.42 | 53.19 | 405.00 |
| 15* | 659.51 | 11.40 | 48.70 | 3.25 | 56.07 | 2.13 | 49.58 | 340.00 |
| 16* | 679.42 | 11.17 | 50.68 | 3.38 | 55.51 | 2.32 | 53.26 | 460.00 |
| 17* | 688.50 | 11.52 | 54.63 | 3.64 | 60.94 | 2.21 | 53.98 | 405.00 |

TABLE 14

| | Burst Index | | | | | Taber | Stiffness | |
|---|---|---|---|---|---|---|---|---|
| Sample | Burst PSI | Burst kPa | kPa.m$^2$/g | Taber left | Taber Right | Average | TSU | (mN m) |
| 1* | 36.26 | 249.99 | 3.93 | 4.68 | 3.46 | 4.07 | 0.41 | 39912.9 |
| 2* | 39.63 | 273.25 | 4.35 | 6.56 | 2.76 | 4.66 | 0.47 | 45698.8 |
| 3* | 33.32 | 229.76 | 3.68 | 5.32 | 2.48 | 3.90 | 0.39 | 38245.7 |
| 4* | 30.39 | 209.54 | 3.58 | 3.32 | 4.16 | 3.74 | 0.37 | 36676.7 |
| 5* | 34.12 | 235.28 | 3.89 | 3.08 | 3.64 | 3.36 | 0.34 | 32950.2 |
| 6* | 33.86 | 233.43 | 3.66 | 5.90 | 4.08 | 4.99 | 0.50 | 48934.9 |
| 7* | 39.43 | 271.86 | 4.56 | 4.64 | 4.86 | 4.75 | 0.48 | 46581.4 |
| 8* | 30.91 | 213.10 | 3.59 | 4.68 | 4.16 | 4.42 | 0.44 | 43345.2 |
| 9* | 38.00 | 261.99 | 4.27 | 6.96 | 4.04 | 5.50 | 0.55 | 53936.3 |
| 10* | 38.70 | 266.82 | 4.36 | 6.48 | 3.76 | 5.12 | 0.51 | 50209.8 |
| 11* | 36.93 | 254.60 | 3.99 | 6.04 | 2.44 | 4.24 | 0.42 | 41580.0 |
| 12* | 34.49 | 237.79 | 4.01 | 6.44 | 2.98 | 4.71 | 0.47 | 46189.1 |
| 13* | 36.24 | 249.84 | 4.00 | 6.26 | 2.82 | 4.54 | 0.45 | 44522.0 |
| 14* | 29.91 | 206.19 | 3.46 | 5.62 | 1.78 | 3.70 | 0.37 | 36284.4 |
| 15* | 29.86 | 205.85 | 3.55 | 3.74 | 3.26 | 3.50 | 0.35 | 34323.1 |
| 16* | 32.09 | 221.27 | 3.64 | 6.10 | 3.36 | 4.73 | 0.47 | 46385.2 |
| 17* | 33.11 | 228.28 | 3.82 | 5.12 | 3.86 | 4.49 | 0.45 | 44031.6 |

Even after refining the OCC down to a more typical value of 435 mL CSF freeness, several of the samples show similar strength characteristics as compared to the OCC control, showing that non-wood agricultural fibers can be incorporated into the paper product, while generally maintaining desired mechanical and physical properties. As noted herein, where care is taken in the chemical pulping and other processes used to prepare the agricultural fiber pulp material, to ensure that fiber length and strength of such fibers are maintained, further improvements and better yields can be achieved. For example, it can be important to limit the use of high temperatures, high pressures, and the use of certain chemicals (e.g., ozone, acids, peroxides, etc.), to maintain or increase strength, while at the same time minimizing generation of hazardous waste streams for which disposal accommodations must be made.

Trial 2.

For trial 2, the fiber preparation process was further developed, including shredding, hammermilling, and screening. In addition, the cooking temperature was reduced to 150° C., compared to trial 1 (where it was 160° C. for the corn stover and 170° C. for the hemp). As noted herein. Applicant has found that even lower temperatures (less than 100° C.) are even better suited to producing desired results.

Material Preparation
- Hammermill
- 2.5×50 mm slotted screen

Digester Cook 1:
- Process Run ID: CS-1150° C. 30 minutes
- 10 g/L NaOH—1200 g 50% NaOH solution+58.8 L RO water
- 3500 g corn stover (94.6% csy=3312.4 g od)
- Liquor heating to 150° C.—14 minutes
- Ramping time for material to reach 150° C.—5 minutes
- Cooking time—30 minutes. Black liquor samples taken every 5 minutes during run, 6 Samples in total
- Maximum temperature during cook—150.9° C.
- Average temperature during cook—150.3° C.
- Cooling time at end of run—18 minutes to 60° C.
- Steam wash—5 minutes
- Final Material Weight—8239.1 g @ 22.0% csy=1812.60 g OD 54.7% Yield Digester Cook 2:
- Process Run ID: WS-1150° C. 30 minutes
- 10 g/L NaOH—1200 g 50% NaOH solution+58.8 L RO water
- 3500 g wheat straw (95.2% csy=3332.0 g od)
- Liquor heating to 150° C.—10 minutes
- Ramping time for material to reach 150° C.—4 minutes
- Cooking time—30 minutes. Black liquor samples taken every 5 minutes during run, 6 samples in total
- Maximum temperature during cook—151.0° C.
- Average temperature during cook—150.6° C.
- Cooling time at end of run—20 minutes to 60° C.
- Steam wash—5 minutes
- Final Material Weight—7198.2 g @ 22.6% csy=1628.23 g OD
- 48.9% Yield Digester Cook 3:
- Process Run CS-2 150° C. 30 minutes
- 8 g/L NaOH—960 g 50% NaOH solution+59.04 L RO water
- 3500 g corn stover (94.64% csy=3312.4 g od)
- Liquor heating to 150° C.—12 minutes
- Ramping time for material to reach 150° C.—4 minutes
- Cooking time—30 minutes. Black liquor samples taken every 5 minutes during run, 6 samples in total
- Maximum temperature during cook—151.1° C.
- Average temperature during cook—150.7° C.
- Cooling time at end of run—16 minutes to 60° C.
- Steam wash—5 minutes
- Final Material Weight—8635.8 g @ 27.7% csy=2392.13 g OD 72.2% Yield Digester Cook 4:
- Process Run ID: WS-2 150° C. 30 minutes
- 8 g/L NaOH—960 g 50% NaOH solution+59.04 L RO water
- 3500 g wheat straw (95.2% csy=3332.0 g od)
- Liquor heating to 150° C.—10 minutes
- Ramping time for material to reach 150° C.-4 minutes
- Cooking time—30 minutes. Black liquor samples taken every 5 minutes during run, 6 samples in total
- Maximum temperature during cook—150.6° C.
- Average temperature during cook—150.4° C.
- Cooling time at end of run—18 minutes to 60° C.
- Steam wash—5 minutes
- Final Material Weight—8515.5 g @ 24.4% csy=2075.02 g OD 62.3% Yield Digester Cook 5:
- Process Run ID: CS-3 150° C. 30 minutes
- 9 g/L NaOH—1080 g 50% NaOH solution+58.92 L RO water
- 3500 g corn stover (94.64% csy=3312.4 g od)
- Liquor heating to 150° C.—12 minutes
- Ramping time for material to reach 150° C.—4 minutes
- Cooking time—30 minutes. Black liquor samples taken every 5 minutes during run, 6 samples in total
- Maximum temperature during cook—150.6° C.
- Average temperature during cook—150.4° C.
- Cooling time at end of run—18 minutes to 60° C.
- Steam wash—5 minutes
- Final Material Weight—7499.0 g @ 22.8% csy=1712.77 g OD 51.7% Yield Digester Cook 6:
- Process Run ID: WS-3 150° C. 30 minutes
- 9 g/L NaOH—1080 g 50% NaOH solution+58.92 L RO water
- 3500 g wheat straw (95.2% csy=3332.0 g od)
- Liquor heating to 150° C.—10 minutes
- Ramping time for material to reach 150° C.—4 minutes
- Cooking time—30 minutes. Black liquor samples taken every 5 minutes during run, 6 samples in total
- Maximum temperature during cook—150.7° C.
- Average temperature during cook—150.5° C.
- Cooling time at end of run—18 minutes to 60° C.
- Steam wash—5 minutes
- Final Material Weight—7802.4 g @ 22.1% csy=1722.77 g OD 51.7% Yield Table 15 shows data for hammer milling and screening of wheat straw.

TABLE 15

| Hammermill Processing of Wheat Straw | | |
|---|---|---|
| Screen type<br>Screen size | Slotted screen<br>2.5 mm/50 mm | |
| Mass<br>material- | Before Hammer Milling | After Hammer Milling |
| | 14.1 kg | 13.4 kg |
| Rotary Drum Screen Size<br>Run time for each batch | 1/32 inch<br>2 minutes | |

TABLE 15-continued

| Hammermill Processing of Wheat Straw | | |
|---|---|---|
| Wheat Straw | Batch weight | Dust Collected |
| Batch 1 | 2 kg | 0.130 kg |
| Batch 2 | 2 kg | 0.105 kg |
| Batch 3 | 2 kg | 0.101 kg |
| Batch 4 | 2 kg | 0.104 kg |
| Batch 5 | 2 kg | 0.114 kg |
| Batch 6 | 2 kg | 0.111 kg |
| Batch 7 | 2.1 kg | 0.135 kg |
| Initial weight before screening | Final weight after screening | Total dust Collected |
| 14.1 kg | 13.2 kg | 0.800 kg |

Table 16 shows data for hammer milling and screening of corn stover.

TABLE 16

| Hammermill Processing of Corn Stover | | |
|---|---|---|
| Screen type | Slotted screen | |
| Screen size | 2.5 mm/50 mm | |
| Mass material - | Before Hammer Milling | After Hammer Milling |
| | 14.6 kg | 11.9 kg |
| Rotary Drum Screen Size | 1/32 inch | |
| Run time for each batch | 2 minutes | |
| Corn Stover | Weight for each batch | Dust Collected |
| Batch 1 | 2 kg | 0.225 kg |
| Batch 2 | 2 kg | 0.195 kg |
| Batch 3 | 2 kg | 0.190 kg |
| Batch 4 | 2 kg | 0.167 kg |
| Batch 5 | 2 kg | 0.195 kg |
| Batch 6 | 1.9 kg | 0.212 kg |
| Initial weight before screening | Final weight after screening | Total dust Collected |
| 11.9 kg | 10.6 kg | 1.184 kg |

Table 17 shows corn stover soda pulp handsheet data for different samples, (e.g., how many g/L of NaOH used in pulping, how many revolutions milled in the PFI mill).

TABLE 17

| Sample Number | Corn Stover 10 g/L unmilled | Corn Stover 8 g/L unmilled | Corn Stover 8 g/L 250 rev | Corn Stover 9 g/L unmilled |
|---|---|---|---|---|
| Freeness, ml | 330 | 376 | 208 | 330 |
| Moisture, % | 9.25 | 9.14 | 10.06 | 9.25 |
| Oven dry Grammage, g/m$^2$ | 59.7 | 62.0 | 61.3 | 59.7 |
| Bulk, cm$^3$/g | 1.82 | 2.44 | 2.30 | 1.82 |
| Tear Index, mN*m$^2$/g | 7.15 | 5.28 | 7.41 | 7.15 |
| Breaking length, km | 4.52 | 2.96 | 3.99 | 4.52 |
| Tensile Index, N m/g | 44.3 | 29.1 | 39.1 | 44.3 |
| Stretch, % | 2.09 | 2.19 | 2.70 | 2.09 |
| Burst Index, kPa*m$^2$/g | 2.08 | 1.19 | 1.68 | 2.08 |
| Energy@break (J/m$^2$) | 31.0 | 15.3 | 24.7 | 31.0 |
| Final Strain (%) | 2.10 | 2.21 | 2.47 | 2.10 |

All handsheets were formed according to TAPPI T205 sp-18 *Forming Handsheets for Physical Tests of Pulp* and tested according to TAPPI T200 sp-16 *Physical Testing of Pulp Handsheets*. Any pulps with Freeness values below 200 mL CSF were not formed into handsheets.

Tables 18A-18B show wheat straw soda pulp handsheet data for various samples.

TABLE 18A

| Sample Number | Wheat straw 9 g/L unmilled | Wheat straw 9 g/L 250 rev | Wheat straw 9 g/L 500 rev | Wheat Straw 9 g/L 1000 rev | Wheat straw 10 g/L unmilled |
|---|---|---|---|---|---|
| Freeness, ml | 522 | 313 | 280 | 220 | 612 |
| Moisture, % | 9.82 | 9.17 | 9.50 | 9.74 | 9.85 |
| Oven dry Grammage, g/m$^2$ | 59.0 | 63.4 | 63.5 | 68.5 | 60.3 |
| Bulk, cm$^3$/g | 1.82 | 1.64 | 1.60 | 1.52 | 1.80 |
| Tear Index, mN*m$^2$/g | 8.20 | 8.67 | 8.35 | 8.67 | 7.08 |
| Breaking length, km | 4.85 | 6.88 | 7.66 | 9.13 | 4.03 |
| Tensile Index, N m/g | 47.6 | 67.5 | 75.1 | 89.5 | 39.5 |
| Stretch, % | 2.42 | 2.56 | 3.09 | 4.85 | 2.45 |
| Burst Index, kPa*m$^2$/g | 1.91 | 3.77 | 4.20 | 4.86 | 1.70 |
| Energy@break (J/m$^2$) | 22.2 | 71.3 | 78.3 | 168.2 | 20.4 |
| Final Strain (%) | 2.45 | 2.58 | 3.11 | 4.89 | 2.47 |

TABLE 18B

| Sample Number | Wheat Straw 10 g/L 250 rev | Wheat Straw 10 g/L 500 rev | Wheat Straw 8 g/L unmilled | Wheat Straw 8 g/L 250 rev |
|---|---|---|---|---|
| Freeness, ml | 293 | 254 | 532 | 207 |
| Moisture, % | 9.46 | 9.25 | 9.48 | 10.11 |
| Oven dry Grammage, g/m$^2$ | 61.4 | 64.4 | 61.0 | 63.7 |
| Bulk, cm$^3$/g | 1.66 | 1.59 | 1.95 | 1.73 |
| Tear Index, mN*m$^2$/g | 8.57 | 7.87 | 5.82 | 7.20 |
| Breaking length, km | 7.16 | 7.67 | 2.83 | 4.73 |
| Tensile Index, N m/g | 70.2 | 75.2 | 27.8 | 46.3 |
| Stretch, % | 3.04 | 3.07 | 1.32 | 1.72 |
| Burst Index, kPa*m$^2$/g | 4.03 | 4.42 | 0.90 | 2.11 |
| Energy@break (J/m$^2$) | 73.9 | 93.8 | 9.2 | 29.2 |
| Final Strain (%) | 3.05 | 3.07 | 1.33 | 1.72 |

All handsheets were formed according to TAPPI T205 sp-18 *Forming Handsheets for Physical Tests of Pulp* and tested according to TAPPI T200 sp-16 *Physical Testing of Pulp Handsheets*. Any pulps with Freeness values below 200 mL were not formed into handsheets.

Table 19A shows compositional characteristics of blends 1-7 and blend X that were prepared, while Table 19B shows pulp blends handsheet data for blends 1-7.

TABLE 19A

| Blend # | OCC | Hemp | Corn | Wheat |
|---|---|---|---|---|
| 1 | 40 | 0 | 60 | 0 |
| 2 | 40 | 10 | 50 | 0 |
| 3 | 45 | 5 | 50 | 0 |
| 4 | 90 | 10 | 0 | 0 |
| 5 | 100 | 0 | 0 | 0 |
| 6 | 40 | 0 | 40 | 20 |
| 7 | 40 | 10 | 30 | 20 |
| X | 0 | 0 | 100 | 0 |

TABLE 19B

| Sample Number | Blend 1 | Blend 2 | Blend 3 | Blend 4 | Blend 5 | Blend 6 | Blend 7 |
|---|---|---|---|---|---|---|---|
| Freeness, ml | 403 | 407 | 393 | 490 | 437 | 353 | 400 |
| Moisture, % | 9.41 | 9.60 | 9.48 | 8.93 | 8.84 | 9.41 | 9.07 |
| Oven dry Grammage, g/m$^2$ | 64.6 | 66.5 | 61.4 | 61.7 | 61.1 | 58.7 | 61.3 |
| Bulk, cm$^3$/g | 1.88 | 1.98 | 1.94 | 1.95 | 1.86 | 1.82 | 1.98 |
| Tear Index, mN*m$^2$/g | 9.99 | 8.85 | 8.80 | 13.12 | 13.15 | 9.64 | 10.52 |
| Breaking length, km | 4.33 | 4.30 | 4.32 | 4.00 | 4.34 | 5.06 | 4.62 |
| Tensile Index, N m/g | 42.5 | 42.2 | 42.3 | 39.2 | 42.5 | 49.7 | 45.3 |
| Stretch, % | 2.68 | 2.84 | 3.13 | 3.21 | 3.83 | 3.04 | 2.90 |
| Burst Index, kPa*m$^2$/g | 2.08 | 2.08 | 2.08 | 2.12 | 2.44 | 2.44 | 2.38 |
| Energy @ break (J/m$^2$) | 37.8 | 36.7 | 35.0 | 35.8 | 50.1 | 38.7 | 36.5 |
| Final Strain (%) | 2.70 | 2.87 | 3.16 | 3.24 | 3.87 | 3.04 | 2.90 |

All handsheets were formed according to TAPPI T205 sp-18 *Forming Handsheets for Physical Tests of Pulp* and tested according to TAPPI T200 sp-16 *Physical Testing of Pulp Handsheets*. Any pulps with Freeness values below 200 mL were not formed into handsheets.

Table 20 shows OCC and hemp handsheet data, where the freeness target was 400 mL CSF after the Valley Beater (another type of refiner).

TABLE 20

| Sample Number | OCC @ 437 mL CSF Freeness | Hemp Freeness @ 453 mL CSF |
|---|---|---|
| Freeness, ml | 437 | 453 |
| Moisture, % | 8.84 | 8.39 |
| Oven dry Grammage, g/m$^2$ | 61.1 | 59.6 |
| Bulk, cm$^3$/g | 1.86 | 2.92 |
| Tear Index, mN*m$^2$/g | 13.15 | 25.16 |
| Breaking length, km | 4.34 | 2.77 |
| Tensile Index, N m/g | 42.5 | 27.1 |
| Stretch, % | 3.83 | 2.97 |
| Burst Index, kPa*m$^2$/g | 2.44 | 2.66 |
| Energy@break (J/m$^2$) | 50.1 | 22.1 |
| Final Strain (%) | 3.87 | 3.00 |

Note:
OCC @ 437 mL CSF freeness is also the sample used for Blend 5.

Table 21 shows CSF and Kappa number for corn stover soda pulp.

TABLE 21

| Sample ID | CSF Freeness (mL, corrected) | Consistency (%) | Temp (° C.) | Kappa Number |
|---|---|---|---|---|
| Corn stover 8 g/L unmilled | 376 | 0.30 | 22 | 29.6 |
| Corn Stover 8 g/L 250 rev | 208 | 0.31 | 19 | |
| Corn Stover 8 g/L 500 rev | 115 | 0.30 | 20 | |
| Corn Stover 9 g/L unmilled | 387 | 0.32 | 22 | 13.5 |
| Corn Stover 9 g/L 250 rev | 137 | 0.30 | 21 | |
| Corn Stover 10 g/L unmilled | 330 | 0.28 | 22 | 14.6 |
| Corn Stover 10 g/L 250 rev | 162 | 0.28 | 18 | |

All Freeness testing was done according to TAPPI T227 om-17 *Freeness of Pulp* (*Canadian Standard Method*). All Kappa numbers were done according to TAPPI T236 om-13 Kappa Number of Pulp.

Table 22 shows CSF and Kappa number for wheat straw soda pulp.

TABLE 22

| Sample ID | CSF Freeness (mL, corrected) | Consistency (%) | Temp (° C.) | Kappa Number |
|---|---|---|---|---|
| Wheat straw 8 g/L unmilled | 532 | 0.31 | 21 | 27.0 |
| Wheat straw 8 g/L 250 rev | 207 | 0.28 | 21 | |
| Wheat straw 8 g/L 500 rev | 144 | 0.28 | 21 | |
| Wheat straw 9 g/L unmilled | 522 | 0.31 | 20 | 21.6 |
| Wheat straw 9 g/L 250 rev | 313 | 0.28 | 21 | |

TABLE 22-continued

| Sample ID | CSF Freeness (mL, corrected) | Consistency (%) | Temp (° C.) | Kappa Number |
|---|---|---|---|---|
| Wheat Straw 9 g/L 500 rev | 280 | 0.28 | 21 | |
| Wheat Straw 9 g/L 1000 rev | 220 | 0.30 | 21 | |
| Wheat Straw 9 g/L 3000 rev | 110 | 0.28 | 20 | |
| Wheat straw 10 g/L unmilled | 612 | 0.30 | 20 | 17.7 |
| Wheat straw 10 g/L 250 rev | 293 | 0.30 | 21 | |
| Wheat straw 10 g/L 500 rev | 254 | 0.28 | 21 | |
| Wheat Straw 10 g/L 1000 rev | 194 | 0.29 | 21 | |

All Freeness testing was done according to TAPPI T227 om-17 *Freeness of Pulp* (*Canadian Standard Method*). All Kappa numbers were done according to TAPPI T236 om-13 Kappa Number of Pulp.

Table 23 shows UV visible spectrophotometer measurements for corn stover digester process liquor.

TABLE 23

| Corn Stover | | | |
|---|---|---|---|
| | | Absorbance | |
| Sample ID | Dilution Factor | Wavelength - 205 nm | Wavelength - 280 nm |
| 10 g NaOH/Liter | | | |
| CS -1 (5 minute) | 350 | 1.74 | 0.506 |
| CS-1 (10 minute) | 450 | 1.53 | 0.474 |
| CS-1 (15 minute) | 550 | 1.41 | 0.445 |
| CS-1 (20 minute) | 700 | 1.03 | 0.330 |
| CS-1 (25 minute) | 750 | 1.04 | 0.322 |
| CS-1 (30 minute) | 800 | 0.97 | 0.310 |
| 9 g NaOH/Liter | | | |
| CS -3 (5 minute) | 160 | 1.46 | 0.346 |
| CS-3 (10 minute) | 220 | 1.50 | 0.403 |
| CS-3 (15 minute) | 250 | 1.65 | 0.471 |
| CS-3 (20 minute) | 300 | 1.51 | 0.444 |
| CS-3 (25 minute) | 400 | 1.30 | 0.393 |
| CS-3 (30 minute) | 500 | 1.07 | 0.328 |
| 8 g NaOH/Liter | | | |
| CS-2 (5 minute) | 50 | 1.34 | 0.041 |
| CS-2 (10 minute) | 55 | 1.62 | 0.166 |
| CS-2 (15 minute) | 65 | 1.67 | 0.331 |
| CS-2 (20 minute) | 77 | 2.58 | 0.640 |
| CS-2 (25 minute) | 160 | 1.87 | 0.511 |
| CS-2 (30 minute) | 190 | 1.74 | 0.497 |

Table 24 shows UV visible spectrophotometer measurements for wheat straw digester process liquor.

TABLE 24

| Wheat Straw | | | |
|---|---|---|---|
| | | Absorbance | |
| Sample ID | Dilution Factor | Wavelength - 205 nm | Wavelength - 280 nm |
| 10 g NaOH/Liter | | | |
| WS -1 (5 minute) | 100 | 1.29 | 0.023 |
| WS -1 (10 minute) | 200 | 0.48 | 0.057 |
| WS -1 (15 minute) | 200 | 0.82 | 0.168 |
| WS -1 (20 minute) | 200 | 1.03 | 0.241 |

TABLE 24-continued

| Wheat Straw | | | |
|---|---|---|---|
| | | Absorbance | |
| Sample ID | Dilution Factor | Wavelength - 205 nm | Wavelength - 280 nm |
| WS -1 (25 minute) | 200 | 1.27 | 0.313 |
| WS -1 (30 minute) | 200 | 1.49 | 0.385 |
| 9 g NaOH/Liter | | | |
| WS -3 (5 minute) | 200 | 1.53 | 0.373 |
| WS -3 (10 minute) | 300 | 1.36 | 0.352 |
| WS -3 (15 minute) | 350 | 1.49 | 0.388 |
| WS -3 (20 minute) | 400 | 1.42 | 0.370 |
| WS -3 (25 minute) | 450 | 1.42 | 0.370 |
| WS -3 (30 minute) | 500 | 1.43 | 0.366 |
| 8 g NaOH/Liter | | | |
| WS -2 (5 minute) | 100 | 0.82 | 0.009 |
| WS -2 (10 minute) | 200 | 0.60 | 0.060 |
| WS -2 (15 minute) | 200 | 0.81 | 0.153 |
| WS -2 (20 minute) | 200 | 1.06 | 0.233 |
| WS -2 (25 minute) | 200 | 1.26 | 0.300 |
| WS -2 (30 minute) | 200 | 1.60 | 0.395 |

Figure 18:
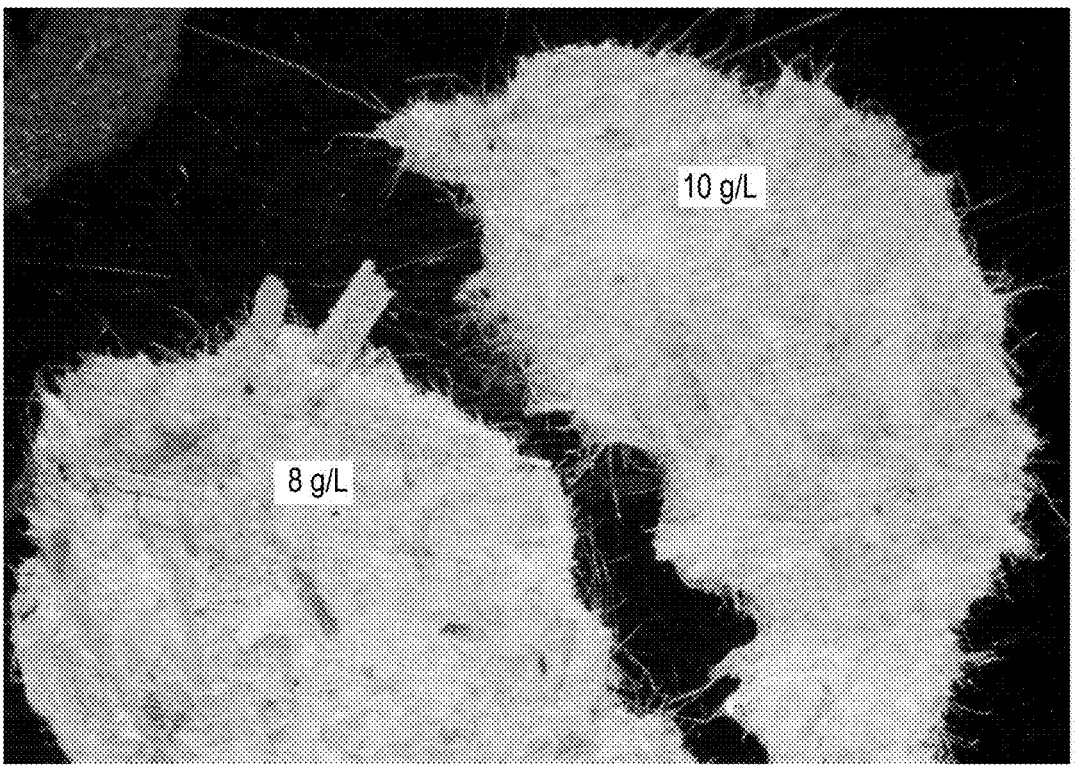
FIG. 18 show photographs of non-wood agricultural feestock pulps as prepared in Trial 2, with 8 g/L, and 10 g/L of NaOH
Figure 19:
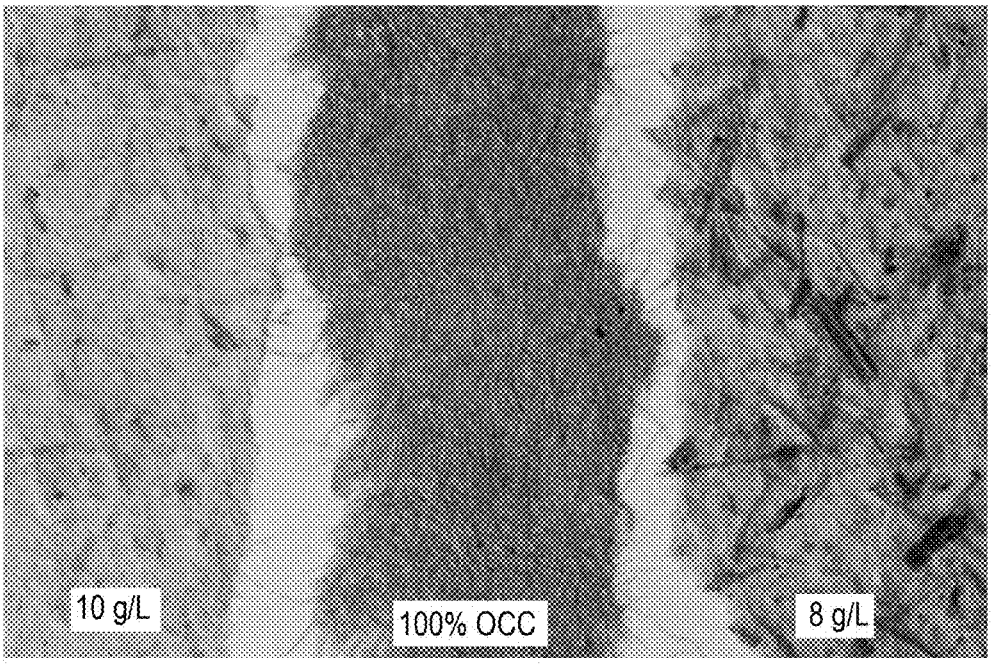
FIG. 19 shows photographs of these same exemplary pulps of FIG. 18, as compared to 100% OCC, as described in the Examples section of the present application.

FIGS. 18-19 show photographs of paper formed from pulp processed at 8 g/L, and 10 g/L of NaOH, as described herein. In FIG. 18, the 8 g/L paper is shown at left, while the 10 g/L is shown at right. In FIG. 19, the 10 g/L is shown at left, the 8 g/L at right, with the center paper being 100% OCC, for comparison.

Trial 3.

The handsheets evaluated above during trial 2 were made to a weight of about 60 gsm. During trial 2, handsheets at a higher weight, of about 127 gsm were also made, and were sent for further paper testing. Table 25A shows test results for blends 1, 2, and 5, while Table 25B shows results for blends 3, 4, and X, for samples at 127 gsm.

TABLE 25A

| Analysis | Units | Blend 1 | Blend 2 | Blend 5 |
|---|---|---|---|---|
| Basis weight, (conditioned) | $g/m^2$ | 147.95 | 150.26 | 140.20 |
| Bulk | cc/g | 1.66 | 1.79 | 1.63 |
| Burst index | $kPa \cdot m^2/g$ | 2.16 | 2.31 | 2.43 |
| Tear index (1-ply) | $mN \cdot m^2/g$ | 7.75 | 9.98 | 9.66 |
| Tensile index | $N \cdot m/g$ | 34.7 | 35.3 | 35.1 |
| Tensile | km | 3.54 | 3.59 | 3.57 |
| Stretch | % | 2.67 | 2.26 | 3.06 |
| Tensile Energy Absorption | $J/m^2$ | 101 | 86.7 | 106 |
| Ring Crush | kN/m | 1.41 | 1.62 | 1.27 |
| Fold | count | 89 | 124 | 122 |
| Stiffness, Taber | $g \cdot cm$ | 7.46 | 8.93 | 7.67 |
| Short Span Compression, STFI | kN/m | 2.88 | 3.06 | 2.50 |
| Absorption, water drop | seconds | 8.0 | 10.0 | 63.6 |

TABLE 25B

| Analysis | Units | Blend 3 | Blend 4 | Blend X |
|---|---|---|---|---|
| Basis weight, (conditioned) | $g/m^2$ | 145.90 | 146.87 | 147.33 |
| Bulk | cc/g | 1.59 | 1.63 | 1.66 |
| Burst index | $kPa \cdot m^2/g$ | 2.41 | 2.27 | 2.33 |
| Tear index (1-ply) | $mN \cdot m^2/g$ | 6.05 | 8.30 | 9.89 |
| Tensile index | $N \cdot m/g$ | 41.0 | 40.4 | 39.7 |
| Tensile Stiffness | kN/m | 666 | 750 | 703 |
| Tensile | km | 4.17 | 4.12 | 4.05 |
| Stretch | % | 2.10 | 1.77 | 2.09 |
| Tensile Energy Absorption | $J/m^2$ | 89.3 | 74.4 | 86.4 |
| Ring Crush | kN/m | 1.54 | 1.48 | 1.52 |
| Fold | count | 165 | 126 | 228 |

TABLE 25B-continued

| Analysis | Units | Blend 3 | Blend 4 | Blend X |
|---|---|---|---|---|
| Stiffness, Taber | $g \cdot cm$ | 8.00 | 14.7 | 19.7 |
| Short Span Compression, STFI | kN/m | 3.68 | 3.21 | 2.75 |

Trial 4.

While the previously described trials were on lab scale equipment, trial 4 was on commercial scale equipment. 2 tons of corn stover, 2 tons of OCC, and about 450 pounds of hemp were processed as described herein. Cooking/pulp digesting was performed at 150° C. for 30 minutes, similar to trial 2. The results of trial 4 show a 50/50 blend of non-wood agricultural fiber with OCC outperforms 100% OCC in many respects, although yield was relatively low. The more gentle cooking procedure described herein (e.g., temperature of less than 100° C., for a longer period of time) will help to improve yield, and may also better preserve fiber length, so as to increase strength properties. A portion of the pulp from trial 4 was used to make handsheets, for testing. Another portion of the pulp from trial 4 was used in trial 5, for papermaking on a papermaking machine. The results for the handsheets of trial 4 are shown in Tables 26A-26C, below. The comparison provided between samples C1 and P8 is exemplary.

TABLE 26A

| Sample | Comments | Freeness (mL) | Shives (%) 0.15 mm | LWAFL (mm) |
|---|---|---|---|---|
| OCC 1 | Foundry | 432 | 0.18 | 1.126 |
| OCC 2 | Floor | 500 | 0.02 | 1.338 |
| P1-3 | OCC | 420 | 0.00 | |
| R1 | Digester Discharge | 271 | 0.06 | 0.807 |
| T7 | Coarse Screen Accepts | 170 | 0.00 | 0.813 |
| G2A | Micra Sieve Long Fiber | 429 | 2.52 | 0.928 |
| P5 | TWP discharge | 360 | 1.40 | 0.879 |
| P6 | TWP discharge | 332 | 1.50 | 0.861 |
| P7 | TWP discharge | 324 | 1.34 | 1.135 |
| C1 | 50/50 Composite | 365 | 1.42 | 1.119 |
| P8 | Final OCC | 434 | 0.34 | 1.539 |

TABLE 26B

| Sample | Bulk ($cm^3/g$) | Burst Index ($kPa \cdot m^2/g$) | Tear Index ($mNm^2/g$) | Tensile Index (Nm/g) | Stretch (%) | TEA ($J/m^2$) |
|---|---|---|---|---|---|---|
| OCC 1 | 1.80 | 1.69 | 8.3 | 31.3 | 2.28 | 31.84 |
| OCC 2 | 1.74 | 2.22 | 10.8 | 40.2 | 2.37 | 38.93 |
| P1-3 | 1.81 | 2.49 | 11.3 | 43.4 | 2.78 | 49.91 |
| R1 | 1.41 | 2.07 | 7.1 | 47.1 | 2.24 | 119.62 |
| T7 | 1.28 | 2.97 | 6.2 | 47.0 | 2.34 | 127.18 |
| G2A | 1.59 | 2.51 | 11.9 | 47.9 | 3.07 | 191.84 |
| P5 | 1.57 | 3.78 | 8.9 | 56.1 | 3.44 | 238.06 |
| P6 | 1.59 | 3.51 | 8.9 | 51.6 | 2.87 | 187.32 |
| P7 | 1.58 | 3.42 | 8.6 | 59.3 | 3.66 | 263.13 |
| C1 | 1.60 | 3.26 | 12.2 | 56.9 | 3.07 | 194.47 |
| P8 | 1.66 | 3.07 | 17.8 | 45.9 | 3.03 | 159.50 |

TABLE 26C

| Sample | CMT Index ($Nm^2/g$) | Ring Crush Index ($Nm^2/g$) | SCT ($Nm^2/g$) |
|---|---|---|---|
| OCC 1 | 0.00 | 0.00 | 16.57 |
| OCC 2 | 0.00 | 0.00 | 18.20 |
| P1-3 | 1.36 | 8.33 | 19.31 |
| R1 | 1.16 | 12.68 | 26.40 |

TABLE 26C-continued

| Sample | CMT Index ($Nm^2/g$) | Ring Crush Index ($Nm^2/g$) | SCT ($Nm^2/g$) |
|---|---|---|---|
| T7 | 1.18 | 12.92 | 27.03 |
| G2A | 1.42 | 0.00 | 23.47 |
| P5 | 1.32 | | 27.87 |
| P6 | 1.42 | | 31.50 |
| P7 | 1.39 | | 29.18 |
| C1 | 1.86 | | 25.05 |
| P8 | 1.22 | | 20.26 |

Trial 5.

Pulps resulting from trial 4 were sent for papermaking trials. A successful production run with a blend of OCC and corn stover fibers was made. A fraction of corn dust (fines) was brought forward from the fiber preparation stage, and added to the pulp, for inclusion in the sheet of paper formed, increasing the yield (see the medium shown in FIG. 22, which included 88% OCC and 12% corn fines). Typical threshold values for what constitutes "fines" will be apparent to those of skill in the art, e.g., based on mesh size. Exemplary mesh sizes that may separate fines from larger particles, including corresponding dimensions for various mesh sizes are shown below, in Table 26D.

TABLE 26D

| Sieve Size (mm) | Opening (μm) | U.S. Standard Mesh Size |
|---|---|---|
| 5.60 | 5600 | 3.5 |
| 4.75 | 4750 | 4 |
| 4.00 | 4000 | 5 |
| 3.35 | 3350 | 6 |
| 2.80 | 2800 | 7 |
| 2.36 | 2360 | 8 |
| 2.00 | 2000 | 10 |
| 1.70 | 1700 | 12 |
| 1.40 | 1400 | 14 |
| 1.18 | 1180 | 16 |
| 1.00 | 1000 | 18 |
| 0.85 | 850 | 20 |
| 0.71 | 710 | 25 |
| 0.60 | 600 | 30 |
| 0.50 | 500 | 35 |
| 0.425 | 425 | 40 |
| 0.355 | 355 | 45 |
| 0.300 | 300 | 50 |
| 0.25 | 250 | 60 |
| 0.212 | 212 | 70 |
| 0.180 | 180 | 80 |
| 0.15 | 150 | 100 |
| 0.125 | 125 | 120 |
| 0.105 | 105 | 140 |
| 0.090 | 90 | 170 |
| 0.075 | 75 | 200 |

The plan for trial 5 was as follows:

7:00 Machine warm up.

9:00 Medium run start with 127 g/m with OCC & Fines (Corn dust).

Chemicals «as is»:

CFennoPol K 2813 (Polyacrylamide, drainage & dewatering aid)—0.35 Kg/Ton

FennoSil 2185 (Colloidal Silica, micro particles, drainage & dewatering aid)—3 Kg/Ton FennoBond 3300 (GPAM, Dry Strength)—20 Kg/Ton 9:20 Stabilize basis weight at 127 $g/m^2$ and 4% moisture for 30 minutes.

9:50 Produce Medium 127 $g/m^2$ for 20 minutes

10:10 Change production to make Liner

Chemicals «as is»:

FennoSize KD 544M (AKD, Sizing)—10 Kg/Ton

10:15 Increase basis weight to 171 $g/m^2$ and stabilize moisture to 8-10%.

10:45 Increase corn flow and decrease total debit to add 25% corn to the recipe

10:50 Increase corn flow and decrease total debit to add 43% corn to the recipe

11:00 Produce Liner 171 $g/m^2$ for 25 minutes

11:30 Add 5% of Hemp pulp to the machine chest.

11:33 Produce Liner (with Hemp) 171 $g/m^2$ until the sheet breaks

11:40 End

Trial 5 proceeded as follows:

At 8:30, the machine warm up was going well.

At 9:00, the machine was in startup and the team was getting ready to start the chemicals.

9:20 the fan pump was started on water and the stock was added soon after.

9:25 Pulp buildup under the Fourdrinier deckle (drive side).

9:29, the drainage was almost too good. The water line did not advance very far on the drainage table.

Trial 5 continued as follows:

9:33, treading the wet sheet to the presses section went well.

9:40, treading the sheet through the dryer was more difficult and took about 10 minutes.

9:33, the sheet broke.

9:45, the sheet was on the drum reel.

Figure 20:
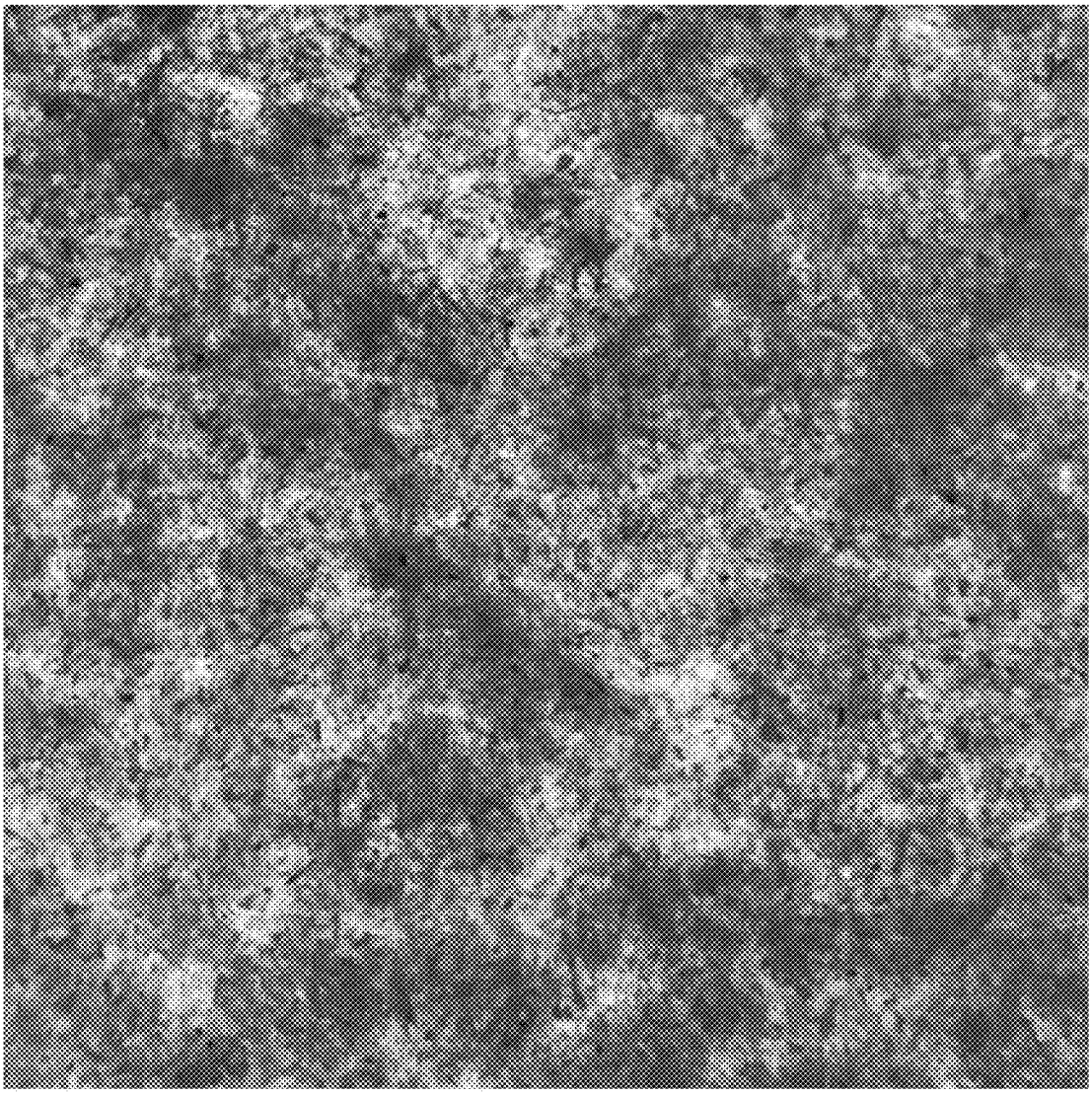
FIG. 20 shows a photograph of paper product produced from Trial 5, as described in the Examples section of the present application.

10:09, working on the sheet formation. The sheet drained really fast, by looking at the position of the water line. Drainage that is too fast (freeness value too high) can cause poor sheet formation. FIG. 20 shows the sheet viewed with a back light illumination. Several adjustments to the foils on the Fourdrinier table were made to slow down the drainage and improve sheet formation. The wet web was weak, with several sheet breaks going to the presses section.

Trial 5 continued as follows.

10:42, medium production began. 900 Kg of OCC remained.

11:00, medium production completed. The basis weight was increased to prepare for the liner run.

11:07, started adding corn pulp. 475 Kg of OCC pulp remaining.

11:10, 25% corn pulp. The water line moved further and the water level increased in the top former vacuum box.

Figure 21:
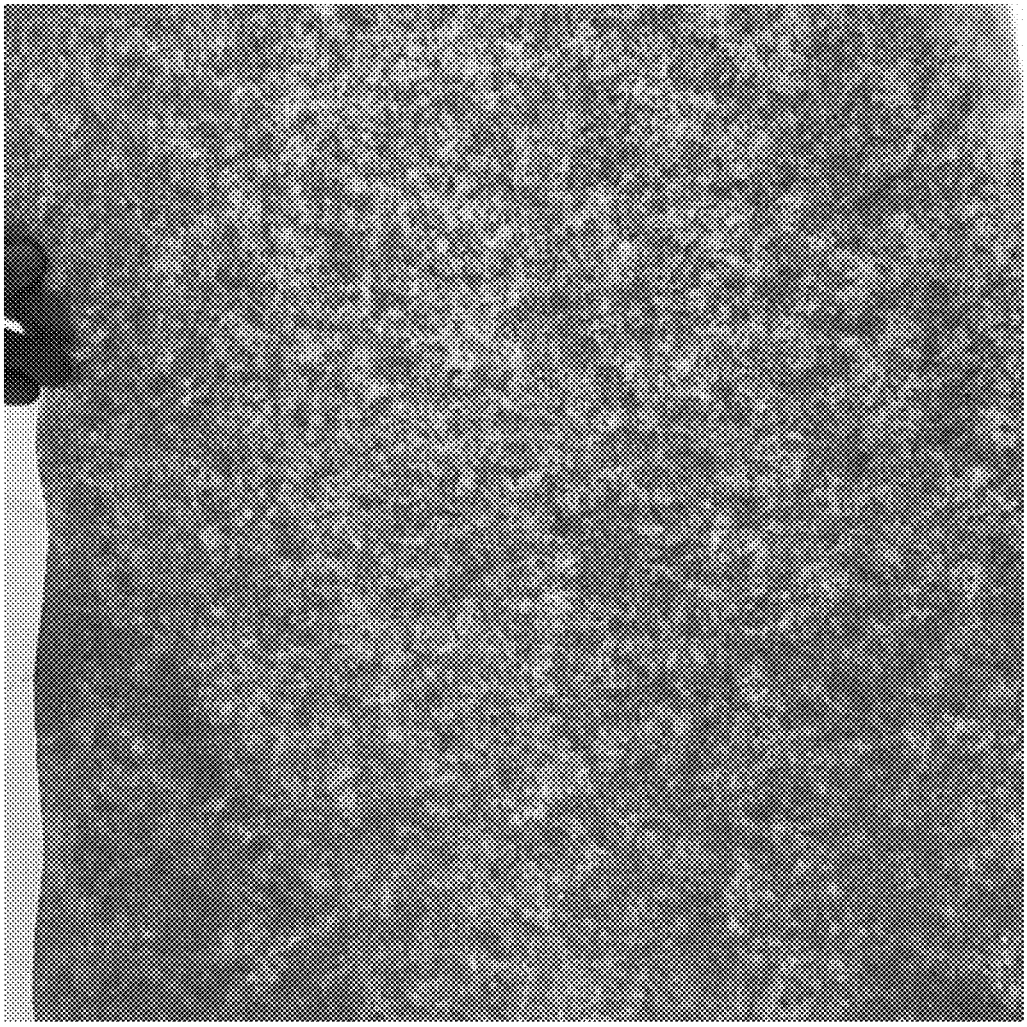
FIG. 21 shows an additional photograph of paper product produced from as described in the Examples section of the present application.
Figure 22:
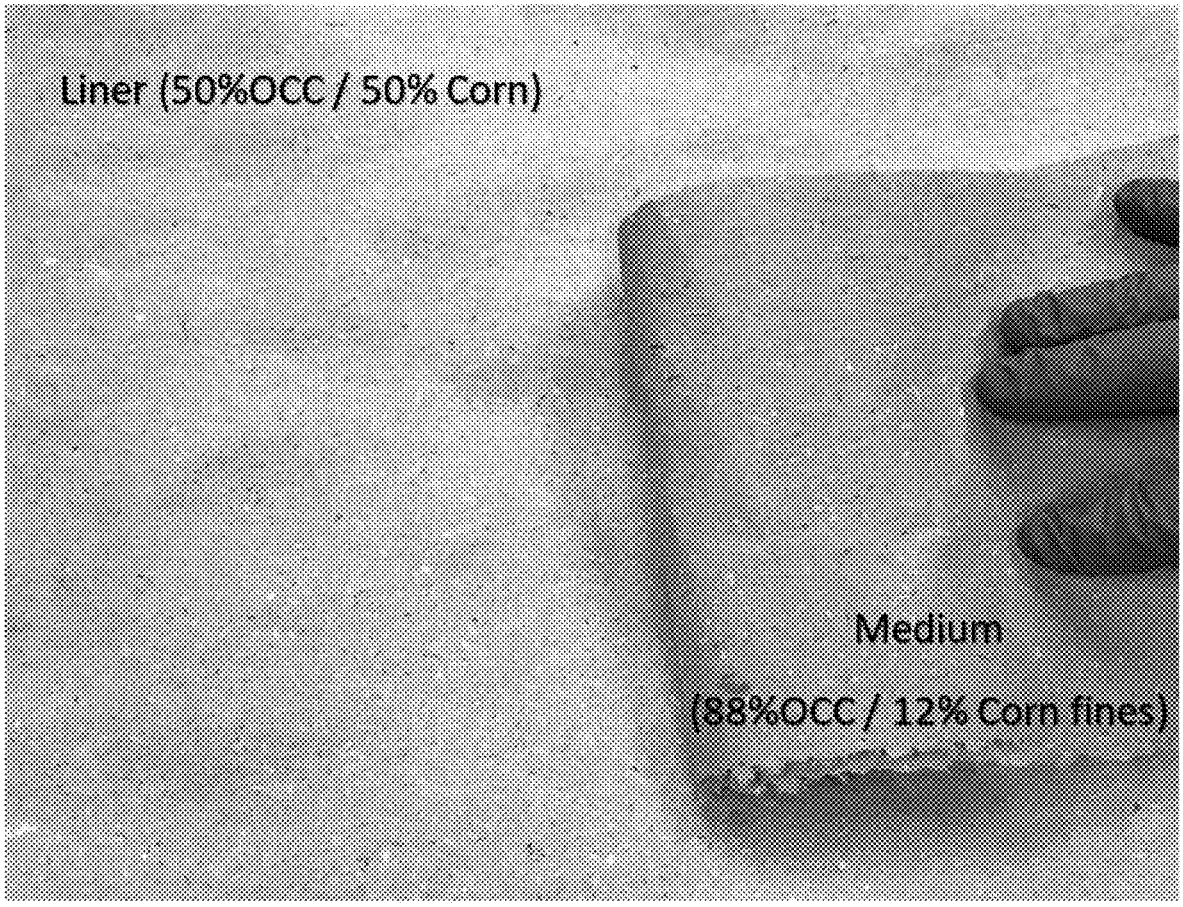
FIG. 22 shows an additional photograph of paper products (both liner and medium) produced from Trial 5, as described in the Examples section of the present application. The illustrated liner was formed from 50% OCC pulp and 50% corn stover pulp, by weight. The illustrated medium was formed from 88% OCC pulp and 12% corn stover fines, by weight.

11:10, the liner recipe is on the machine (50% OCC/50% Corn). The drainage is much slower than before, and the sheet formation is better (FIG. 21). FIG. 22 shows photos of both the produced liner (50% OCC/50% corn fiber) and medium (88% OCC/12% corn fines).

11:15, End of the liner production (without Hemp). The OCC stock flow stopped when the control valve plugged.

Trial 6.

Paper produced in trial 5 was sent for corrugation trials. 16 inch rolls of B-flute single face (including liner and corrugated medium) containerboard were produced. The B-flute single face product exhibited ECT (edge crush test) values of 30-31 lb/in, similar to similar product formed from recycled OCC, even given that this trial was made using a Langston corrugator which uses a pressure roll instead of a belted singlefacer. Use of the pressure roll causes slightly more crushing during lamination which can reduce the ECT of the product. As such, use of a belted singlefacer would likely result in somewhat higher ECT values. In addition, as noted herein, use of lower cooking temperatures, and selection of other process parameters as described herein will also increase strength, and other desired performance characteristics.

Trial 7.

The production of the single face B-flute made in Trial 6 at commercial scale was monitored, and this material was used in a lab environment to produce corrugate structures by gluing the double face to complete the corrugate structure.

While the present disclosure largely focuses on manufacture of liner and medium for construction of corrugated containerboard, it will be appreciated that the present disclosure is applicable to manufacture of a variety of other products, including, but not limited to brown kraft paper, assorted paper towels (e.g., brown paper towel material often used for hand drying in bathrooms), as well as assorted bags and sacks including but not limited to cement bags, feed bags, SOS bags, shopping bags, die-cut handle bags, liquor bags, and lawn and leaf bags. Such paper materials may typically have a basis weight of 30 to 120 gsm, 30 to 90 gsm, 30 to 70 gsm, 70-120 gsm, 70-110 gsm, 70-90 gsm, or 110-120 gsm, depending on the particular application. Brown paper towel material (e.g., as used for hand drying in commercial bathrooms) may often have a basis weight of 20-30 lbs (e.g., 75 to 120 gsm). Those of skill in the art will be familiar with conversion between lb and gsm basis weight values.

Another advantage of using the present non-wood agricultural fiber pulp materials is that such materials include negligible if any sulfur, in contrast to wood fiber materials, which include significant sulfur.

In addition to kraft paper, liner and medium as described herein, the present non-wood pulp materials can also be used in the molding or thermoforming of molded pulp products, such as egg cartons, molded disposable "paper" plates, other food related containers, or various molded pulp products used for packaging consumer goods. Such molded pulp products are disposable single use products. Such molded pulp products have historically been formed from recycled newsprint, although the volume of available newsprint has drastically declined in recent years. Use of the present non-wood agricultural feedstock pulp materials can be used for molded pulp products, and will provide greater rigidity than comparable materials currently used in the manufacture of such products. For example, the agricultural fiber pulp can be introduced into a molded pulp product manufacturing machine (e.g., a pulp chest thereof) to make a molded pulp product from the agricultural fiber pulp. Such a process may include wet pressing and/or thermoforming. Another example product that can be formed using the present processes is cardboard tubes and cores (e.g., for rolls of toilet paper, rolls of paper towels, mailing tubes, as well as chipboard or grayboard (i.e., rigid container board). Such products may typically have a thickness from 0.5 mm to 5 mm.

In an embodiment, blending of corn stover pulp or another agricultural pulp fiber pulp material with OCC may serve to preserve a desired freeness value of the corn stover pulp or other agricultural pulp material, where the OCC is included as a majority of the blend. For example, when running 100% corn stover pulp through a refiner, the corn stover fibers are significantly damaged, resulting in significant loss of freeness. Applicant has found though that where such corn stover pulp material is run through a refiner as a minority component of a blend with OCC, that the freeness of the corn stover pulp material is surprisingly protected and preserved. For example, in an embodiment, the corn stover run through a refiner in such a blend may be present at less than 50%, less than 40%, less than 30%, less than 20%, less than 10%, at least 3%, at least 5%, such as from 3% to 25%. Such is another advantage of preparing a corn stover or similar non-wood agricultural pulp material through a cooking process as described herein, and then blending such pulp material with OCC or a similar wood pulp material, and then refining such blend (e.g., in a pulper).

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition.

As used herein, the term "between" includes any referenced endpoints. For example, "between 2 and 10" includes both 2 and 10.

Although this disclosure has been described in terms of certain embodiments, other embodiments apparent to those of ordinary skill in the art are also within the scope of this disclosure. Accordingly, the scope of the disclosure is intended to be defined only by the claims which follow.

What is claimed is:

1. A method comprising:

providing non-wood agricultural feedstock material that includes agricultural fibers, and reducing the size of such agricultural fibers to a desired length, and mechanically refining such agricultural fibers;

chemically pulping the agricultural fibers in an alkaline chemical pulping process to produce an agricultural fiber pulp, wherein chemically pulping the agricultural fibers is achieved at a temperature of less than 100° C. and unpressurized conditions throughout the entire chemical pulping process, without addition of any acids or enzymes, and wherein the method is performed without the use of ozone, and without any bleaching, wherein the agricultural fiber pulp is of high quality, present as fiber bundles of a plurality of fibers including 2 to 50 fibers; and introducing the agricultural fiber pulp into a molded pulp product manufacturing machine to make as molded pulp product from the agricultural fiber pulp.

2. The method of claim 1, wherein the non-wood agricultural feedstock material comprises at least one of corn stover, hemp, wheat straw, rice straw, soybean residue, cotton residue, switchgrass, miscanthus, DDGS, bamboo, or sugarcane bagasse.

3. The method of claim 1, wherein the agricultural fiber pulp is combined with at least one of OCC pulp, double lined kraft (DLK), or virgin wood pulp to make the molded pulp product.

4. The method of claim 1, wherein chemically pulping the agricultural fibers is achieved in a 2-step cooking process, comprising:

introducing the agricultural fibers into a first reactor, wherein the first reactor operates at a low temperature of less than 100° C., and where the agricultural fibers are processed in a first alkali concentration;

introducing the agricultural fibers from the first reactor into a second reactor, where the second reactor operates at a low temperature, of less than 100° C., the second reactor operating at a higher temperature than the first reactor, to produce the agricultural fiber pulp, wherein the agricultural fibers are processed in a second alkali concentration that is higher than the first alkali concentration of the first reactor.

5. The method of claim 1, wherein chemically pulping the agricultural fibers includes chemically pulping with a sodium hydroxide or other active alkali concentration of from 4 g/L to less than 40 g/L, or an active alkali (relative to the agricultural feedstock material) value of from 5% to 30%, for a period of time of from 30 minutes to 5 hours, at a temperature of less than 100° C.

6. The method of claim 1, wherein a yield of the agricultural fibers in the molded pulp product is at least 40%, at least 50%, at least 60%, at least 70%, or at least 80% by weight.

7. The method of claim 1, wherein the molded pulp product includes at least 3% by weight of agricultural fibers.

8. The method of claim 1, wherein reducing the size of such agricultural fibers to a desired length, and mechanically refining such agricultural fibers in preparation for pulping comprises (i) chopping or shredding, (2) milling, and/or (3) screening such agricultural fibers, wherein such (i) chopping or shredding, (2) milling, and/or (3) screening such agricultural fibers is achieved in a low consistency pulper.

9. The method of claim 1, wherein reducing the size of the agricultural fibers to a desired length and mechanically refining such fibers occurs before, during or after chemical pulping.

10. The method of claim 1, wherein the molded pulp manufacturing machine performs at least one of wet pressing or thermoforming of the agricultural fiber pulp to form the molded pulp product.

11. The method of claim 10, wherein the molded pulp product comprises at least one of an egg carton, a molded disposable "paper" plate, a food container, or a molded pulp product used for packaging consumer goods, wherein the molded pulp product is a disposable single use product.

12. A product, comprising the molded pulp product formed by the method of claim 1.

13. The product as recited in claim 12, wherein the product comprises at least one of an egg carton, a molded disposable "paper" plate, a food container, or a molded pulp product used for packaging consumer goods, wherein the molded pulp product is a disposable single use product.

14. The product as recited in claim 12, wherein the product comprises a single use food container.

15. The product as recited in claim 12, wherein the molded pulp product comprises at least one of a waterproofing agent or a sizing agent.

16. The method of claim 1, wherein reducing the size of the agricultural fibers to a desired length and mechanically refining such fibers occurs during or after chemical pulping.

17. The method of claim 5, wherein chemically pulping the agricultural fibers is achieved in a continuous screw digester, with a residence time of from 1 to 5 hours.

18. The method of claim 1, wherein the molded pulp product includes 10% to 100% by weight of agricultural fibers.

19. The method of claim 1, wherein reducing the size of such agricultural fibers to a desired length, and mechanically refining such agricultural fibers in preparation for pulping comprises hammermilling the agricultural fibers.

20. A method comprising:

providing non-wood agricultural feedstock material that includes agricultural fibers, and reducing the size of such agricultural fibers to a desired length, and mechanically refining such agricultural fibers, wherein such agricultural fibers comprise corn stover;

chemically pulping the agricultural fibers in an alkaline chemical pulping process to produce an agricultural fiber pulp, wherein chemically pulping the agricultural fibers includes chemically pulping with a sodium hydroxide concentration of from 4 g/L to less than 40 g/L, or a sodium hydroxide active alkali (relative to the agricultural feedstock material) value of from 5% to 30%, wherein chemically pulping the agricultural fibers is achieved at a temperature of from 60° C. to 99° C. and unpressurized conditions, wherein chemically pulping the agricultural fibers is achieved without addition of any acids or enzymes, wherein the agricultural fiber pulp is of high quality, present as fiber bundles of a plurality of fibers including 2 to 50 fibers; and introducing the agricultural fiber pulp into a molded pulp product manufacturing machine to make a molded pulp product from the agricultural fiber pulp.

21. The method of claim 1, wherein chemically pulping the agricultural fibers in the alkaline chemical pulping process is achieved using a liquor that consists essentially of water and caustic.

22. The method of claim 20, wherein chemically pulping the agricultural fibers is achieved in a 2-step cooking process, comprising:

introducing the agricultural fibers into a first reactor, wherein the first reactor operates at a low temperature of less than 100° C., and where the agricultural fibers are processed in a first sodium hydroxide concentration of from 4 g/L to less than 40 g/L;

introducing the agricultural fibers from the first reactor into a second reactor, where the second reactor operates at a low temperature, of less than 100° C., the second reactor operating at a higher temperature than the first reactor, to produce the agricultural fiber pulp, wherein the agricultural fibers are processed in a second sodium hydroxide concentration that is higher than the first sodium hydroxide concentration of the first reactor.

* * * * *